US008746541B2

(12) United States Patent
Spivey, Sr. et al.

(10) Patent No.: US 8,746,541 B2
(45) Date of Patent: Jun. 10, 2014

(54) BAG-IN-A-BOX

(75) Inventors: Raymond Rudolph Spivey, Sr., Mableton, GA (US); Patrick J. DeBusk, Larue, TX (US); Colin Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 381 days.

(21) Appl. No.: 13/170,744

(22) Filed: Jun. 28, 2011

(65) Prior Publication Data

US 2011/0259916 A1 Oct. 27, 2011

Related U.S. Application Data

(62) Division of application No. 11/367,912, filed on Mar. 3, 2006, now abandoned.

(60) Provisional application No. 60/658,508, filed on Mar. 4, 2005, provisional application No. 60/658,509, filed on Mar. 4, 2005, provisional application No. 60/703,552, filed on Jul. 27, 2005.

(51) Int. Cl.

| | |
|---|---|
| ***B65D 3/00*** | (2006.01) |
| ***B65D 5/56*** | (2006.01) |
| ***B67D 7/06*** | (2010.01) |

(52) U.S. Cl.

USPC ..... 229/117.3; 229/117.35; 229/117.13; 222/185.1

(58) Field of Classification Search

USPC ..... 229/117.35, 117.3, 117.13; 222/185.1

See application file for complete search history.

(56) References Cited

U.S. PATENT DOCUMENTS

| | | | | | |
|---|---|---|---|---|---|
| 3,054,549 | A | * | 9/1962 | Humphrey | 229/117.3 |
| 3,087,655 | A | * | 4/1963 | Scholle | 222/183 |
| 3,173,579 | A | * | 3/1965 | Curie et al. | 222/105 |
| 3,178,242 | A | * | 4/1965 | Ellis et al. | 312/45 |
| 3,184,117 | A | * | 5/1965 | Sanderson | 222/183 |
| 3,233,817 | A | * | 2/1966 | Casady | 229/117.3 |
| 3,521,741 | A | * | 7/1970 | Beaudry | 229/117.17 |
| 3,640,380 | A | | 2/1972 | Huffman | |
| 3,756,471 | A | | 9/1973 | Wissman | |
| 4,069,917 | A | * | 1/1978 | Stollberg et al. | 206/423 |
| 4,121,757 | A | * | 10/1978 | Hamlin | 229/117.13 |

(Continued)

FOREIGN PATENT DOCUMENTS

| | | | |
|---|---|---|---|
| CA | 2000971 | A1 | 4/1990 |
| DE | 89 09 888 | U1 | 12/1989 |

(Continued)

*Primary Examiner* — J. Gregory Pickett
*Assistant Examiner* — Latrice Byrd
(74) *Attorney, Agent, or Firm* — Womble Carlyle Sandridge & Rice, LLP

(57) ABSTRACT

A package includes a carton having an access opening that is for providing access to the interior of the carton. The package further includes a flexible bag that is positioned in the interior of the carton, and a spigot that is operatively connected to the bag for selectively dispensing flowable material from the bag. A holder is cooperatively associated with the spigot and the carton for holding the spigot so that the spigot is simultaneously proximate the access opening of the carton and disposed at least partially within the interior of the carton, so that access to the spigot is at least temporarily restricted in a manner that at least temporarily restricts any dispensing of flowable material from the bag by way of the spigot.

31 Claims, 34 Drawing Sheets

(56) References Cited

U.S. PATENT DOCUMENTS

| | | | | |
|---|---|---|---|---|
| 4,169,539 | A | 10/1979 | Price | |
| 4,322,018 | A | 3/1982 | Rutter | |
| 4,331,289 | A * | 5/1982 | Killy | 229/117.13 |
| 4,560,090 | A | 12/1985 | Okushita | |
| D305,304 | S | 1/1990 | McCaleb | |
| 4,919,306 | A | 4/1990 | Heaps, Jr. et al. | |
| 5,069,359 | A | 12/1991 | Liebel | |
| 5,201,462 | A | 4/1993 | Sada et al. | |
| 5,228,589 | A * | 7/1993 | Della Riva | 206/229 |
| 5,265,753 | A | 11/1993 | Moorman | |
| 5,482,179 | A | 1/1996 | Bruhn | |
| 5,632,402 | A | 5/1997 | Walsh et al. | |
| 5,632,404 | A | 5/1997 | Walsh | |
| 5,735,429 | A | 4/1998 | Whitworth | |
| 5,746,871 | A | 5/1998 | Walsh | |
| 5,749,489 | A | 5/1998 | Benner et al. | |
| 5,783,030 | A | 7/1998 | Walsh | |
| 5,788,121 | A | 8/1998 | Sasaki et al. | |
| 5,794,811 | A | 8/1998 | Walsh | |
| 5,794,812 | A | 8/1998 | Walsh | |
| 5,803,346 | A | 9/1998 | Baker et al. | |
| 5,826,752 | A * | 10/1998 | Latimer | 222/105 |
| 5,909,841 | A | 6/1999 | Andrews, Sr. et al. | |
| 5,918,799 | A | 7/1999 | Walsh | |
| 6,062,431 | A * | 5/2000 | Geshay | 222/105 |
| 6,273,332 | B1 | 8/2001 | Todjar-Hengami | |
| 6,352,096 | B1 | 3/2002 | Walsh | |
| 6,443,329 | B1 * | 9/2002 | Rochefort et al. | 222/105 |
| 6,644,510 | B2 | 11/2003 | Kawolics et al. | |
| 6,644,540 | B2 | 11/2003 | Jamitzky et al. | |
| 6,648,218 | B2 | 11/2003 | Katsuyama et al. | |
| 6,736,289 | B2 * | 5/2004 | Cook et al. | 222/105 |
| 6,755,324 | B2 | 6/2004 | Geshay | |
| 6,786,394 | B2 * | 9/2004 | Prince | 229/117.3 |
| 6,827,237 | B2 | 12/2004 | Yorn et al. | |
| 6,971,550 | B2 | 12/2005 | Kuge et al. | |
| 7,007,825 | B2 * | 3/2006 | Crosland et al. | 222/105 |
| 7,080,758 | B2 | 7/2006 | Jones | |
| 7,244,064 | B2 | 7/2007 | Sullivan, Jr. | |
| 7,350,670 | B2 | 4/2008 | Steeves et al. | |
| 7,389,909 | B2 | 6/2008 | Crosland et al. | |
| 7,571,835 | B2 | 8/2009 | Hill et al. | |
| 7,681,783 | B2 * | 3/2010 | Stephenson | 229/117.3 |
| 7,798,711 | B2 | 9/2010 | Plunkett et al. | |
| 2003/0155372 | A1 | 8/2003 | Yorn et al. | |
| 2003/0183650 | A1 | 10/2003 | Muise et al. | |
| 2004/0089672 | A1 | 5/2004 | Crosland et al. | |
| 2004/0164136 | A1 | 8/2004 | Harrelson | |
| 2005/0040063 | A1 | 2/2005 | Churvis et al. | |
| 2005/0051611 | A1 | 3/2005 | Ingalls | |
| 2006/0180643 | A1 | 8/2006 | Stephenson | |
| 2010/0065581 | A1 | 3/2010 | Thomason | |
| 2010/0127057 | A1 | 5/2010 | Burke | |
| 2010/0327027 | A1 | 12/2010 | Kasai | |
| 2011/0000918 | A1 | 1/2011 | Plunkett et al. | |

FOREIGN PATENT DOCUMENTS

| | | | |
|---|---|---|---|
| EP | 0 359 968 | A1 | 3/1990 |
| EP | 0 361 042 | A1 | 4/1990 |
| EP | 0 365 941 | A1 | 5/1990 |
| EP | 0 576 333 | A1 | 12/1993 |
| EP | 0 582 532 | A1 | 2/1994 |
| JP | 56-84966 | | 7/1981 |
| JP | 08282647 | | 10/1996 |
| WO | WO 02/083510 | A1 | 10/2002 |

* cited by examiner

BAG-IN-A-BOX

CROSS-REFERENCE TO RELATED APPLICATIONS

This application is a divisional application of U.S. patent application Ser. No. 11/367,912, filed Mar. 3, 2006, which claims the benefit of each of U.S. Provisional Application No. 60/658,508, filed Mar. 4, 2005, U.S. Provisional Application No. 60/658,509, filed Mar. 4, 2005, and U.S. Provisional Application No. 60/703,552, filed Jul. 27, 2005.

INCORPORATION BY REFERENCE

The entire disclosure of each of the following is incorporated herein by reference: U.S. patent application Ser. No. 11/367,912, filed Mar. 3, 2006; U.S. Provisional Application No. 60/658,508, filed Mar. 4, 2005; U.S. Provisional Application No. 60/658,509, filed Mar. 4, 2005; and U.S. Provisional Application No. 60/703,552, filed Jul. 27, 2005.

BACKGROUND OF THE INVENTION

Bag-in-a-box packages are well known. As one example, it is common to provide a beverage in a bag-in-a-box package, with the beverage more specifically being within the fluid-impervious bag of the package, and the bag being within the box-shaped carton of the package. The bag is typically closed by a spigot that can be used to dispense the beverage from the bag. In one type of bag-in-a-box package, it is common for the carton to have to be torn, so that the spigot can be manually retrieved from within the carton and manually mounted to an exterior sidewall of the carton, and thereafter the beverage is dispensed from the spigot.

One advantage of a bag-in-a-box package is that it can prevent oxidation of the beverage within the bag, because the bag typically collapses as the beverage is dispensed so that air does not enter the bag. On the other hand, some users of the above-described type of bag-in-a-box packages consider the need to manually mount the spigot to an exterior sidewall of the carton to be an inconvenience. For this and/or other reasons, there is a desire for improvements in bag-in-a-box packages and associated features.

SUMMARY OF SOME ASPECTS OF THE PRESENT INVENTION

One aspect of the present invention is the provision of a package for dispensing flowable material. The package includes a carton having an access opening that is for providing access to the interior of the carton. The package further includes a flexible bag that is positioned in the interior of the carton, and a spigot that is operatively connected to the bag for selectively dispensing the flowable material from the bag. A holder can be cooperatively associated with the spigot and the carton for holding the spigot so that the spigot is simultaneously proximate the access opening of the carton and disposed at least partially within the interior of the carton, so that access to the spigot is at least temporarily restricted in a manner that at least temporarily restricts any dispensing of the flowable material. In accordance with some of the embodiments of the present invention, the entire spigot can be completely enclosed within the interior of the carton while the spigot is being held by the holder.

One advantageous aspect of some of the embodiments of the present invention is that the spigot is held by the holder in a predetermined manner so that the spigot can conveniently be used to discharge the flowable material from the bag immediately after the carton is opened. That is, and an accordance with this aspect, an end user of the package is not required to mount the spigot, because it is premounted.

In accordance with some of the embodiments of the present invention, the holder can be a portion of the carton or a portion of a liner that at least partially lines the carton. In accordance with one example, the bag, such as a neck of the bag, can be mounted to the blank, or to the partially erected blank, from which the carton or liner is erected, and this mounting can occur either before or after the bag is filled.

In accordance with one example in which the holder is a portion of the carton, the holder is more specifically a holding panel that extends into the interior of the carton and includes a gripping opening that is positioned in the interior of the carton. A neck, or the like, of the bag can be mounted to the gripping opening so that the neck is simultaneously within the interior of the carton and proximate the access opening of the carton.

In accordance with one example in which the holder is a portion of a liner, the liner at least partially lines the interior of the carton, extends at least partially around the bag, and holds the bag's neck, or the like, so that the neck is simultaneously within the interior of the carton and proximate the access opening of the carton. A cover panel can at least partially close the carton's access opening so that the cover panel obstructs access to at least the neck.

Other aspects and advantages of the present invention will become apparent from the following.

BRIEF DESCRIPTION OF THE DRAWINGS

Some aspects of the present invention will be described in the following with reference to the accompanying drawings, which are not necessarily drawn to scale, and wherein.

DETAILED DESCRIPTION OF EXEMPLARY EMBODIMENTS

Figure 6:
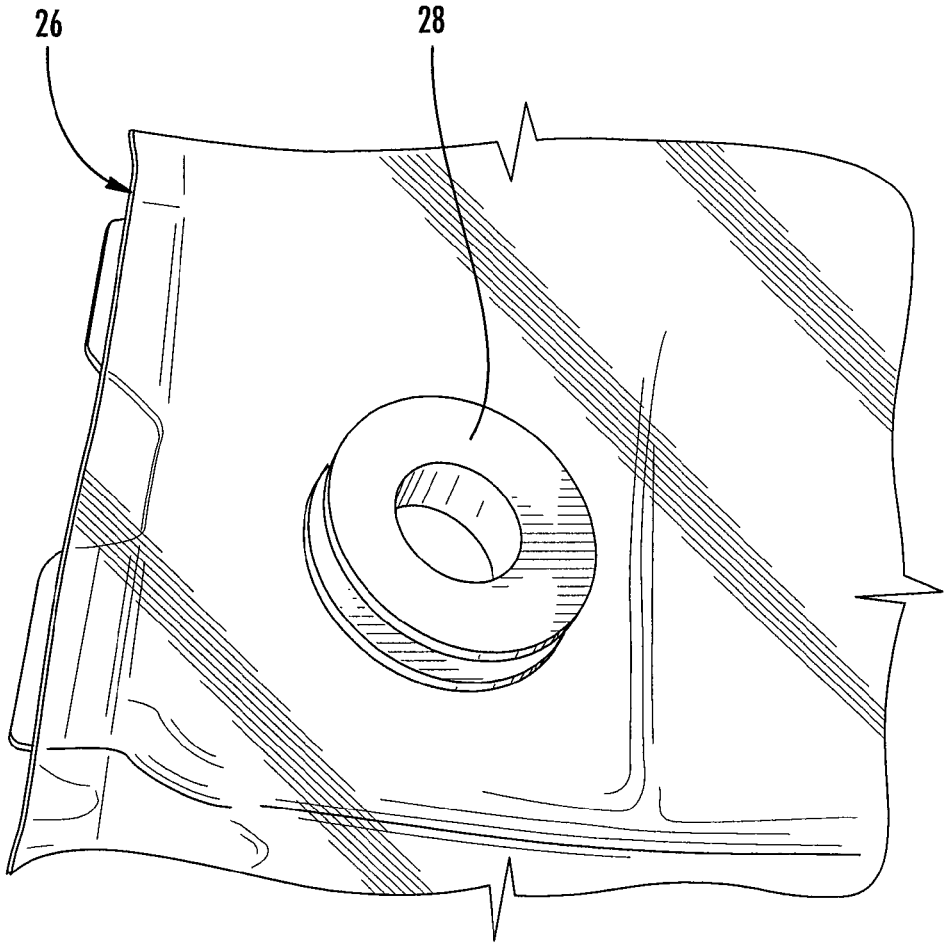
FIG. 6 is a pictorial view of a portion of a bag and associated neck, in accordance with the first embodiment of the present invention.
Figure 7:
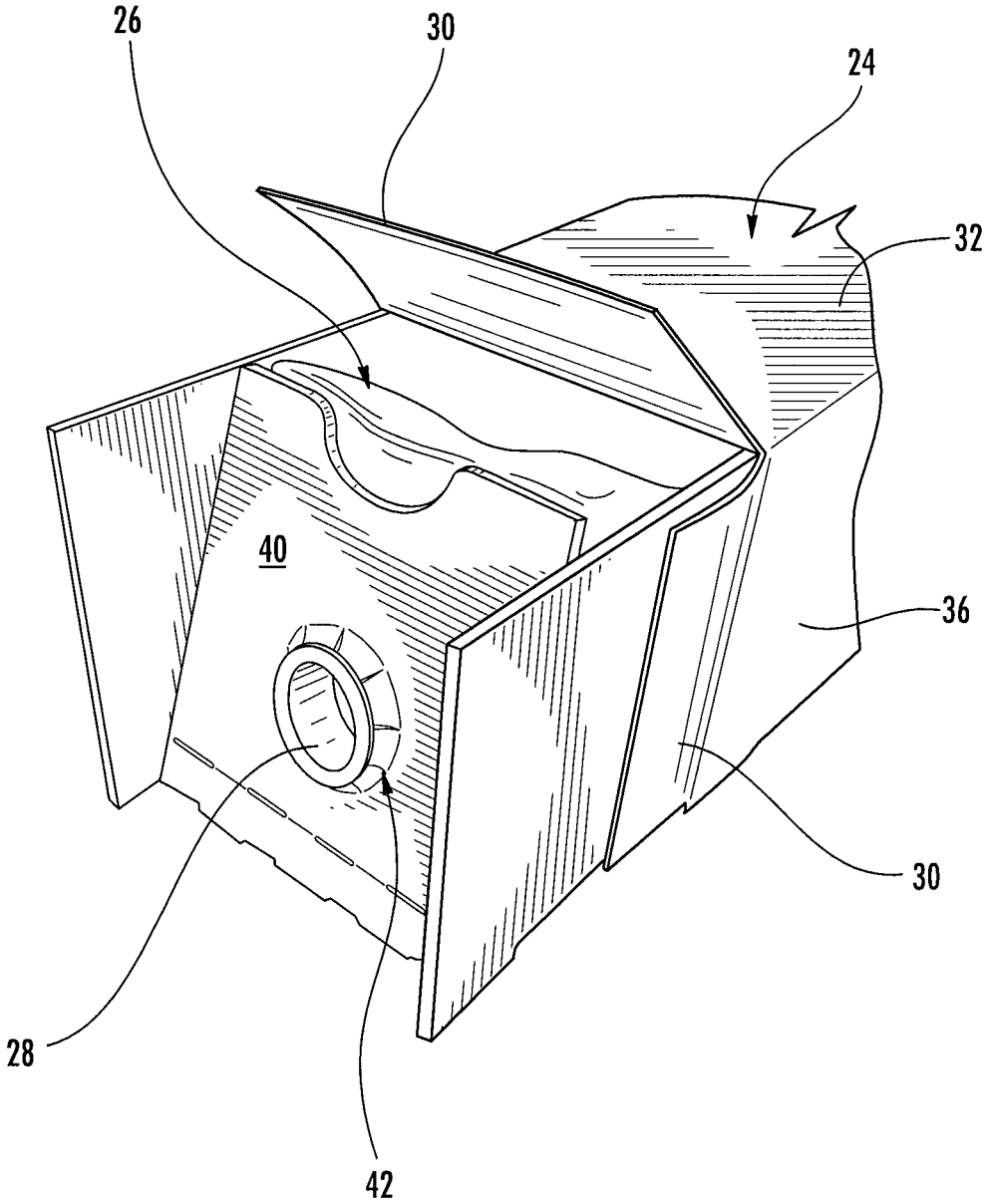
FIG. 7 is a pictorial, partial view of the liner of FIG. 1 partially inserted into a box and having the bag of FIG. 6 fastened thereto, in accordance with the first embodiment of the present invention.

Referring now in greater detail to the drawings, in which like numerals refer to like parts throughout the several views, a first embodiment of the present invention will be described with reference to FIGS. 1-10. More specifically, a liner 20 (FIGS. 1-4) and items it can be associated with to form a bag-in-a-box package 21 (FIG. 8) will be described in accordance with the first embodiment of the present invention. Generally described, the liner 20 can be erected from a blank 22 (FIG. 5) and used to at least partially line a box 24 (FIGS. 7-10) that also contains a flexible bag 26 (FIGS. 6 and 7). In accordance with the first embodiment of the present invention, the box 24 is a carton, although it can be more generally referred to as a construct or an outer container.

The flexible bag 26 is for containing a flowable material, such as a fluid (e.g., beverage), fine powders, salts, or other flowable materials. The flexible bag 26 typically includes a neck 28 that defines a passageway that is in fluid communication with the bag's interior and by way of which the flowable material can be received into, and discharged from, the bag. Advantageously, the liner 20 can support the neck 28 and/or bag 26, and/or reinforce the box 24, as will be discussed in greater detail below.

In accordance with the first embodiment, the box 24 is a rectangular parallelepiped when closed. As best understood with reference to FIGS. 8-10, the box 24 has an access opening 29 at its front end, for providing access to the interior of the box 24. The access opening 29 can be opened and closed by the box's front cover panel. The front cover panel is typically in the form of four front flaps 30 respectively foldably connected along fold lines to the front edges of the top, bottom, right side and left side panels 32, 34, 36, 38 of the box 24. The front cover panel can be used for opening and closing the box's access opening 29.

Similarly, the box has a rear end (not shown) that is primarily kept closed by a rear cover panel (not shown). The rear cover panel is typically in the form of four rear flaps (not shown, but similar to the front flaps 30) respectively foldably connected along fold lines to the rear edges of the top, bottom, right side and left side panels 32, 34, 36, 38 of the box 24. Other types of cover panels are also within the scope of the present invention.

Figure 8:
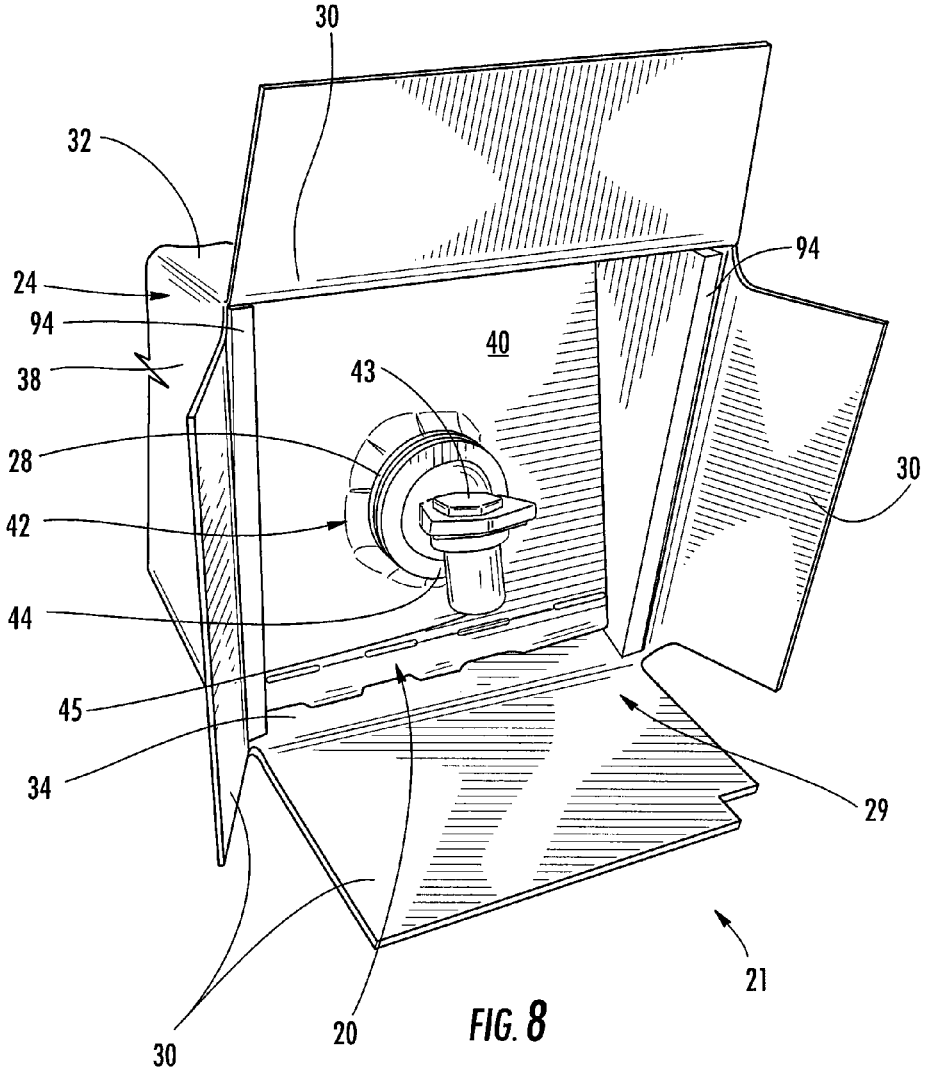
FIG. 8 is a partial, pictorial view of the liner fully inserted into the box and having the bag fastened thereto, with a spigot mounted to the bag's neck, in accordance with the first embodiment of the present invention.
Figure 9:
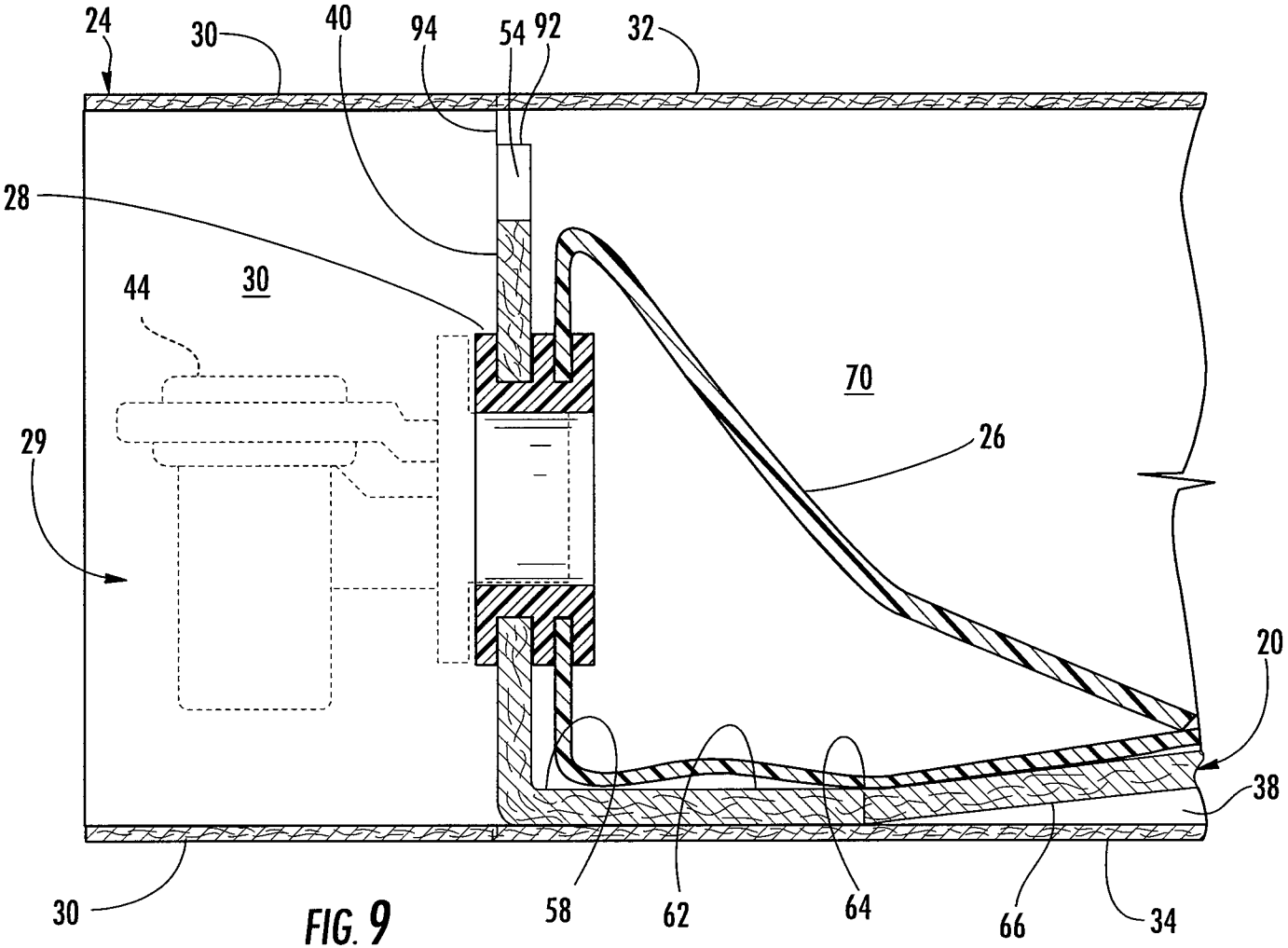
FIG. 9 is a schematic, cross-sectional, partial view of the liner fully inserted into the box with the bag and its neck attached thereto, with the insert's holding flap in a forward position and the spigot illustrated by broken lines, and line 9-9 of FIG. 1 generally indicates where the cross-section has been taken, in accordance with the first embodiment of the present invention.
Figure 10:
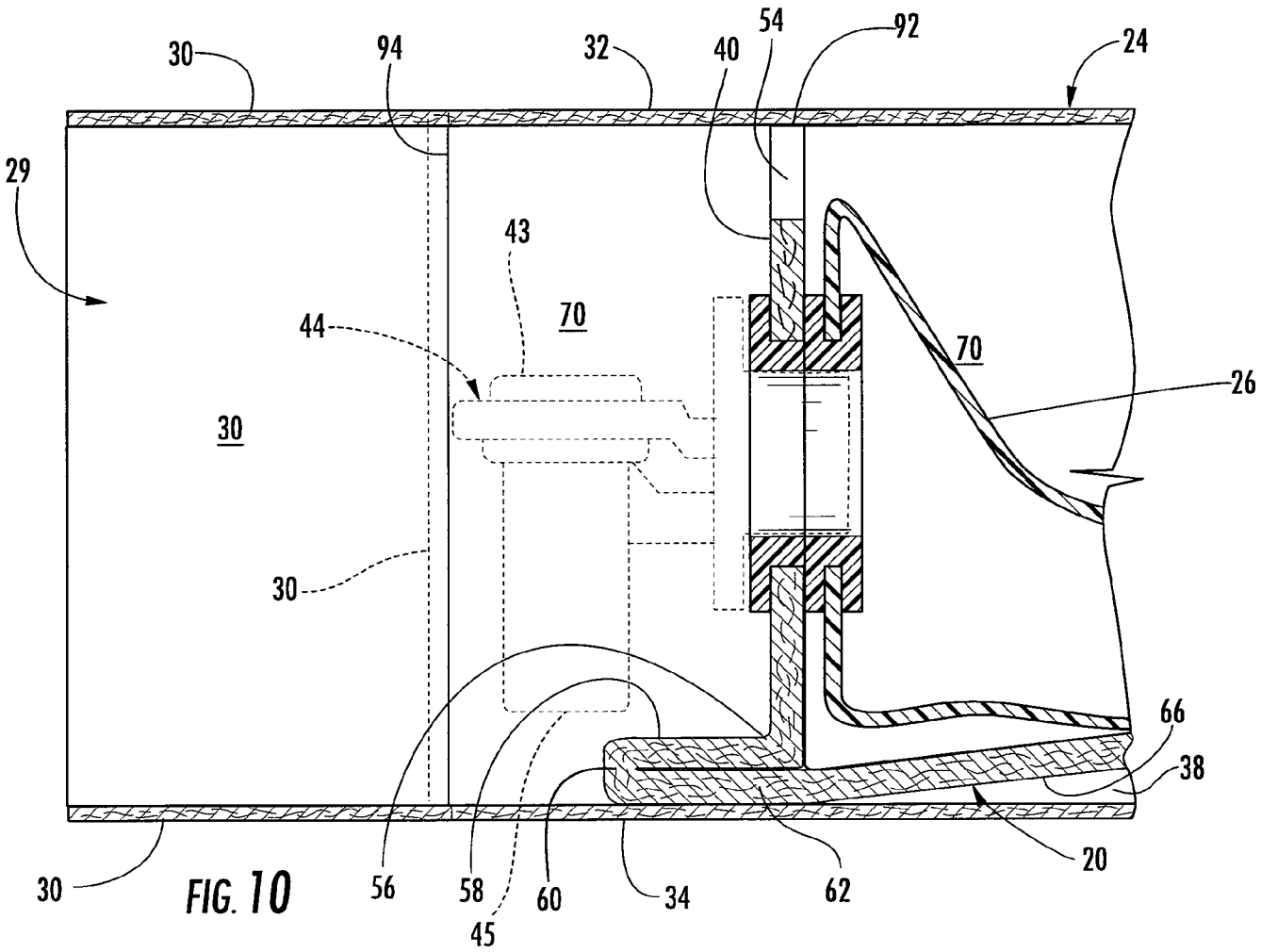
FIG. 10 is like FIG. 9, except that the insert's holding flap is in a rearward position, in accordance with the first embodiment of the present invention.

As best understood primarily with reference to FIGS. 8-10, while the liner 20 is fully inserted within the open box 24 and the bag 26 is also within the box 24, a holding flap 40 of the liner 20 is proximate the box's access opening 29 and can hold the bag's neck 28 by virtue of the neck extending through a gripping opening 42 (also see FIGS. 1, 2 and 5) in the insert's holding flap. The holding flap 40 can also be referred to as a holding panel. More generally, the holding flap 40 can be referred to a holder, because it can hold the bag 26, or as a more specific example it can hold the neck 28 of the bag or another component, in a manner that advantageously results in the bag or item(s) associated therewith being advantageously positioned with respect to the box, as will be discussed in greater detail bellow. In accordance with the first embodiment of the present invention, the insert's holding flap 40 is pivotably connected to one or more other panels of the liner 20 so that the insert's holding flap can be moved between forward and rearward positions (FIGS. 9 and 10, respectively) while the holding flap is holding the bag's neck 28.

As best understood with reference to FIG. 9, with the insert's holding flap 40 in the forward position and holding the neck 28, the neck is conveniently proximate the box's access opening 29, such as for conveniently dispensing fluid into or from the bag 26, as will be discussed in greater detail below. In this regard, while the insert's holding flap 40 is in the forward position and holding the neck 28, an optionally associated spigot 44 (schematically illustrated by broken lines in FIG. 9), or the like, is conveniently proximate the box's access opening 29, as will be discussed in greater detail below. Whereas the front flaps 30 are shown folded 90 degrees away from the access opening 29 in FIG. 9, one or more of the front flaps, such as the bottom front flap, can be folded farther away from the access opening (e.g., 180 degrees away from the access opening) for optimizing access to the neck 28 and/or spigot 44.

As best understood with reference to FIG. 10, while the insert's holding flap 40 is in its rearward position and holding the neck 28, the neck is conveniently at least slightly rearward of (e.g., recessed from) the box's access opening 29 in a manner that seeks to keep the neck, and the optionally associated spigot 44, or the like, from: (1) interfering with the closing of the box's access opening 29 (e.g., with front flaps 30), and (2) interfering with maintaining the box's access opening 29 in its closed configuration. Whereas the front cover panel (e.g., front flaps 30) is illustrated by solid lines in an open configuration in FIG. 10, FIG. 10 is schematic in that the spigot 44 is illustrated by broken lines and the front cover panel (e.g., front flaps 30) is illustrated by broken lines as being in a closed configuration in which it closes the box's access opening 29. In this closed configuration, the front cover panel (e.g., front flaps 30) obstruct access to the spigot 44 and associated features, such as the neck 28. More specifically and in accordance with the first embodiment of the present invention, while the front cover panel (e.g., front flaps 30) is closed, access to the spigot 44 is at least temporarily restricted by the front cover panel in a manner that at least temporarily restricts any dispensing of flowable material from the bag 26 by way of the spigot.

In accordance with the first embodiment of the present invention, while the insert's holding flap 40 is in its rearward position and holding the neck 28, the discharge opening 45 of the spigot 44 and the button-like actuator 43 of the spigot are simultaneously within the interior of the box 24 and proximate the box's access opening 29. More specifically, the entire spigot 44, neck 28 and holding flap 40 are within the interior of the box 24.

The liner 20 can be erected from the blank 22 illustrated in FIG. 5, and in the following the blank is described in its flat/planar configuration, in accordance with the first embodiment of the present invention. The gripping opening 42 in the holding flap 40 can be what is referred to by some as a "starburst hole". More specifically, in a sheet, such as a sheet of corrugated cardboard, from which the blank 22 was formed, the gripping opening 42 is provided, in part, by an annular slit that is circular or polygonal (e.g., with ten sides), or the like, and originally extended around a piece of the sheet that has been discarded (e.g., culled) and is not included in the blank 22. The edge resulting from this slit extends around the central opening 46 of the gripping opening 42.

An outer annular score line 48 that is circular or polygonal (e.g., with ten sides), or the like, can be concentric with the central opening 46. Multiple radial slits 50 extend radially between the central opening 46 and the annular score line 48 to define multiple radial tabs 52. The radial tabs 52 are hingedly connected to the remainder of the holding flap 40 at the annular score line 48. Only a representative few of the radial slits 50 and tabs 52 are identified by their reference numerals in FIG. 5 in an effort to clarify the view. The annular score line 48 can be omitted to increase the rigidity of the tabs 52, and the number of tabs 52 can vary.

In the sheet from which the blank 22 was formed, opposite ends of an arcuate slit extended to an edge 92 of the holding flap 40 so that the arcuate slit separated a piece of the sheet that was discarded (e.g., culled) and is not included in the blank. The edge resulting from this arcuate slit defines an arcuate handhold 54, as will be discussed in greater detail below. The handhold 54 can be shaped differently than is shown in the respective figures, or it can even be omitted.

In the exemplary blank 22, the holding flap 40 is foldably attached by a forward lateral fold line 56 to an edge of a relatively active pleat panel 58, the opposite edge of the active pleat panel is foldably attached by an intermediate lateral fold line 60 to an edge of a relatively passive pleat panel 62, and the opposite edge of the passive pleat panel is foldably attached by a rearward lateral fold line 64 to an edge of a base panel 66. The active pleat panel 58 can be characterized as "active" because the folding and unfolding of it along the forward and intermediate lateral fold lines 56 and 60 can at least partially provide the transition between the above-mentioned forward and rearward positions of the holding flap 40. On the other hand, the passive pleat panel 62 can be characterized as "passive" because it is not required to be folded and unfolded along the intermediate and rearward lateral fold lines 60 and 64 to transition between the forward and rearward positions of the holding flap 40.

Opposite edges of the base panel 66 are respectively foldably attached by longitudinal fold lines 68 to side panels 70. The fold line 78, by way of which the holding flap 40 is foldably attached to the base panel 66, is positioned rearwardly of forward edges 94 of the side panels 70. Each of the longitudinal fold lines 68 includes segments that are respectively spaced apart from one another by tab-like projections of the side panels 70; these tab-like projections extend into the base panel 66 and can be referred to as rearward projections 72 because they are positioned relatively rearward of the holding flap 40. Other tab-like projections of the side panels 70 are adjacent the active and passive pleat panels 58, 62, and these projections can be referred to as forward projections 74 because they are proximate the holding flap 40. The tab-like rearward and forward projections 72, 74 are optional, but they can advantageously be used as legs of the liner 20, as will be discussed in greater detail below.

Each of the forward projections 74 is formed by an oblique slit 76 and a longitudinal slit 78. Each oblique slit 76 extends generally forwardly from the forward end of the respective longitudinal fold line 68. Each longitudinal slit 78 extends forwardly from the forward end of the respective oblique slit 76, to the forward lateral fold line 56.

Each of the rearward projections 72 is defined by a respective group of slits. Each group of slits can include two straight lateral slits 80 and a straight oblique slit 82. In each group of slits, the lateral slits 80 are spaced apart from one another and extend inwardly from the respective longitudinal fold line 68, and the oblique slit 82 extends between ends of the lateral slits. Two of the oblique slits 82 are collinear with a straight, oblique, dashed imaginary line 84 that is parallel to an oblique outer edge 86 of the adjacent side panel 70. Similarly, the two other oblique slits 82 are collinear with another straight, oblique, dashed imaginary line 88 that is parallel to an oblique outer edge 90 of the adjacent side panel 70. (The side panel's outer edges 86, 90 are also referred to as the side panel's upper edges in the erected liner 20).

In the blank 22 of the first embodiment: each of the lateral fold lines 56, 60, 64, the lateral slits 80, the holding flap's forward edge 92 (which is also referred to as the holding flap's top edge in the erected liner 20), the side panel's forward edges 94, the side panel's rearward edges 96, and the base panel's rearward edge 98 extend in a lateral direction; each of the longitudinal fold lines 68, the longitudinal slits 78 and the holding flap's side edges 100 extend in a longitudinal direction; the lateral and longitudinal directions are perpendicular to one another; and each of the oblique slits 76, 82, the side panels' outer edges 86, 90, and the imaginary lines 84, 88 extend obliquely to the longitudinal and lateral directions.

The slits 50, 76, 78, 80, 82 are typically cuts that extend completely through the blank 22. Each of the fold lines 56, 60, 64, 68 can be a score line or any other type of line for facilitating folding, such as a score line that includes an alternating series of slits or cuts that extend coextensively along, and optionally all the way through, the score line. For example, in the blank 22 of the first embodiment, the forward and intermediate lateral fold lines 56, 60 are each in the form of a score line that includes an alternating series of slits or cuts that extend coextensively along, and completely through, the score line; whereas the other fold lines 64, 68 are solely in the form of score lines. Having the forward and intermediate lateral fold lines 56, 60 each in the form of a score line that includes an alternating series of slits or cuts that extend coextensively therealong and therethrough can facilitate easy folding along these fold lines, which can be advantageous since folding along them typically occurs more than once for facilitating the transitioning between the forward and rearward positions of the insert's holding flap 40. A blank (e.g., the blank 22), a partially erected blank, or a fully erected blank (e.g., the liner 20) can each be generally referred to as a construct.

The box 24 can be an at least generally conventional carton constructed of paperboard or corrugated cardboard, or the like. The blank 22 for forming the liner 20 can also be paperboard or corrugated cardboard, or the like. In accordance with the first embodiment of the present invention, the blank 22 is corrugated cardboard, and the lengthwise direction of each of the flutes of the cardboard extends perpendicular to the direction in which the holding flap's side edges 100 extend; and the box 24 is constructed of paperboard. Other construction materials are also within the scope of the present invention.

In the following, acceptable methods of erecting the liner 20 from the blank 22 and using the liner with the box 24 and bag 26 are described, in accordance with the first embodiment of the present invention. These methods can be best understood in view of, and will thereby follow, a more detailed description of the bag 26 and neck 28.

The bag 26 and neck 28 can each be conventional. It is typical for the flowable material to be a liquid (e.g., a beverage), and for the bag 26 to be constructed of a material that is impervious to the liquid, such as a flexible polymeric material; more specifically a polymeric film. An acceptable neck 28 is a short tube (e.g., a bunghole-like tube) of polymeric material that is hermetically sealed to the bag 26 in a conventional manner so that the only passage into or out of the bag is through the passageway defined through the neck. Typically, the neck 28 is more rigid than the bag 26 and includes at least a pair of annular flanges (e.g., see flanges 415 in FIG. 20) that extend around the neck and are spaced apart from one another to define an annular groove therebetween. The neck's annular groove is not open to the fluid-passing passageway that extends through the neck. The neck's annular flanges and annular groove each extend around and perpendicularly away from the neck's axis. As will be discussed in greater detail below, the neck's annular groove is outwardly open for receiving the free ends of the gripping opening's tabs 52 (i.e., the ends of the tabs that are opposite from the gripping opening's annular score line 48). That is, the neck's annular flanges and groove together function as an attachment mechanism for interacting with the attachment mechanisms (e.g., tabs 52) of the holding flap's gripping opening 42, or the like. These attachment mechanisms can be replaced with other types of attachment mechanisms for attaching the bag 26 and/or neck 28 to the insert's holding flap 40.

Figure 5:
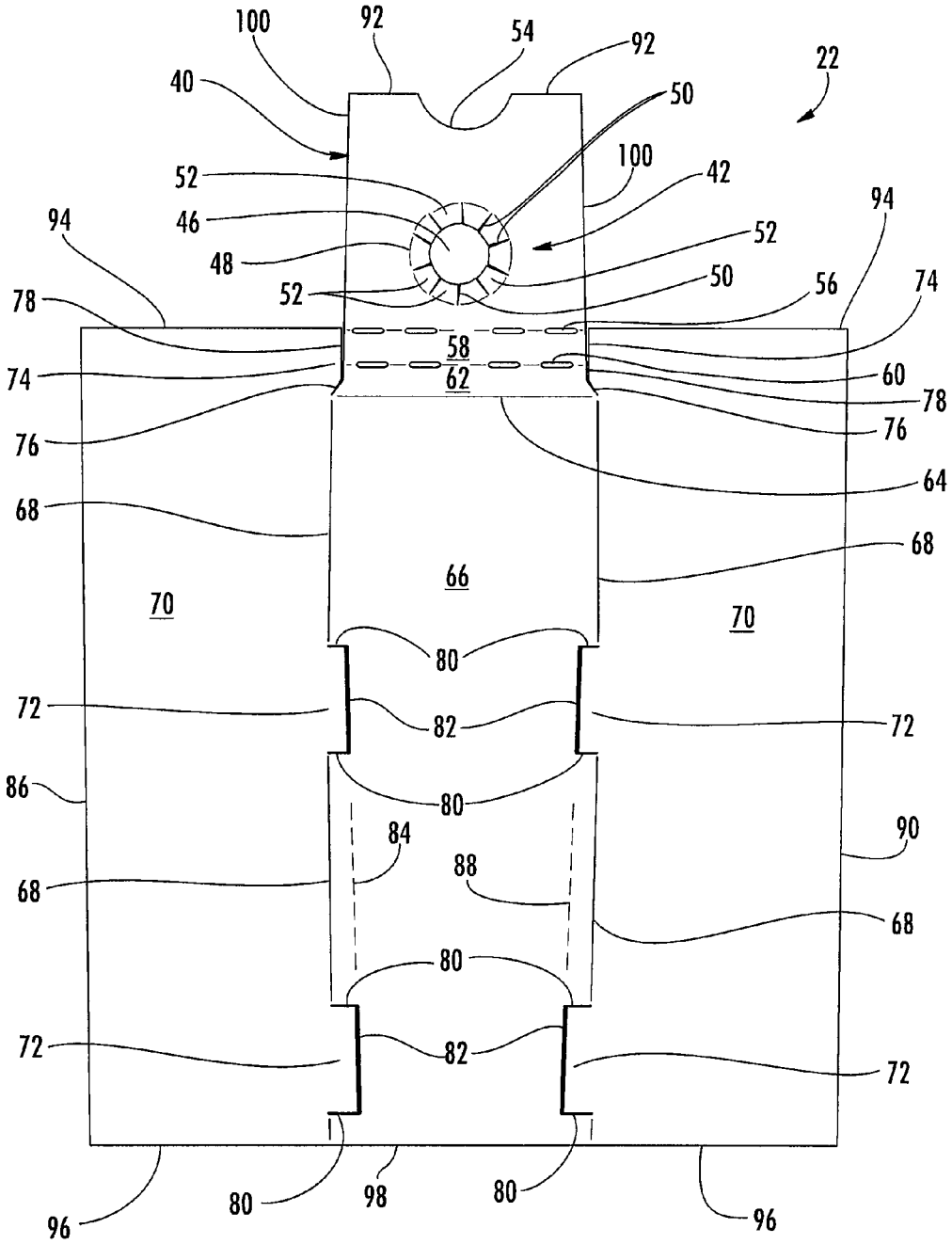
FIG. 5 is a schematic plan view of a blank from which the liner of FIG. 1 can be erected, in accordance with the first embodiment of the present invention.

The bag 26 with its neck 28 can be positioned over the base panel 66 of the blank 22 while the blank is in its flat configuration illustrated in FIG. 5. Then, the holding flap 40 can be pivoted upwardly, such as by folding along one or more of the lateral fold lines 56, 60. With the holding flap 40 extending upwardly, the neck 28 is pushed partially through the central opening 46 so that typically all of the free ends of the tabs 52 (i.e., the ends opposite the annular score line 48) "lock" into the neck's groove. Then, the side panels 70 are pivoted upwardly respectively about the longitudinal fold lines 68 so that the bag 26 is between the side panels and supported by the base panel 66, and so that the side panels respectively engage the opposite side edges 100 of the holding flap 40. As a result, the erected liner 20 extends at least partially around the bag 26. Alternatively, the blank 22 can remain flat while the neck 28 is mounted to the gripping opening 42, and the liner 20 can be erected from the blank thereafter.

Figure 1:
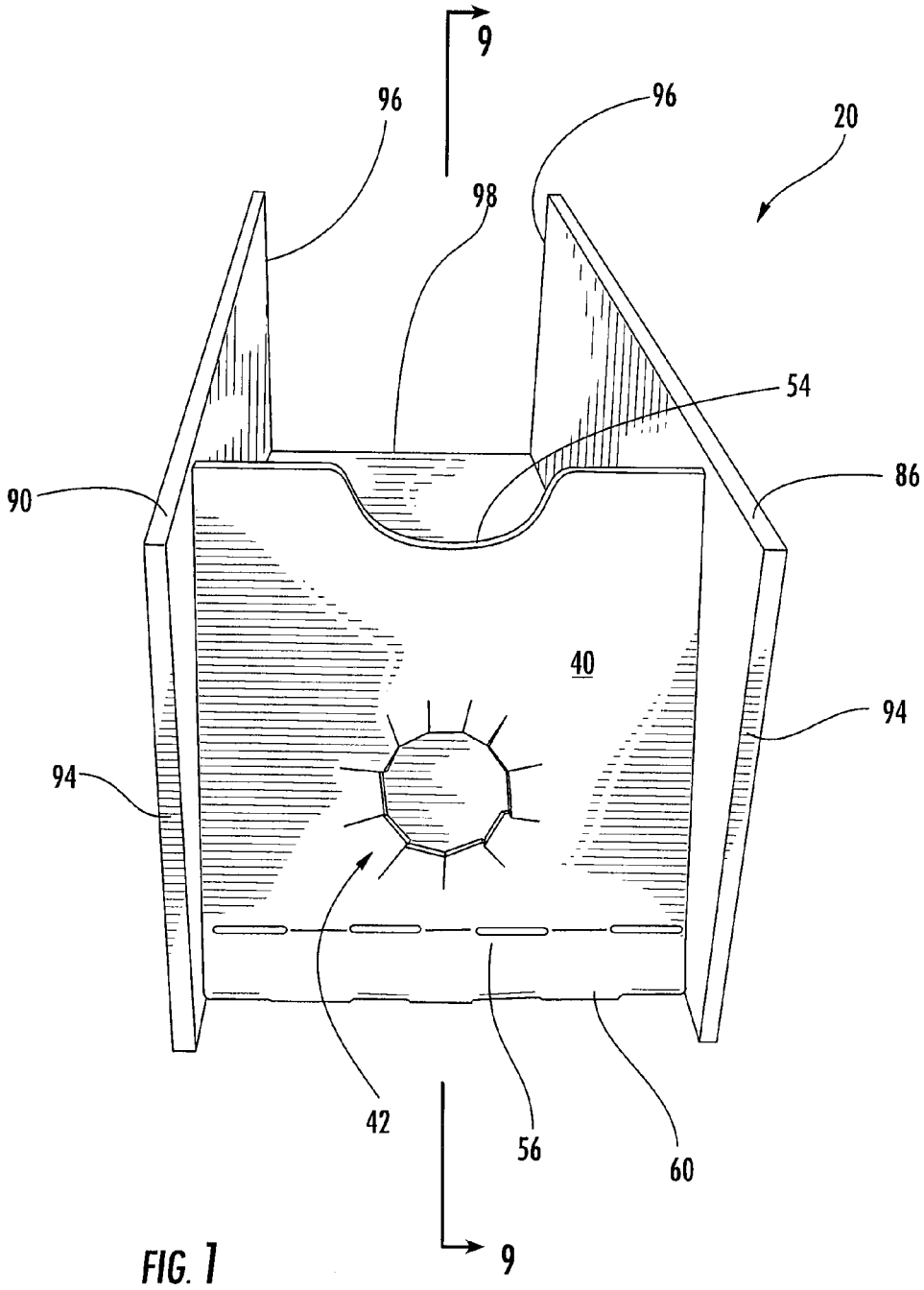
FIG. 1 is a front, top pictorial view of a liner, in accordance with a first embodiment of the present invention.
Figure 2:
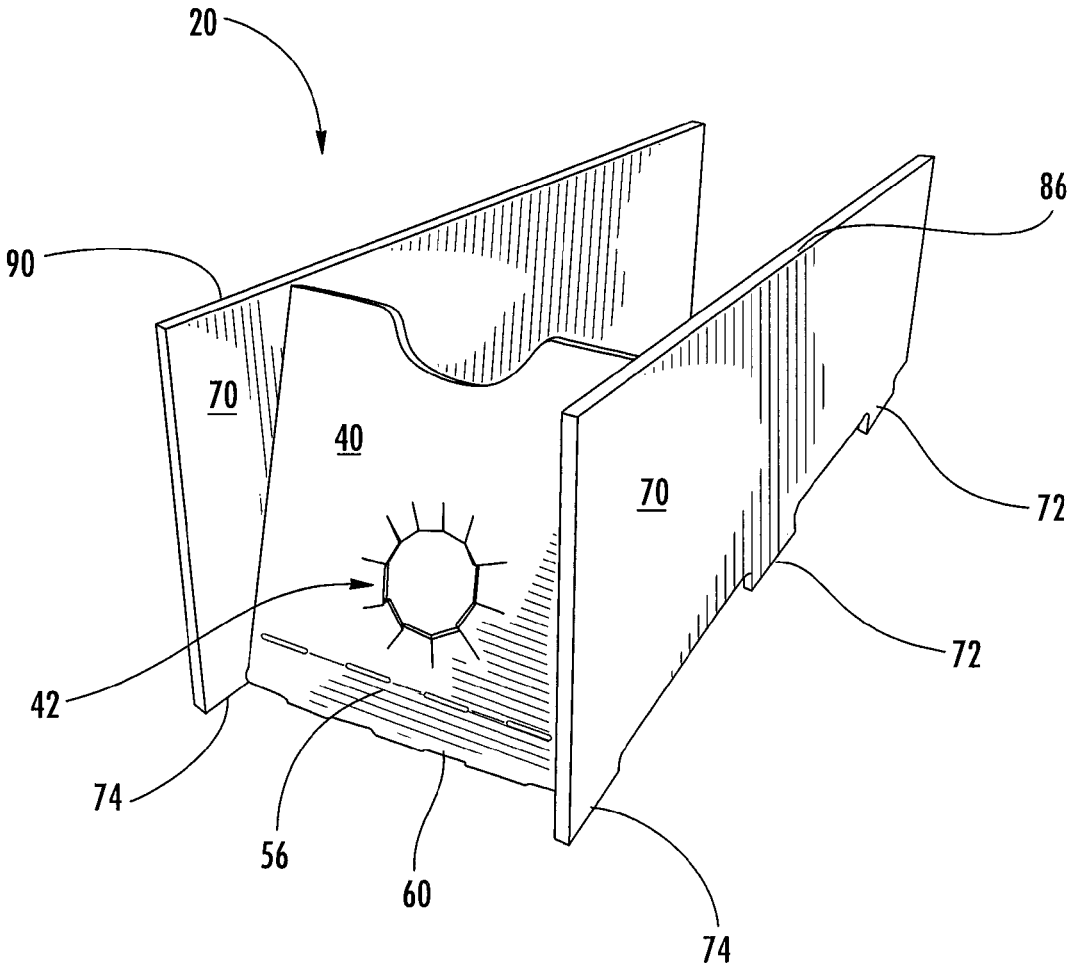
FIG. 2 is another pictorial view of the liner of FIG. 1.
Figure 3:
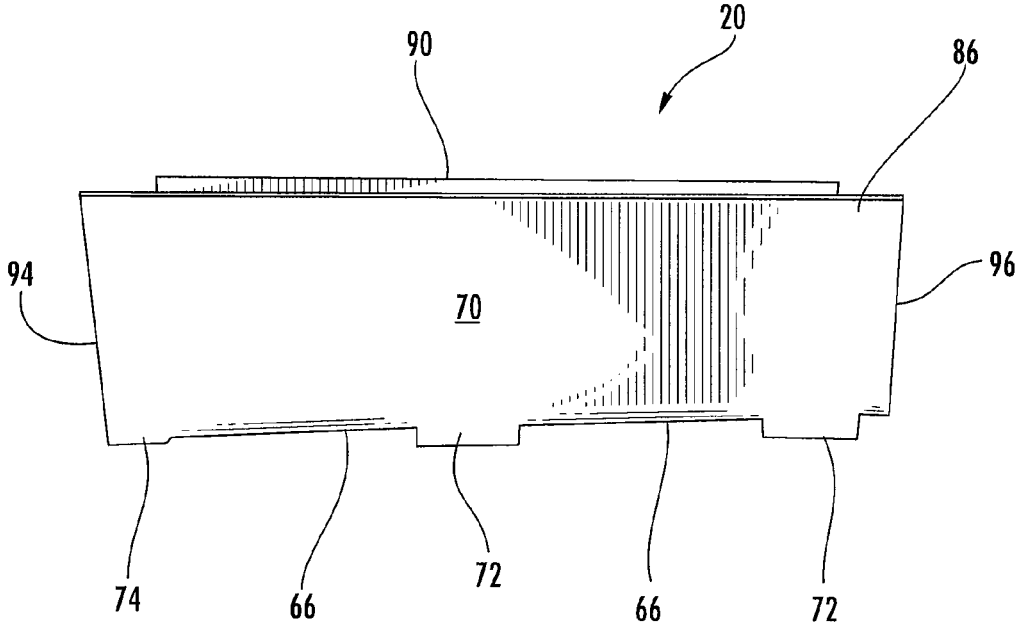
FIG. 3 is a pictorial side view of the liner of FIG. 1, with a corresponding view of the opposite side of the liner being a mirror image of FIG. 3.
Figure 4:
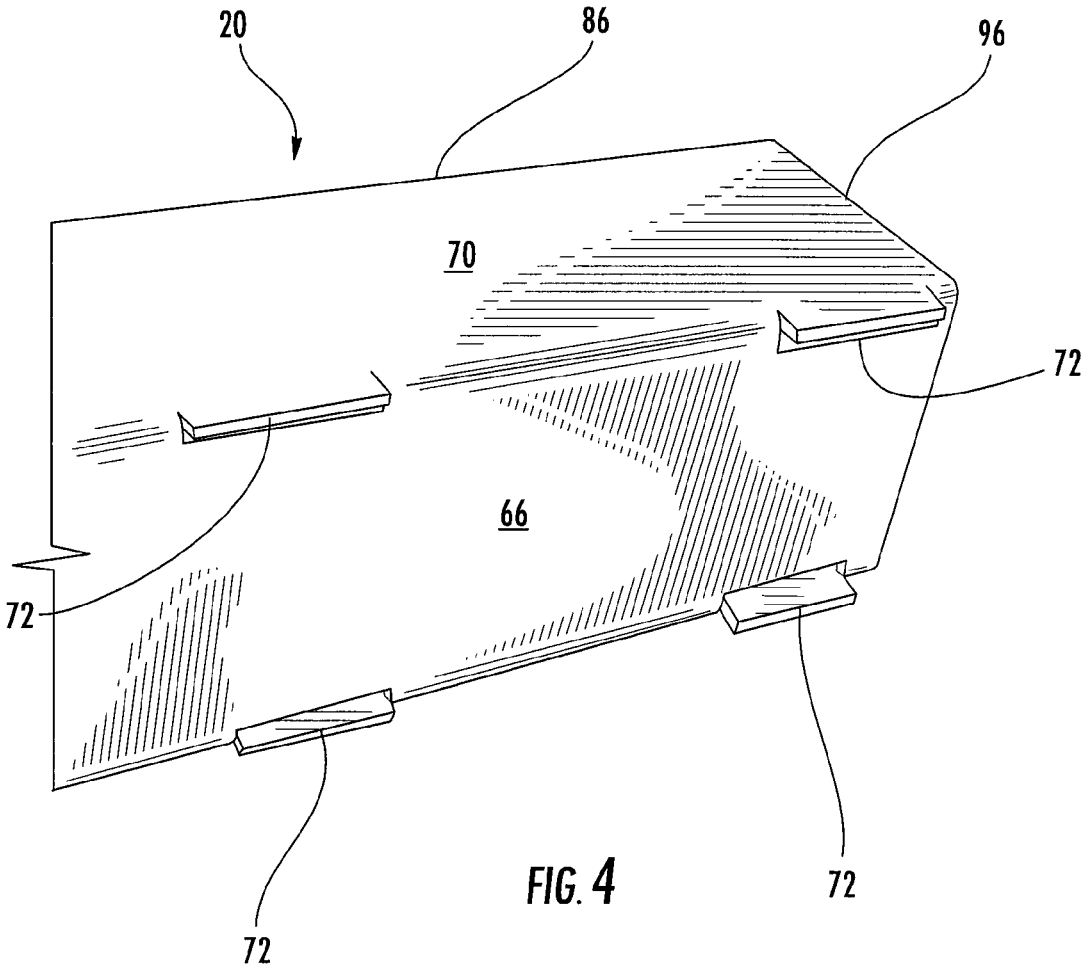
FIG. 4 is a bottom, side pictorial view of a portion of the liner of FIG. 1.

The upward pivoting of the side panels 70 respectively about the longitudinal fold lines 68 results in the forward tabs 74 being struck from the pleat panels 58, 62 (if this striking has not already occurred due to the holding flap 40 being pivoted upwardly). Likewise, the upward pivoting of the side panels 70 results in the rearward tabs 72 being struck from the base panel 66. As illustrated in FIG. 3, the forward and rearward tabs 74, 72 can function as legs that extend different distances from the plane of the base panel 66 so that the base panel is inclined toward the insert's holding flap 40 while the liner 20 is fully erected and the lower edges of the forward and rearward tabs are resting upon a planar horizontal surface. The angle of inclination of the base panel 66 in this configuration can be about two or three degrees, or more or less, and it substantially matches (e.g., is at least about equal to) the following acute angles that are defined in the blank 22: (1) the acute angle defined between the longitudinal direction and the side panel's outer edge 86, (2) the acute angle defined between the longitudinal direction and the other side panel's outer edge 90, (3) the acute angle defined between the longitudinal direction and the imaginary line 84 (i.e., slits 82), and (4) the acute angle defined between the longitudinal direction and the other imaginary line 88 (i.e., slits 82). As a result and advantageously for reinforcing the box 24 as discussed in greater detail below, while the liner 20 is fully erected and the lower edges of the forward and rearward tabs 74, 72 are resting upon a planar horizontal surface, the side panels'upper edges 86, 90 extend at least substantially parallel to the planar horizontal surface upon which the lower edges of the forward and rearward tabs 74, 72 are resting. A fully erected liner (e.g., the liner 20) or partially erected liner can be generally referred to as a construct.

After the liner 20 has been erected and had the bag 26, namely the neck 28, attached thereto as described above, the rear end of the liner can be fully inserted into/through the box's access opening 29 so that the insert's rearward edges 96, 98 are adjacent respective marginal portions of the inner face of the rear cover panel (not shown) of the box 24. More specifically, at least some of or substantially the entire length of the insert's rearward edges 96, 98 are in opposing face-to-face orientation and/or contact with the respective marginal portions of the inner face of the rear cover panel of the box 24. Also while the liner 20 is fully erected and fully inserted into the box 24, the outer faces of the insert's side panels 70 are proximate the inner faces of the box's side panels 36, 38; the insert's side panels' upper edges 86, 90 are respectively proximate marginal portions of the inner face of the box's top panel 32; and the bottom edges of the tabs 72, 74 are proximate respective marginal portions of the inner face of the box's bottom panel 34. More specifically, at least some of or substantially all of the outer faces of the insert's side panels 70 are respectively in opposing face-to-face orientation and/or contact with at least some of or substantially all of the inner faces of the box's side panels 36, 38; at least some of or substantially the entire length of the insert's side panels' upper edges 86, 90 are in opposing face-to-face orientation and/or contact with respective marginal portions of the inner face of the box's top panel 32; and at least some of or substantially all of the bottom edges of the tabs 72, 74 are in opposing face-to-face orientation and/or contact with respective marginal portions of the inner face of the box's bottom panel 34. In addition, when the box's access opening 29 is closed by the box's front cover panel (e.g., front flaps 30), the insert's side panels' forward edges 94 are respectively proximate marginal portions of the inner face of the box's front cover panel. More specifically, at least some of or substantially the entire length of the insert's side panels' forward edges 94 are in opposing face-to-face orientation and/or contact with marginal portions of the inner face of the box's front cover panel. In accordance with one aspect of the present invention, the side panels 70 extend for substantially the entire length of the interior of the box 24 and rise to substantially the entire height of the interior of the box, which helps to strengthen the box.

With the liner 20 fully inserted into the box as described above and the box's access opening 29 in its open configuration, the insert's holding flap 40 can be moved between its forward and rearward positions, such as by folding along the forward lateral fold line 56 and the intermediate lateral fold line 60. That is, the intermediate lateral fold line 60 is recessed with respect to the forward edges 94 of the side panels 70 in a manner that at least partially facilitates folding the insert's holding flap 40 between the forward and rearward positions (e.g., allows the spigot 44 to be tucked into the box 24). In this regard, FIGS. 9 and 10 schematically illustrate the insert's holding flap 40 in the forward and rearward positions, respectively. Although the insert's holding flap 40 is shown as extending vertically in FIGS. 9 and 10, it may be sufficient or more typical for it to extend generally upright as opposed to extending perfectly vertically. Reiterating from above, with the insert's holding flap 40 in the forward position and carrying the spigot 44, the spigot is conveniently proximate the box's access opening 29, such as for conveniently dispensing fluid from the bag 26 by way of the spigot. In addition, while the holding flap 40 is in its rearward position and holding the spigot 44, the spigot is conveniently at least slightly rearward of (e.g., recessed from) the box's access opening 29.

FIGS. 9 and 10 are schematic in nature because, for example, the fold lines are schematically represented therein. As shown in FIG. 9, the legs/tabs 72, 74 (FIGS. 2-5) are effective so that the inclined orientation of the base panel 66 extends all the way to the rearward lateral fold line 64, and at least some of or substantially the entire "outer" surface of the base panel 66 is typically kept distant from, yet proximate or more specifically in opposing face-to-face relationship with, the inside surface of the box's bottom panel 34. The rearward lateral fold line 64 at least partially facilitates for the inclined orientation of the base panel 66. The position of the rearward lateral fold line 64 along the length of the liner 20 can be changed to affect the inclined orientation of the base panel 66.

As best understood with reference to FIG. 10, with the liner 20 fully inserted into the box 24 and the insert's holding flap 40 in the rearward position and extending upward, the "outer" face of the passive pleat panel 62 is proximate the inside face of the box's bottom panel 34, the opposite face of the passive pleat panel 62 is proximate a face of the active pleat panel 58, and the holding flap's top edge 92 is proximate the inside face of the box's top panel 32. More specifically, at least some of or substantially the entire "outer" face of the passive pleat panel 62 is in opposing face-to-face orientation and/or contact with the inside face of the box's bottom panel 34, at least some of or substantially all of the opposite face of the passive pleat panel 62 is in opposing face-to-face orientation and/or contact with at least some of or substantially an entire face of the active pleat panel 58, and at least some of or substantially all of the holding flap's top edge 92 is in opposing face-to-face orientation and/or contact with the inside face of the box's top panel 32. Stated differently, the rearward position can be achieved by folding along the lateral fold lines 56 and 60 such that surfaces of the pleat panels 58, 62 that were originally coplanar (i.e., they were coplanar while the blank 22 was flat) have been repositioned to be in an opposing face-to-face configuration with one another, or more specifically in opposing face-to-face contact with one another, and the holding flap 40 extends upwardly from the active pleat panel 58.

While the liner 20 is fully inserted into the box 24 and the insert's holding flap 40 is within the interior of the box, the holding flap's side edges 100 are respectively adjacent the inwardly facing faces of the liner's side panels 70. In accordance with the first embodiment of the present invention, while the liner 20 is fully inserted into the box 24 and the insert's holding flap 40 is within the interior of the box, the holding flap's side edges 100 are respectively in opposing face-to-face configuration with the inwardly facing faces of the liner's side panels 70, and more specifically the holding flap's side edges 100 are respectively in opposing face-to-face contact with (i.e., abutting) the inwardly facing faces of the liner's side panels 70.

Advantageously, all of the above-described opposing face-to-face orientations and/or contacts can help to reinforce the box 24. This reinforcement is particularly advantageous after the bag 26 in the box 24 is filled or partially filled with fluid, or the like, because it is often desirable to ship such boxes and/or stack two or more of the boxes one upon the other. In accordance with alternative embodiments of the present invention, one or more of the above-described opposing face-to-face orientations and/or contacts can be omitted.

With the liner 20 and the bag 26 installed in the box 24 such that the insert's holding flap 40 is holding the bag's neck 28 as described above, the bag can be filled with fluid, or the like, through the neck. While the bag 26 is being filled, the insert's holding flap 40 advantageously holds the neck 28 proximate the box's access opening 29, and the handhold 54 can be manually grasped, or otherwise manipulated, to help in maintaining optimal control over the neck during filling of the bag with fluid. That is, an aspect of the present invention is the provision of methods and apparatus for stabilizing the bag 26 and/or neck 28 while the bag is being filled with fluid. After a predetermined amount of fluid, or the like, has been put into the bag 26 (e.g., after the bag has been filled or partially filled), the neck 28 is closed. The filled or partially filled bag 26 rests upon the insert's base panel 66, between the insert's side panels 70.

The neck 28 can be closed and opened in any conventional manner, such as with a closure mechanism that is in the form of a removable plug, removable cap or the spigot 44. In accordance with the first embodiment of the present invention, the conventional spigot 44 is used for convenience. Referring to FIG. 8, the spigot 44 has a body, a valve (hidden from view within the body), and an actuator 43 for operating the valve to selectively open and close the passageway through the spigot, for controllably dispensing flowable material via the spigot's discharge opening 45. As illustrated in FIG. 8, the actuator 43 is in the form of a manually manipulatable button; however, it can alternatively be in the form of a lever, handle, knob or any other suitable feature for controlling operation of the spigot 44. In accordance with the present invention, the term "spigot" is intended to encompass any type of device that includes a valve, or the like, for controlling flow through the neck 28, such as a tap, faucet, or the like. The spigot 44 is securely mounted to the neck 28, such as by being securely inserted into, or otherwise attached to, the neck in a conventional manner, so that the discharging of the fluid from the bag 26 is through the spigot.

Whereas the neck 28 is described above as being closed by the spigot, it may alternatively be the case that the spigot 44 and the neck 28 are a unitary unit that is substantially absent of separable parts. That is and for example, the neck 28 can be characterized as being part of the spigot 44. In this situation and other situations, a bag 26 that is to be filled with flowable material can be fitted with both the neck 28 and the spigot 44 prior to the bag being filled with the flowable material, and the flowable material can be supplied to the interior of the bag by way of the spigot 44.

In accordance with the first embodiment of the present invention, after the neck 28 is closed, if the insert's holding flap 40 is not already in its rearward position, then the insert's holding flap can be transitioned to the rearward position as described above. The transitioning to the rearward position can be facilitated, for example, by manually gripping the handhold 54 and moving the holding flap 40 accordingly. Then, the box's access opening 29 can be closed such as by pivoting the respective front flaps 30 over the box's access opening 29 and then securing them in a conventional manner, such as with adhesive material or any other suitable fastening mechanism. While the box's access opening 29 is closed, the outer face of the insert's holding flap 40 is in opposing face-to-face relation with the box's front cover panel (e.g., front flaps 30).

When it is desired to discharge some of the fluid from the bag 26, the box 24 can be laid upon a horizontal surface such that the outer surface of the box's bottom panel 34 is resting upon the horizontal surface. As a result of the legs/tabs 72, 74, the base panel 66 of the liner 20 will be inclined with respect to both the box's bottom panel 34 and the horizontal surface. The box's access opening 29 is opened such as by pivoting the respective front flaps 30 away form the box's access opening 29. Alternatively, at least a portion of the box's access opening 29 can be opened or otherwise accessed by opening (e.g., tearing away) an openable portion of the box 24 that is defined by one or more tear lines (not shown for the first embodiment) that may extend at least partially across the box's front cover panel/closed front flaps 30. Thereafter, the insert's holding flap 40 is typically transitioned to the forward position so that the spigot 44 can be conveniently used (e.g., so that the spigot is proximate to or extends out of the box's access opening 29). The transitioning of the insert's holding flap 40 to its forward position can be at least partially facilitated by manually grasping the handhold 54 and pulling the insert's holding flap forward.

Advantageously, the inclined orientation of the base panel 66, which results from the legs/tabs 72, 74, will encourage (due to the force of gravity) the fluid to flow out of the bag 26 via the spigot 44 when the spigot is opened. The legs/tabs 72, 74 can vary in height, length and number depending upon the type of support needed and also depending upon the desired flow of the liquid toward the spigot 44. Alternatively, the blank 22 can be modified so that the tabs 74, 72 are omitted and the side panels' outer edges 86, 90 extend in the longitudinal direction rather than obliquely (in which case a difference from the first embodiment would be that substantially all of the "outer" surface of the insert's base panel 66 would typically be in opposing face-to-face contact with the inside surface of the box's bottom panel 34 while the liner is fully inserted into the box 24).

In the following portion of this Detailed Description of Exemplary Embodiments section of this disclosure, numerous other embodiments of the present invention are described, and these other embodiments can be like the above-described first embodiment of the present invention, except for variations noted and variations that will be apparent to those of ordinary skill in the art. In this regard, for some of the features of a second embodiment of the present invention that are like corresponding features of the first embodiment of the present invention, the same respective element numbers are used except that the elements numbers have been incremented by two hundred for the subject features of the second embodiment.

Figure 11:
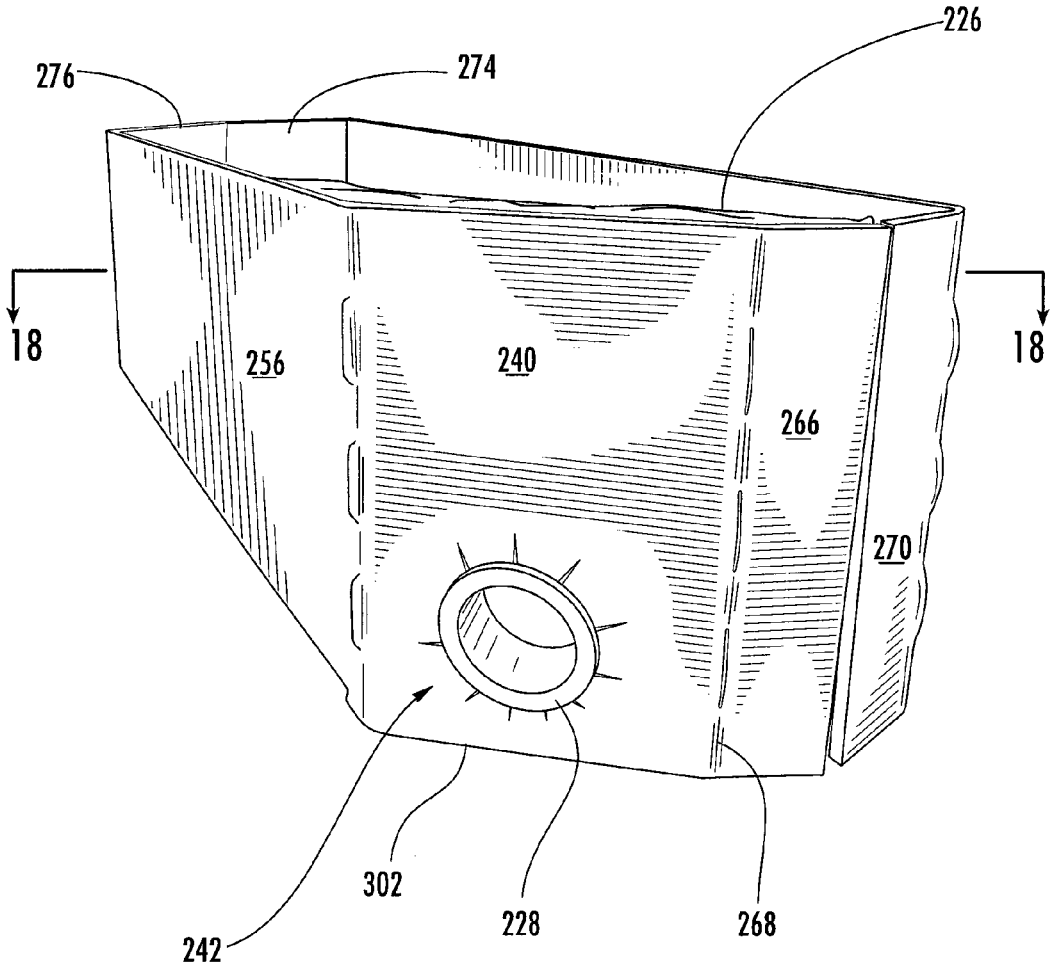
FIG. 11 is generally a front pictorial view of a liner that contains a bag and is holding the bag's neck, in accordance with a second embodiment of the present invention.
Figure 12:
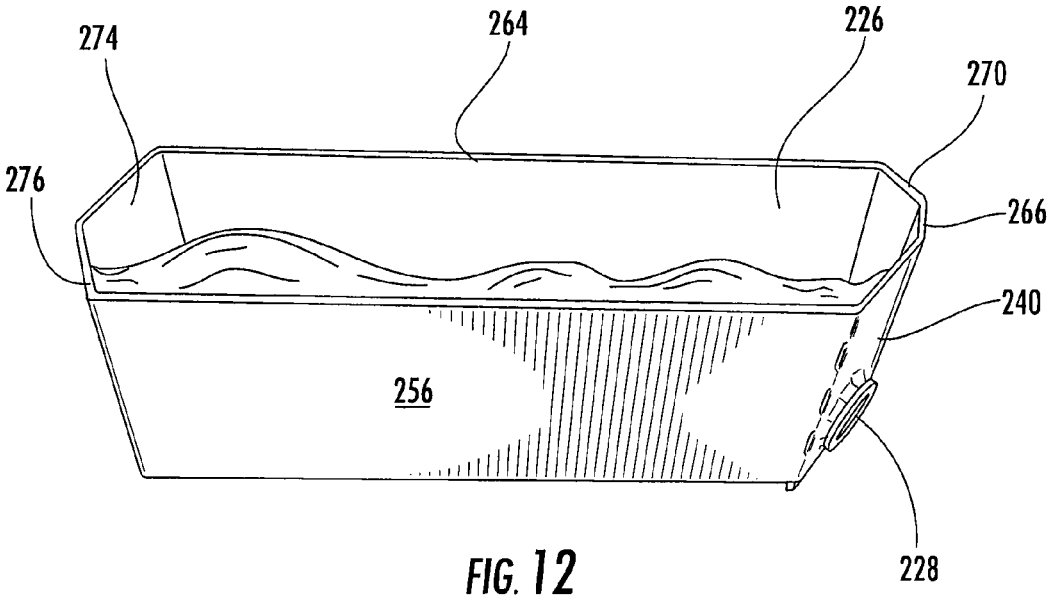
FIG. 12 is generally a side, top pictorial view of the combination of FIG. 11.

The second embodiment of the present invention is described in the following with reference to FIGS. 11-18. In accordance with the second embodiment, and generally described, a liner 220 (FIGS. 11 and 12) can be erected from a blank 222 (FIGS. 13-16) and used to at least partially line a box 224 (FIG. 17) that also contains a flexible bag 226 (FIGS. 11 and 12). The flexible bag 226 is for containing a flowable material (not shown), such as a fluid (e.g., beverage). The flexible bag 226 includes a neck 228 that is for receiving and dispensing the fluid. Advantageously, the liner 220 can support the neck 228 and/or bag 226, and/or reinforce the box 224.

Figure 17:
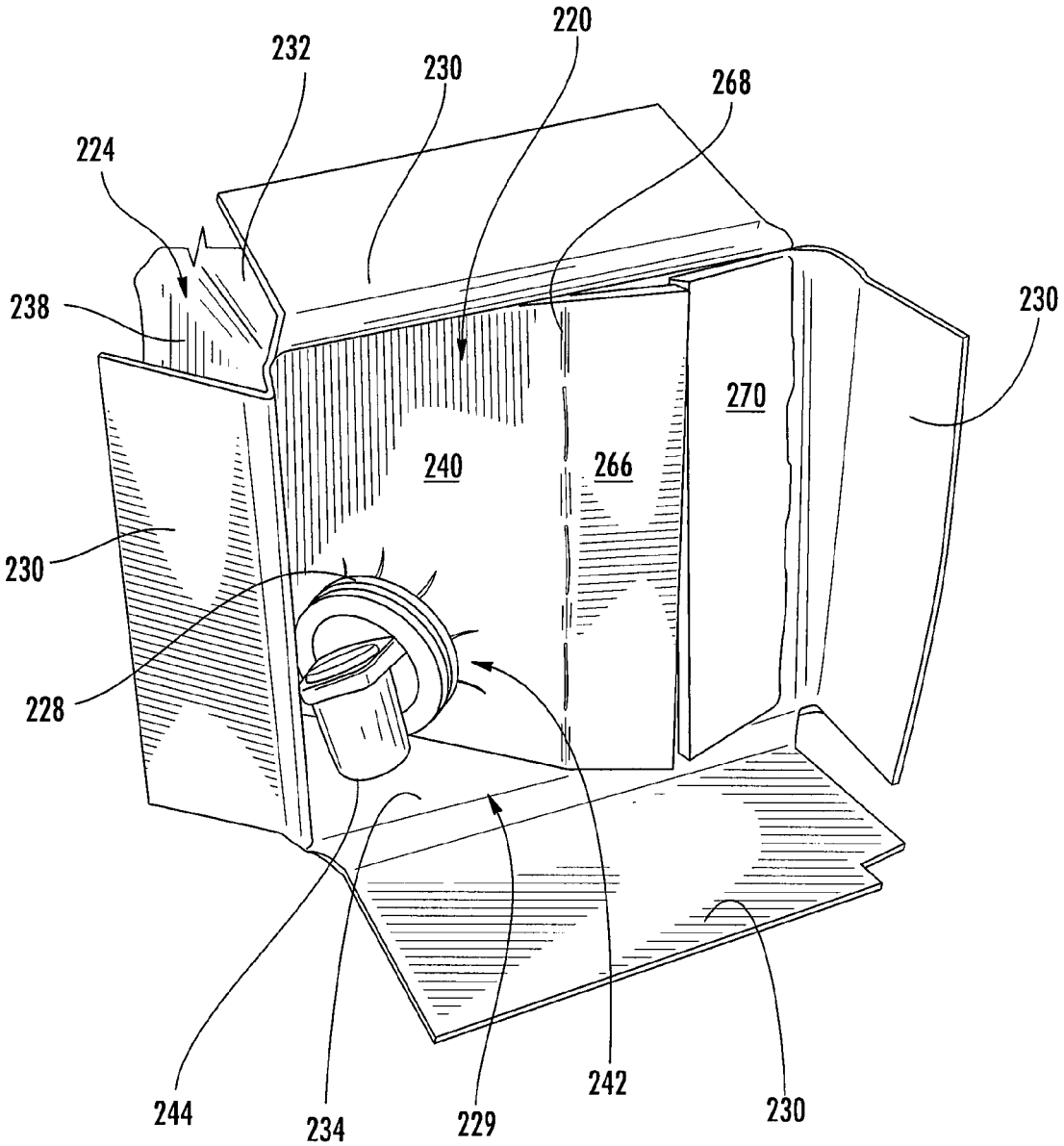
FIG. 17 is a pictorial view of the liner of FIG. 11 fully inserted into a box and having the bag fastened thereto, with a spigot mounted to the bag's neck, in accordance with the second embodiment of the present invention.

As best understood with reference to FIG. 17, the outer container, which can more specifically be a carton that is in the form of a box 224, has an access opening 229 at its front end, and this access opening can be opened and closed by the box's front cover panel. The front cover panel of the box 224 is illustrated as being in the form of four front end flaps 230 respectively foldably connected along fold lines to the front edges of the top, bottom, right side and left side panels 232, 234, 236, 238 of the box 224. Similarly, the box has a rear end (not shown) that is closed by a rear cover panel (not shown). The rear cover panel of the box 224 is typically in the form of four end flaps (not shown, but similar to the end flaps 230) respectively foldably connected along fold lines to the rear edges of the top, bottom, right side and left side panels 232, 234, 236, 238 of the box 224.

As best understood primarily with reference to FIG. 17, while the liner 220 is fully inserted within the open box 224 and the bag 226 is also within the liner 220 and box 224, a holding flap 240 of the liner 220 is proximate the box's access opening 229 and can hold the bag's neck 228 by virtue of the neck extending through a gripping opening 242 in the insert's holding flap. In this configuration, the insert's holding flap 240 extends obliquely with respect to the box's axis so that the neck 228 is conveniently at least slightly rearward of (e.g., recessed from) the box's access opening 229 in a manner that seeks to keep the neck 228, and an optionally associated spigot 244, or the like, from: (1) interfering with the closing of the box's access opening 229 (e.g., with the box's end flaps 230), and (2) interfering with maintaining the box's access opening 229 in its closed configuration. That is, the insert's holding flap 240 extends at an angle that allows the box's neck 228, and an optionally associated spigot 244, or the like, to be recessed into the box 224 during shipping of the box.

Figure 18:
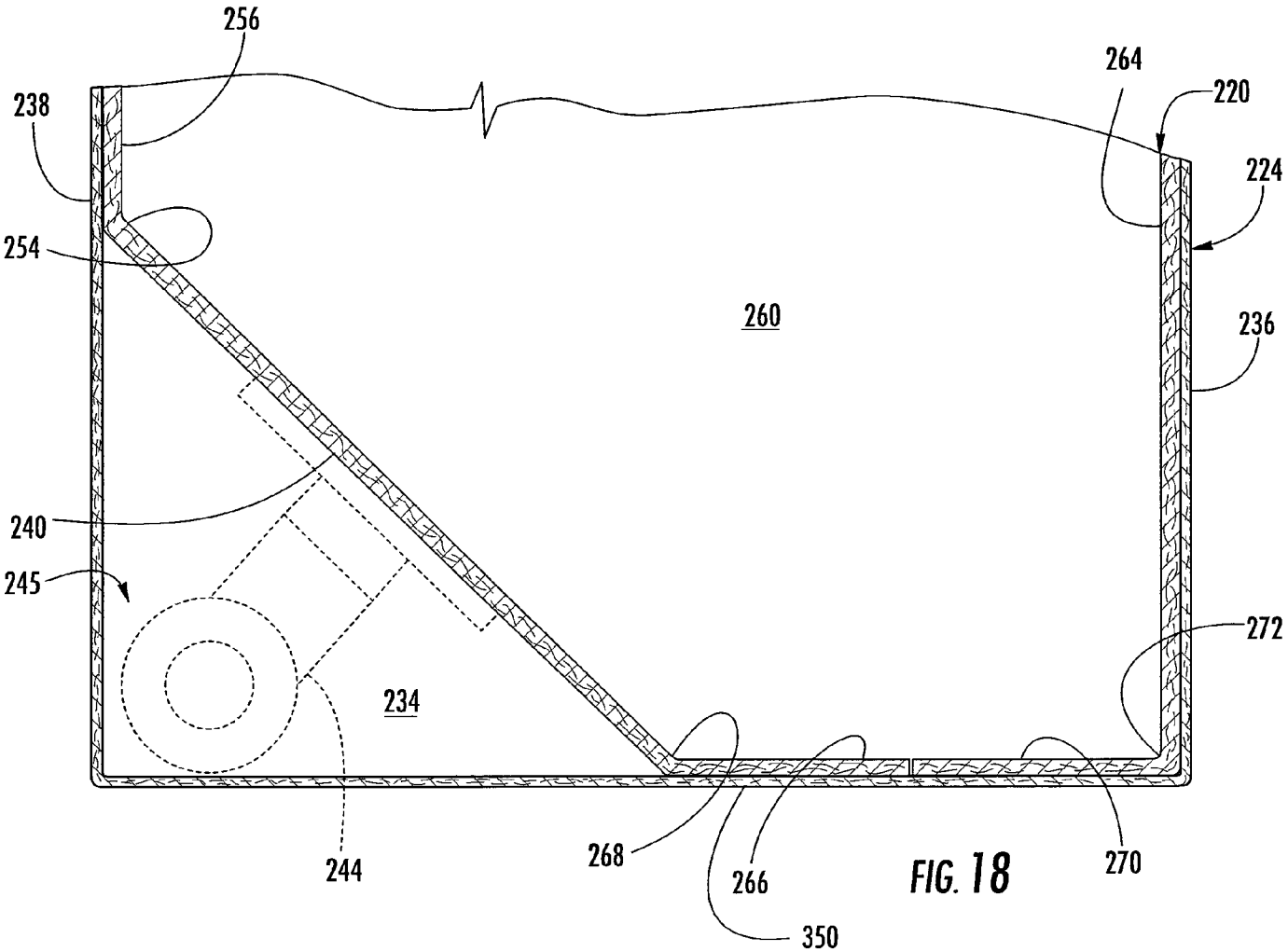
FIG. 18 is a schematic, cross-sectional, partial view of the liner fully inserted into the box without the bag and its neck, with the box's front cover panel closed and the spigot illustrated by broken lines, and line 18-18 of FIG. 11 generally indicates where the cross-section has been taken, in accordance with the second embodiment of the present invention.

With regard to the box's access opening 229 being closed and in accordance with the second embodiment, the placement of the gripping opening 242 is coordinated with the oblique arrangement of the holding flap 240 so that the spigot 244 is advantageously arranged in an interior corner 245 of the box 224, which is a beneficial compact arrangement. This compact arrangement is illustrated in FIG. 18, which schematically illustrates that the box's access opening 229 (FIG. 17) is closed by a closure panel 350 (e.g., formed by respectively overlapping and adhering together the end panels 230 of FIG. 17), and further illustrates in broken lines how the spigot 44 can be advantageously positioned in the interior corner 245. FIG. 18 illustrates that the spigot 44 is entirely enclosed in the interior of the box 224. In FIG. 18, the liner 240 is shown fully inserted into the box 224, but the neck 228 and bag 210 are omitted.

The liner 220 can be erected from the blank 222 illustrated in FIGS. 13-16 (e.g., after turning the blank over), and the blank is described in the following in its flat/planar configuration, in accordance with the second embodiment of the present invention. As best understood with reference to FIG. 13, the gripping opening 242 in the holding flap 240 can be what is referred to by some as a "starburst hole". More specifically, the gripping opening 242 can be like the gripping opening of the first embodiment, so that it includes a central opening 246, an outer annular score line 248, multiple radial slits 250, and multiple radial tabs 252. The radial tabs 252 are hingedly connected to the remainder of the holding flap 240 at the annular score line 248. Only a representative few of the radial slits 250 and tabs 252 are identified by their reference numerals in FIG. 13 in an effort to clarify the view. The annular score line 248 can be omitted to increase the rigidity of the tabs 252, and the number of tabs 252 can vary.

In the exemplary blank 222, the holding flap 240 is foldably attached by an intermediate lateral fold line 254 to a relatively short side panel 256. The short side panel 256 is foldably attached by a relatively short longitudinal fold line 258 to a base panel 260, and the other side of the base panel is foldably attached by a relatively long longitudinal fold line 262 to a relatively long side panel 264. A front end flap 266 is foldably attached by a forward lateral fold line 268 to the holding flap 240. Another front end flap 270 is foldably attached by a forward lateral fold line 272 to the long side panel 264. Rear end flaps 274, 276 are respectively foldably attached by rearward lateral fold lines 278, 280 to the side panels 264, 256.

End edges 282, 284, 286, 288 of the end flaps 266, 270, 274, 276, as well as a rearward end edge 290 of the base panel 260, extend in the lateral direction. The forward edge of the base panel 260 includes a lateral forward edge 292 and an oblique forward edge 294. A longitudinal side edge 296 of the blank 222 extends straight between the end edges 284, 286 of the end flaps 270, 274. Likewise, longitudinal side edge 298 of the blank 222 extends straight between the end edges 282, 288 of the end flaps 266, 276. (Respective portions of the side edges 296, 298 of the blank 222 are referred to as top edges of the holding flap 240, top edges of the side panels 256, 264 and top edges of the end flaps 266, 270, 274, 276 in the erected liner 220). The front end flap 266 includes a longitudinal side edge 300 that is collinear with a longitudinal side edge 302 of the attachment panel 240. (The longitudinal side edges 300, 302 of the front end flap 266 and the holding flap 240 are also respectively referred to as the lower edges 300, 302 of the front end flap 266 and the holding flap 240 in the erected liner 220). The end flaps 270, 274, 276 respectively include longitudinal side edges 304, 306, 308 (that are respectively referred to as lower edges 304, 306, 308 of the end flaps 270, 274, 276 in the erected liner 220).

Figure 13:
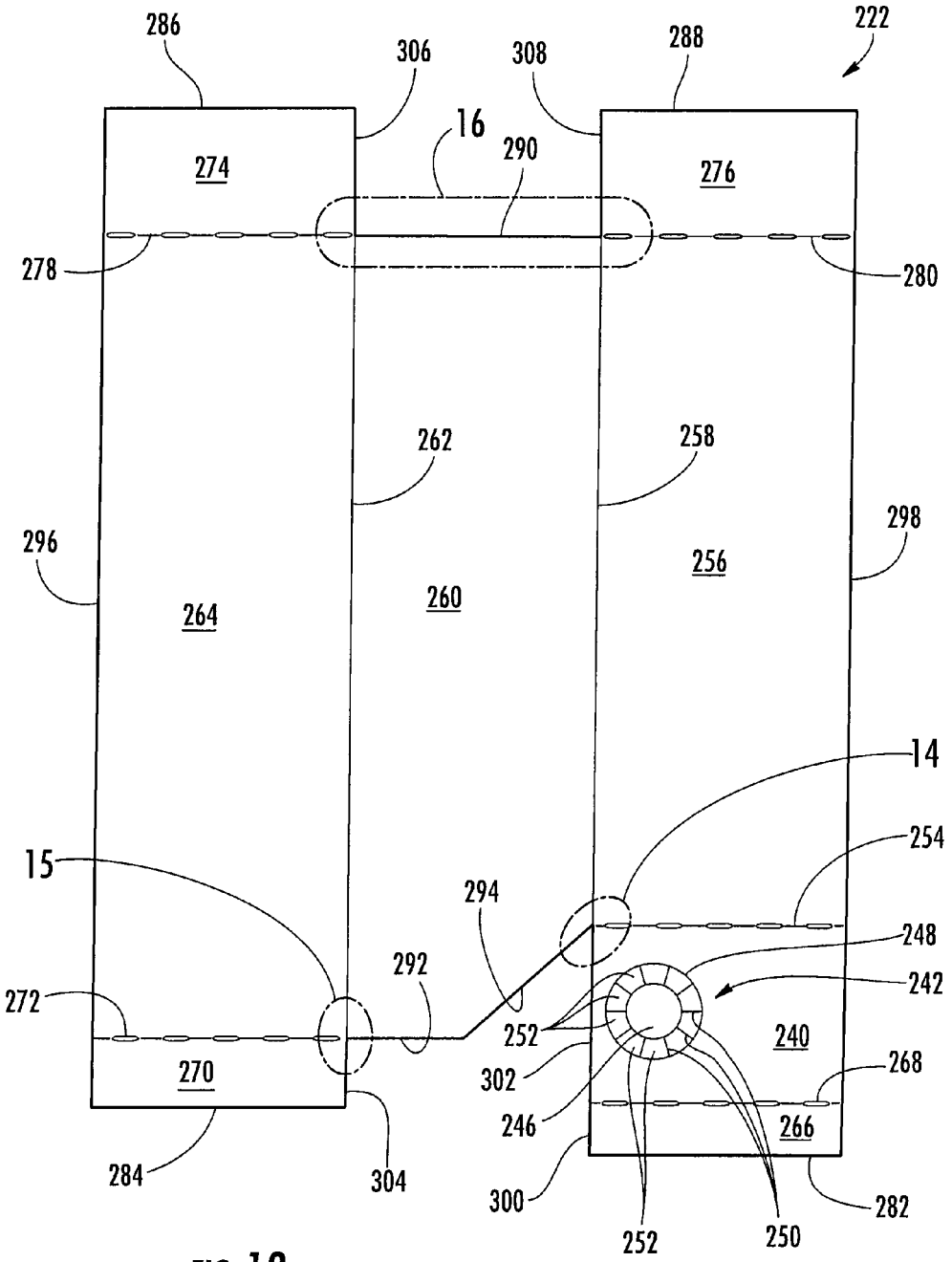
FIG. 13 is a schematic plan view of a blank from which the liner of FIG. 11 can be erected, in accordance with the second embodiment of the present invention.
Figure 14:
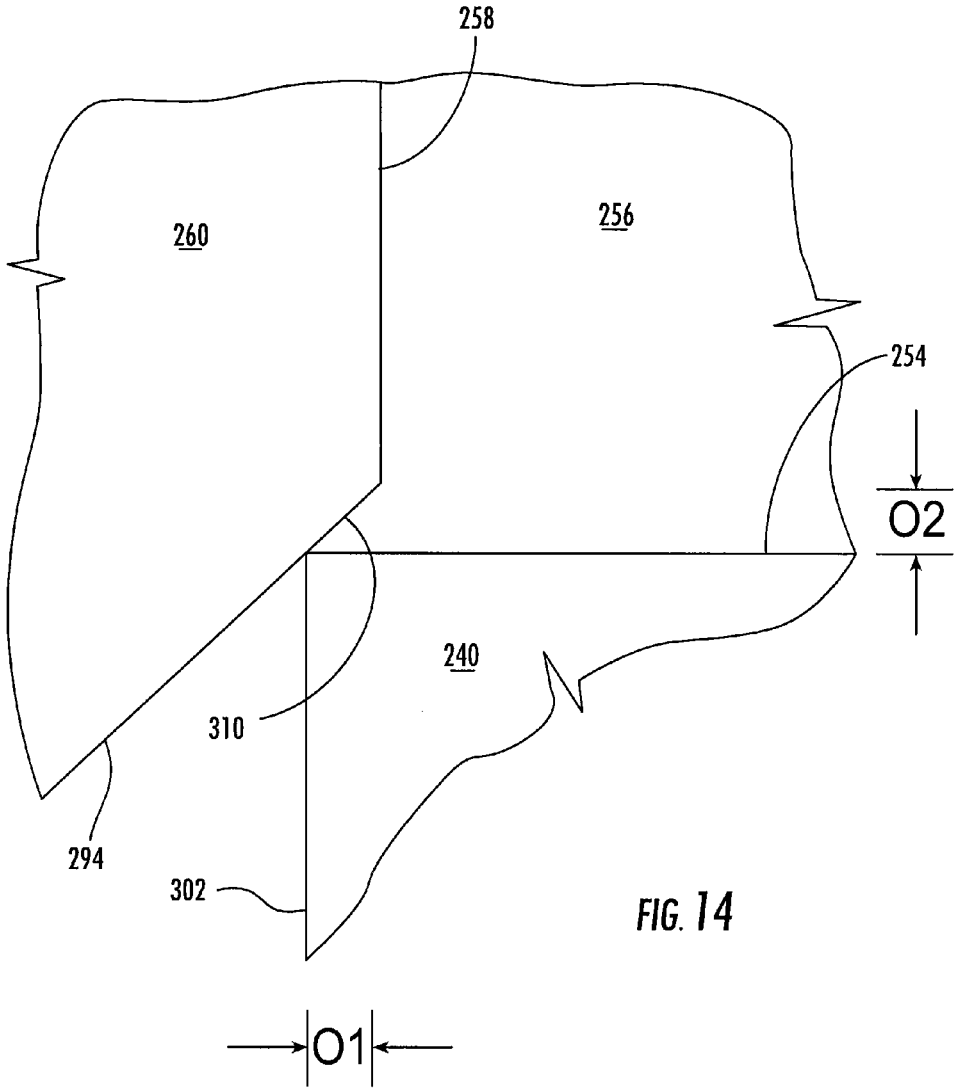
FIG. 14 is a schematic, relatively enlarged, partial view of the area surrounded by broken line 14 of FIG. 13.

Reference will now also be made to FIG. 14, which is a relatively enlarged view of a portion of the area that is surrounded by imaginary broken line 14 of FIG. 13. As a result of an oblique slit 310, the oblique forward edge 294 of the base panel 260 extends past the intersection of the intermediate lateral fold line 254 and the longitudinal side edge 302 of the holding flap 240, and all the way to the forward end of the short longitudinal fold line 258. The oblique slit 310 extends obliquely from: (i) the forward end of the short longitudinal fold line 258 to (ii) the intersection of the intermediate lateral fold line 254 and the longitudinal side edge 302 of the holding flap 240. As a result, a lateral offset O1 is defined between the side edge 302 of the holding flap 240 and the short longitudinal fold line 258, and a longitudinal offset O2 is defined between the forward end of the short longitudinal fold line 258 and the intermediate lateral fold line 254. These offsets O1 and O2 can play an advantageous role in enabling the liner 220 to optimally reinforce the box 224, as discussed in greater detail below.

Figure 15:
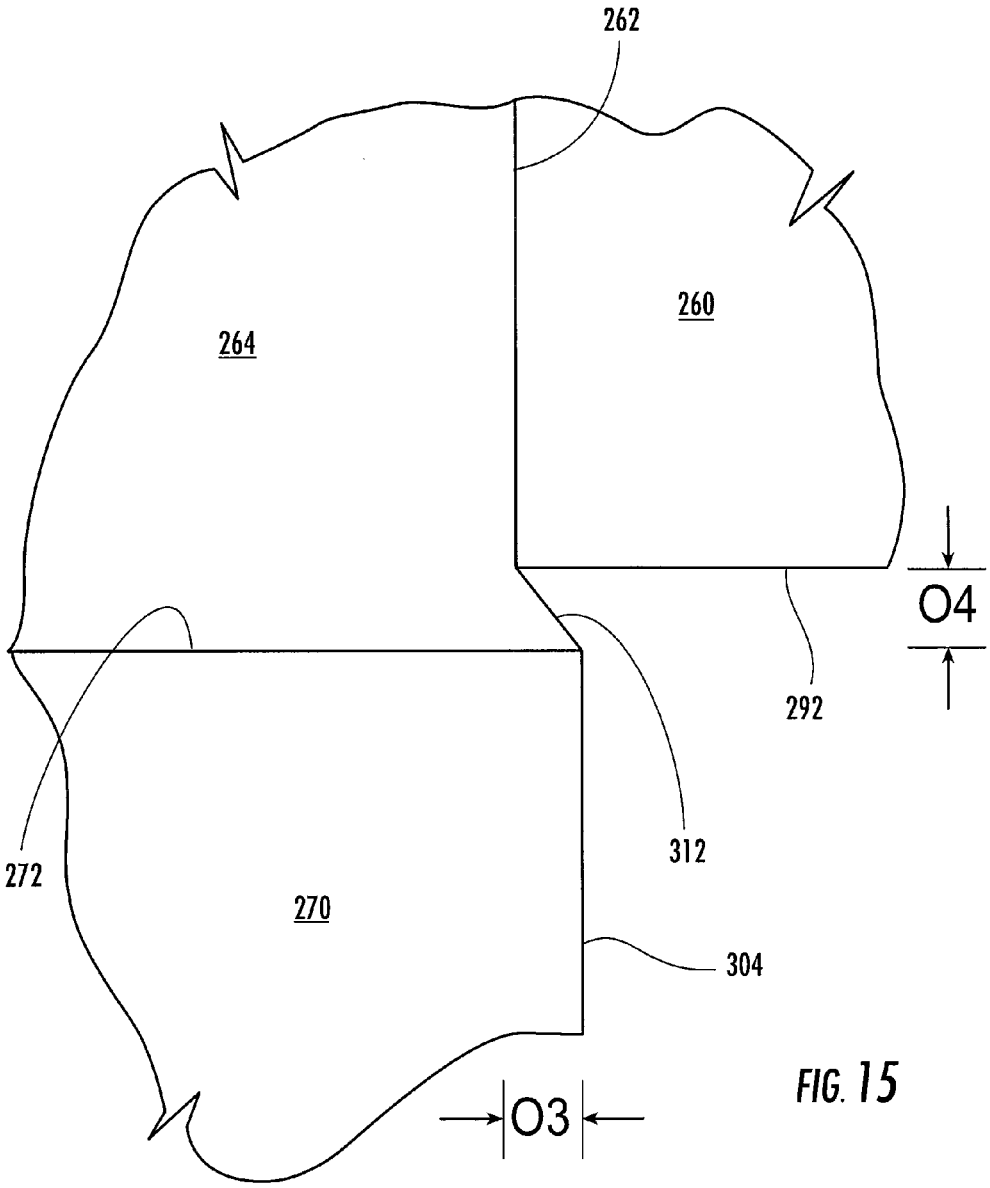
FIG. 15 is a schematic, relatively enlarged, partial view of the area surrounded by broken line 15 of FIG. 13.

Reference will now be made to FIG. 13 and FIG. 15. FIG. 15 is a relatively enlarged view of a portion of the area that is surrounded by imaginary broken line 15 of FIG. 13. A forward oblique edge 312 of the long side panel 264 extends obliquely from: (i) the intersection between the forward lateral fold line 272 and the longitudinal side edge 304 of the front end flap 270 to (ii) the intersection between the long longitudinal fold line 262 and the lateral forward edge 292 of the base panel 260. As a result, a lateral offset O3 is defined between the long longitudinal fold line 262 and the longitudinal side edge 304 of the front end flap 270, and a longitudinal offset O4 is defined between the forward lateral fold line 272 and the lateral forward edge 292 of the base panel 260. These offsets O3 and O4 can play an advantageous role in enabling the liner 220 to optimally reinforce the box 224, as discussed in greater detail below.

Figure 16:
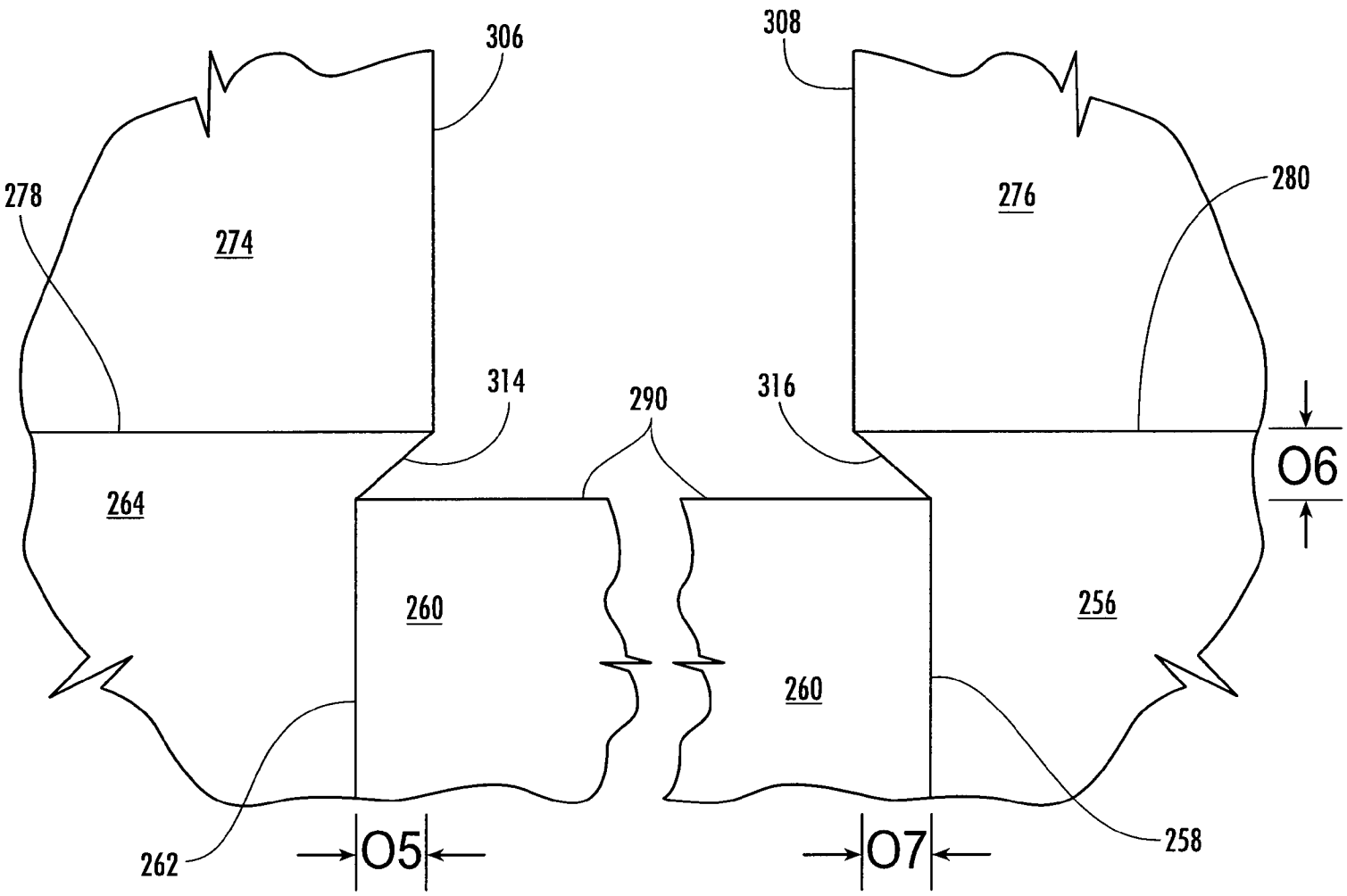
FIG. 16 is a schematic, relatively enlarged, partial view of the area surrounded by broken line 16 of FIG. 13.

Reference will now be made to FIG. 13 and FIG. 16. FIG. 16 is a relatively enlarged view of a portion of the area that is surrounded by imaginary broken line 16 of FIG. 13. A rearward oblique edge 314 of the long side panel 264 extends obliquely from: (i) the intersection of the rearward lateral fold line 278 and the longitudinal side edge 306 of the rear end flap 274 to (ii) the intersection of the long longitudinal fold line 262 and the lateral rearward edge 290 of the base panel 260. As a result, a lateral offset O5 is defined between the long longitudinal fold line 262 and the longitudinal side edge 306 of the rear end flap 274, and a longitudinal offset O6 is defined between the rearward lateral fold line 278 and the lateral rearward edge 290 of the base panel 260. These offsets O5 and O6 can play an advantageous role in enabling the liner 220 to optimally reinforce the box 224, as discussed in greater detail below.

Similarly, rearward oblique edge 316 of the short side panel 256 extends obliquely from: (i) the intersection of the rearward lateral fold line 280 and the longitudinal side edge 308 of the rear end flap 276 to (ii) the intersection of the short longitudinal fold line 258 and the lateral rearward edge 290 of the base panel 260. As a result, a lateral offset O7 is defined between the short longitudinal fold line 258 and the longitudinal side edge 308 of the rear end flap 276, and the longitudinal offset O6 is defined between the rearward lateral fold line 280 and the lateral rearward edge 290 of base panel 260. These offsets O6 and O7 can play an advantageous role in enabling the liner 220 to optimally reinforce the box 224, as discussed in greater detail below. Each of the offsets O1, O2, O3, O4, O5, O6, O7 is typically at least about equal to the thickness of the blank 222.

In the blank 222 of the second embodiment: each of the lateral fold lines 254, 268, 272, 278, 280, the end flaps' end edges 282, 284, 286, 288, the base panel's lateral forward edge 292 and the base panel's rearward edge 290 extend in a lateral direction; each of the longitudinal fold lines 258, 262, the longitudinal side edges 296, 298 of the blank 222, and the longitudinal side edges 300, 304, 306, 308 of the end flaps 266, 270, 274, 276 and the longitudinal side edge 302 of the holding flap 240 extend in a longitudinal direction; the lateral and longitudinal directions are perpendicular to one another; and each of the oblique forward edge 294 of base panel 260, the oblique slit 310 and the oblique edges 312, 314, 316 extend obliquely to (e.g., about 45 degrees, or more or less, to) the longitudinal and lateral directions.

The slits 250, 310 are each typically a cut that extends completely through the blank 222. The fold lines 254, 258, 262, 268, 272, 278, 280 can each be a score line or any other type of line for facilitating folding, such as a score line that includes an alternating series of slits or cuts that extend coextensively along, and optionally all the way through, the score line. For example, in the blank 222 of the second embodiment, the lateral fold lines 254, 268, 272, 278, 280 are each in the form of a score line that includes an alternating series of slits or cuts that extend coextensively along, and completely through, the score line; whereas the longitudinal fold lines 258, 262 are solely in the form of score lines.

In the following, acceptable methods of erecting the liner 220 from the blank 222 and using the liner with the box 224 and bag 226 are described, in accordance with the second embodiment of the present invention. The bag 226 with its neck 228 can be generally positioned over the base panel 260 and/or the short side panel 256 of the blank 222 while the blank is in its flat configuration illustrated in FIG. 13. Then, the holding flap 240 can be pivoted upwardly, such as by folding along the intermediate lateral fold line 254. With the holding flap 240 extending upwardly, the neck 228 is pushed partially through the central opening 246 so that typically all of the free ends of the tabs 252 (i.e., the ends opposite the annular score line 248) "lock" into the neck's groove. Then, the side panels 256, 264 are pivoted upwardly respectively about the longitudinal fold lines 258, 262 so that the side panels extend upwardly from the respective edges of the base panel 260, and the bag 226 is between the side panels and supported by the base panel. In addition, the front end flaps' end edges 282, 284 are drawn toward one another, and the rear end flaps' end edge 286, 288 are drawn toward one another so that folding respectively occurs along the lateral fold lines 254, 268, 272, 278, 280, and the blank 222 is erected into the liner 220 as generally illustrated in FIGS. 11 and 12. Alternatively, the blank 222 can remain flat while the neck 228 is mounted to the gripping opening 242, and the liner 220 can be erected from the blank thereafter.

After the liner 220 has been erected and has the bag 226, namely the neck 228, attached thereto as described above, the rear end of the liner can be fully inserted into/through the box's access opening 229. In the following, the interrelationship between the features of the liner 220 and/or the box 224 after the liner has been fully inserted into the box and the box's access opening 229 has been closed are described in accordance with the second embodiment of the present invention, and for some of these interrelationships the respective offsets O1, O2, O3, O4, O5, O6, O7 play an advantageous role. Generally described for the blank 222, the offsets O1, O2, O3, O4, O5, O6, O7 respectively result in the flaps 240, 266, 270, 274, 276 being wider than the side panels 256, 264 to which they are respectively foldably connected. As a result, when the blank 222 is erected into the liner 220, the vertical dimension of the upright flaps 240, 266, 270, 274, 276 is greater than the vertical dimension of the upright side panels 256, 164

Further in the erected liner 220, the end edges 286, 288 of the insert's rear end flaps 274, 276 are proximate one another. More specifically, at least some of or substantially the entire lengths of the end edges 286, 288 of the insert's rear end flaps 274, 276 are in opposing face-to-face orientation and/or contact with one another. The outer faces of the insert's rear end flaps 274, 276 are proximate the inner face of the rear cover panel (not shown) of the box 224. More specifically, at least some of or substantially the entire outer faces of the insert's rear end flaps 274, 276 are in opposing face-to-face orientation and/or contact with at least some of or substantially the entire inner face of the rear cover panel of the box 224. The upper edges of the insert's rear end flaps 274, 276 are proximate the box's top panel 232. More specifically, at least some of or substantially the entire upper edges of the insert's rear end flaps 274, 276 are in opposing face-to-face orientation and/or contact with a marginal portion of the box's top panel 232. The lower edges 306, 308 of the insert's rear end flaps 274, 276 are proximate a marginal portion of the box's bottom panel 234. More specifically, at least some of or substantially the entire lower edges 306, 308 of the insert's rear end flaps 274, 276 are in opposing face-to-face orientation and/or contact with a marginal portion of the box's bottom panel 234. The lower edges 306, 308 and associated lower marginal portions of the insert's rear end flaps 274, 276 are proximate the insert's base panel's rearward edge 290. More specifically, the lower marginal portions of the insert's rear end flaps 274, 276 are in opposing face-to-face orientation and/or contact with at least some of or substantially all of the insert's base panel's rearward edge 290 (such that the bottom edges 306, 308 and associated lower marginal portions of the insert's rear end flaps 274, 276 are positioned between the insert's base panel's rearward edge 290 and the inner face of the rear cover panel of the box 224).

The outer face of the insert's base panel 260 is proximate the inner face of the box's bottom panel 234. More specifically, at least some of or substantially the entire outer face of the insert's base panel 260 is in opposing face-to-face orientation and/or contact with the inner face of the box's bottom panel 234. In addition, the side of the insert's base panel 260 that is adjacent the long longitudinal fold line 262 extends for substantially the entire length of the interior of the box 224.

The outer face of the insert's long side panel 264 is proximate the inner face of the box's right side panel 236. More specifically, at least some of or substantially all of the outer face of the insert's long side panel 264 is in opposing face-to-face orientation and/or contact with at least some of or substantially all of the inner face of the box's right side panel 236. The upper edge of the insert's long side panel 264 is proximate a marginal portion of the inner face of the box's top panel 232. More specifically, at least some of or substantially the entire length of the upper edge of the insert's long side panel 264 is in opposing face-to-face orientation and/or contact with a marginal portion of the inner face of the box's top panel 232. The insert's long side panel 264 and the upper edge of the insert's long side panel 264 extend for substantially the entire length of the interior of the box 224, and the insert's long side panel 264 rises to substantially the entire height of the interior of the box.

The outer face of the insert's short side panel 256 is proximate the inner face of the box's left side panel 238. More specifically, at least some of or substantially all of the outer face of the insert's short side panel 256 is in opposing face-to-face orientation and/or contact with the inner face of the box's left side panel 238. The upper edge of the insert's short side panel 256 is proximate a marginal portion of the inner face of the box's top panel 232. More specifically, at least some of or substantially the entire length of the upper edge of the insert's short side panel 256 is in opposing face-to-face orientation and/or contact with a marginal portion of the inner face of the box's top panel 232. The insert's short side panel 256 rises to substantially the entire height of the interior of the box 224.

The end edges 282, 284 of the insert's front end flaps 266, 270 are proximate one another. More specifically, at least some of or substantially the entire lengths of the end edges 282, 284 of the insert's front end flaps 266, 270 are in opposing face-to-face orientation and/or contact with one another. The outer faces of the insert's front end flaps 266, 270 are proximate the inner face of the front end panel (e.g., end flaps 230) of the box 224. More specifically, at least some of or substantially the entire outer faces of the insert's front end flaps 266, 270 are in opposing face-to-face orientation and/or contact with the inner face of the front end panel (e.g., end flaps 230) of the box 224. The upper edges of the insert's front end flaps 266, 270 are proximate a marginal portion of the box's top panel 232. More specifically, at least some of or substantially the entire upper edges of the insert's front end flaps 266, 270 are in opposing face-to-face orientation and/or contact with a marginal portion of the box's top panel 232. The lower edges 300, 304 of the insert's front end flaps 266, 270 are proximate a marginal portion of the box's bottom panel 234. More specifically, at least some of or substantially all of the entire lower edges 300, 304 of the insert's front end flaps 266, 270 are in opposing face-to-face orientation and/or contact with a marginal portion of the box's bottom panel 234. The lower edges 300, 304 and associated lower marginal portions of the insert's front end flaps 266, 270 are proximate the insert's base panel's lateral forward edge 292. More specifically, the lower marginal portions of the insert's front end flaps 266, 270 are in opposing face-to-face orientation and/or contact with the insert's base panel's lateral forward edge 292 (such that the bottom edges 300, 304 and associated lower marginal portions of the insert's front end flaps 266, 270 are positioned between the insert's base panel's lateral forward edge 292 and the inner face of the front end panel (e.g., end flaps 230) of the box 224).

The upper edge of the insert's holding flap 240 is proximate a portion of the box's top panel 232. More specifically, at least some of or substantially the entire upper edge of the insert's holding flap 240 is in opposing face-to-face orientation and/or contact with a portion of the box's top panel 232. The lower edge 302 of the insert's holding flap 240 is proximate the box's bottom panel 234. More specifically, at least some of or substantially the entire lower edge 302 of the insert's holding flap 240 is in opposing face-to-face orientation and/or contact with a portion of the box's bottom panel 234. The lower edge 302 and associated lower marginal portion of the insert's holding flap 240 is proximate the insert's base panel's oblique forward edge 294. More specifically, the lower marginal portion of the insert's holding flap 240 is in opposing face-to-face orientation and/or contact with the insert's base panel's oblique forward edge 294 (such that the bottom edge 302 and associated lower marginal portion of the insert's holding flap 240 are positioned between the insert's base panel's oblique forward edge 294 and the corner 245 (FIGS. 17 and 18) of the box 224).

As mentioned previously and as best understood with reference to FIGS. 17 and 18, the placement of the gripping opening 242 can be coordinated with the oblique arrangement of the insert's holding flap 240 (e.g., the gripping opening 242 can be equally spaced between the intermediate and forward lateral fold lines 254, 268 (FIG. 13)) so that the spigot 244 is advantageously arranged in the interior corner 245 of the box 224, which is a beneficial compact arrangement. More specifically and as best understood with reference to FIG. 18, while the box's access opening 229 is closed, the outer face of the insert's holding flap 240 is in opposing face-to-face relation with the box's interior corner 245, namely respective portions of the box's front cover panel 350 and the box's left side panel 238. As a result, a generally triangular chamber is defined between the insert's holding flap 240, portions of the box's front cover panel 350 and the box's left side panel 238. In a plan view of this triangular chamber, as in FIG. 18, the triangular chamber is at least approximately in the form of a right triangle.

Turning over the liner 220 before it is erected, as well as the relative orientation of the liner 220 and the box 224 when the liner is inserted into the box, will affect which of the box's interior corners (e.g., corner 245) will be in opposing face-to-face relation with the insert's holding flap 240. That is, it is possible for the insert's holding flap 240 to be in opposing face-to-face relation with any of the box's interior corners. Therefore and for example, references made to directional orientations in this specification should be understood to have been made for purposes of illustration rather than for the purpose of narrowing the scope of the present invention.

All of the above-described opposing face-to-face orientations and/or contacts can help to reinforce the box 224. This reinforcement is particularly advantageous after the bag 226 in the box 224 is filled or partially filled with fluid, or the like, because it is often desirable to ship such boxes and/or stack two or more of the boxes one upon the other. In accordance with alternative embodiments of the present invention, one or more of the above-described opposing face-to-face orientations and/or contacts can be omitted.

With the liner 220 and the bag 226 installed in the box 224 such that the insert's holding flap 240 is holding the bag's neck 228 as described above, the bag can be filled with fluid, or the like, through the neck. While the bag 226 is being filled, the insert's holding flap 240 advantageously holds the neck 228 proximate the box's access opening 229. That is, an aspect of the present invention is the provision of methods and apparatus for stabilizing the bag 226 and/or neck 228 while the bag is being filled with fluid. After a predetermined amount of fluid has been put into the bag 226 (e.g., after the bag has been filled or partially filled), the neck 228 is closed. The filled or partially filled bag 226 rests upon the insert's base panel 260, between the insert's side panels 256, 264.

The neck 228 can be closed and opened in any conventional manner, such as with a closure mechanism that is in the form of a removable cap or the spigot 244. After the neck 228 is closed, the box's access opening 229 can be closed such as by pivoting the box's respective end flaps 230 over the box's access opening 229 and then securing them in a conventional manner, such as with adhesive material or any other suitable fastening mechanism. When it is desired to discharge some of the fluid from the bag 226, the box 224 can be laid upon a horizontal surface such that the outer surface of the box's bottom panel 234 is resting upon the horizontal surface. The box's access opening 229 is opened such as by pivoting the respective end flaps 230 away form the box's access opening 229. Thereafter, the spigot 244 can be conveniently used to discharge the fluid.

In accordance with an aspect of the present invention, one or more of, or all of, the insert's end flaps 266, 270, 274, 276 can be omitted and/or one or more of, or all of, the offsets O1, O2, O3, O4, O5, O6, O7 can be omitted. For example, when the front end flap 270 is omitted, the offsets O3 and O4 can be omitted. Similarly, when the rear end flap 274 is omitted, the offset O5 and the offset O6 defined between the rearward lateral fold line 278 and the lateral rearward edge 290 of the base panel 260 can be omitted. Similarly, when the rear end flap 276 is omitted, the offset O7 and the offset O6 defined between the rearward lateral fold line 280 and the lateral rearward edge 290 of the base panel 260 can be omitted. In one specific example in which the front end flap 270 has been omitted, the other front end flap 266 remains, and optionally its length can be increased. In this same specific example and/or other examples, both of the rear end flaps 274, 276 can be omitted.

As best understood with reference to FIG. 14, in accordance with another aspect of the second embodiment of the present invention, the oblique forward edge 294 and oblique slit 310 can be omitted, so that the insert's base panel's lateral forward edge (e.g. and in contrast, see the unextended lateral forward edge 292 in FIG. 13) is extended farther toward the insert's holding flap's longitudinal side edge 302. In accordance with this aspect, the offsets O1 and O2 are omitted, and a longitudinal slit (not shown) extends from, and collinear with, the forward end of the short longitudinal fold line 258 to the end of the insert's base panel's extended lateral forward edge (e.g. and in contrast, see the unextended lateral forward edge 292) that is adjacent the insert's holding flap 240.

Reiterating from above and as best understood with reference to FIG. 18, while the box's access opening 229 is closed by the front cover panel 350 (e.g., overlapping front flaps 230), the spigot 244 is arranged in the interior corner 245 of the box 224. In accordance with one example, the spigot 244 can be accessed by opening the box's access opening 229 such as by pivoting the respective front flaps 230 away form the box's access opening 229. In contrast and in accordance with an alternative embodiment of the present invention, at least a portion of the box's access opening 229 can be opened or otherwise accessed by opening (e.g., tearing away) an openable portion of the box 224 that is defined by one or more tear lines (not shown for the second embodiment) that may extend at least partially across the box's front cover panel 350/closed front flaps 230. In one specific example, structure of the box 224 that defines the box's interior corner 245 (including the respective portion of the box's bottom panel 234) is torn away to expose the spigot 244 so that access to the spigot's actuator 243 (FIG. 17) and discharge opening 45 (FIG. 17) is unobstructed.

The first and second embodiments of the present invention can be modified, such as to be more like a third embodiment of the present invention. For example, the gripping openings 42, 242 (e.g., FIGS. 1, 2, 5, 7, 11 and 13) of the first and second embodiments of the present invention can be modified to be more slot-like, so that they each have an end that extends all the way to, and is open at, an edge of the respective holding flap 40, 240. As a more specific example, the gripping openings 42, 242 of the first and second embodiments can be modified to be like any of the other types of gripping openings disclosed herein. Even more specifically, the gripping openings 42, 242 can each be replaced with a gripping opening that is like, or at least generally like, the gripping opening 436 (e.g., FIGS. 19 and 20) of the third embodiment of the present invention.

Reiterating from above, in the following portion of this Detailed Description of Exemplary Embodiments section of this disclosure, numerous other embodiments of the present invention are described, and these other embodiments can be like the above-described first embodiment of the present invention, except for variations noted and variations that will be apparent to those of ordinary skill in the art. Nonetheless, for many of the features of the following embodiments that are like corresponding features of the first embodiment of the present invention, the same respective element numbers have not been used. Any lack of correspondence between element numbers is not intended to narrow the scope of the present invention.

The third embodiment of the present invention is described in the following with reference to FIGS. 19-30. In accordance with the third embodiment and generally described, a liner blank 420 (FIG. 19) is erected into a liner 470 (FIGS. 21, 23 and 24) that supports a bag 410 (FIGS. 20, 21 and 23), and the liner and bag are inserted into a box 550 (FIGS. 23-27), which has been erected from a blank 480 (FIG. 22), to form a bag-in-a-box package 600 (FIGS. 24-27). As should be apparent from above, the box 550 can be characterized as being a carton, or it can more generally be referred to as a construct or an outer container.

The flexible bag 410 may be fluid impervious and suitable for containing a flowable material (not shown), such as a liquid (e.g., beverage), fine powders, salts, or other flowable materials. Advantageously, the liner 420 can support the bag 410 and/or spigot 412 and/or neck 414 in such a way as to provide easy access to the bag contents. The liner 420 may also reinforce the box 550. The bag 410, spigot 412 and neck 414 can be as described above for the first and second embodiments.

Figure 19:
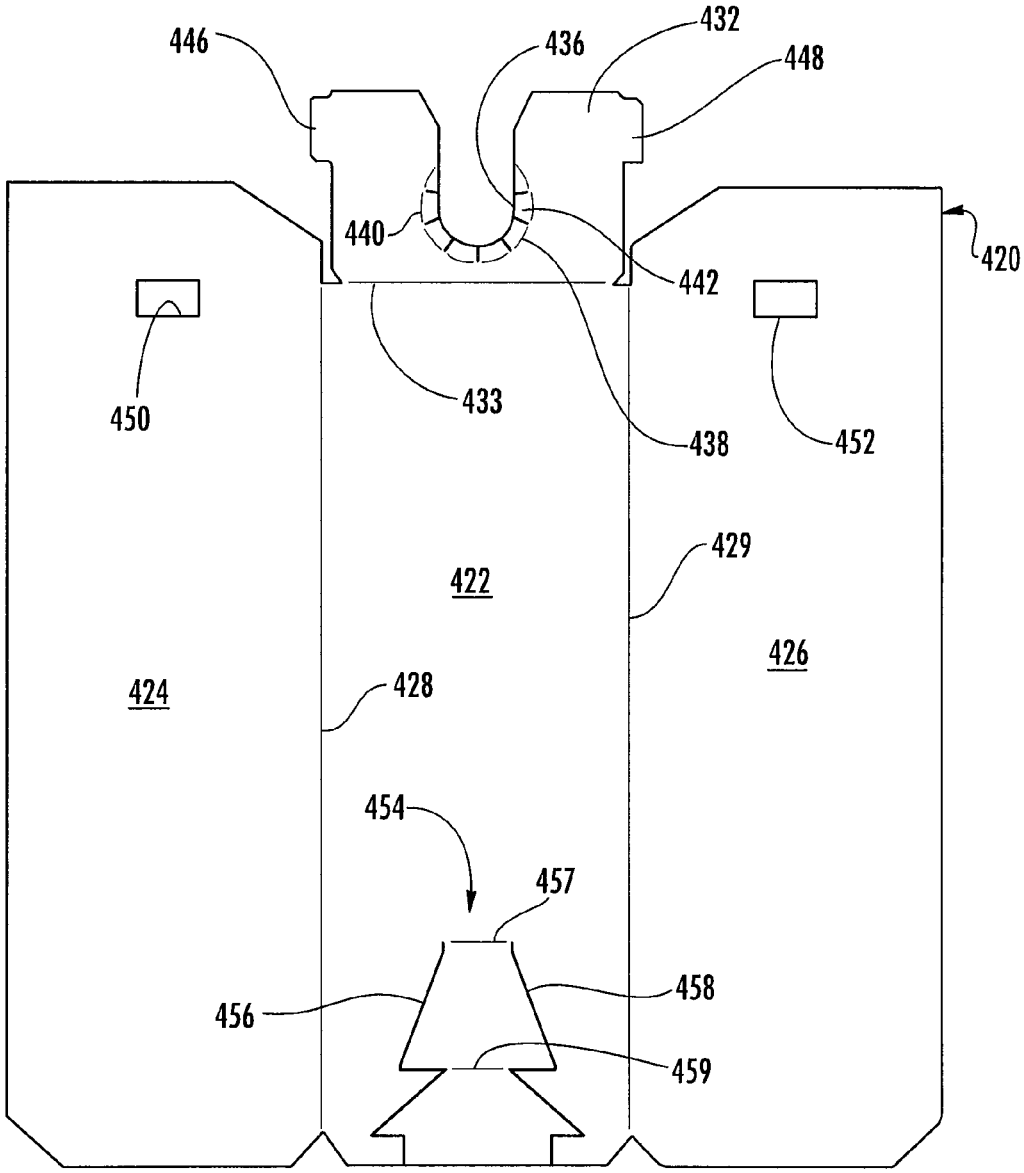
FIG. 19 is a schematic plan view of a blank from which a liner can be formed, in accordance with a third embodiment of the present invention.

Referring to FIG. 19, the liner blank 420 includes a base panel 422 and first and second side panels 424, 426 that are respectively foldably connected to the base panel 422 along longitudinal fold lines 428, 429. A holding flap 432 is foldably connected to a front end of the base panel 422 at a transverse fold line 433.

The holding flap 432 includes a gripping opening 436 that is illustrated as having an end that extends all the way to, and is open at, an edge of the holding flap. The opposite end of the gripping opening 436 is illustrated as having a starburst configuration that is for gripping the bag's neck 414. Whereas the starburst configuration may be optional, it is illustrated in FIG. 19 as being formed by a line of weakening, such as a score or crease line 438, and a plurality of radially extending slits 440 extending from the score or crease line 438. The crease line 438 and the radially extending slits 440 define a plurality of inwardly extending radial tabs 442 that are hingedly connected to the remainder of the holding flap 432 at the crease line 438. The crease line 438 may be, for example, partially circular, partially polygonal, or the like. The crease line 438 can be omitted, for example, to increase the rigidity of the tabs 442. The number of radial tabs 442 can vary. The gripping openings of all of the embodiments of the present invention can be in different sizes and shapes, for example depending upon the sizes and shapes of the necks or other structures they are to receive and hold.

First and second retention tabs 446, 448 may be disposed at upper opposed ends of the holding flap 432. The retention tabs 446, 448 are sized and shaped to be respectively received and retained in first and second retention apertures 450, 452 respectively in the first and second side panels 424, 426. The interaction respectively between the retention tabs 446, 448 and the retention apertures 450, 452 is for respectively connecting the opposite edges of the holding flap 432 to the side panels 424, 426 and thereby at least partially supporting the holding flap 432 in an upright configuration while the liner 470 is erected. As a result of the respective interaction between the retention tabs 446, 448 and retention apertures 450, 452, when the liner 470 is fully erected and within the box 550 in accordance with the third embodiment, not only are the side edges of the holding flap 432 respectively in opposing face-to-face contact with the inwardly facing faces of the liner's side panels 424, 426, the side edges of the holding flap 432 can also be characterized as being respectively connected to the side panels 424, 426.

Optionally, a support stand 454 may be defined in the bottom panel 422 of the liner blank 420. As illustrated in FIG. 19, the support stand 454 is defined by slits or tear lines 456, 458 that extend in a generally zigzag fashion from a fold line 457 to an edge of the bottom panel 422. Another fold line 459 can extend between points of the tear lines 456, 458, for facilitating deployment of the support stand 454, as will be discussed in greater detail below. The support stand 454 can be used to tilt the package 600 and thereby aid in dispensing of contents of the bag 410, as will be discussed in greater detail below.

Figure 20:
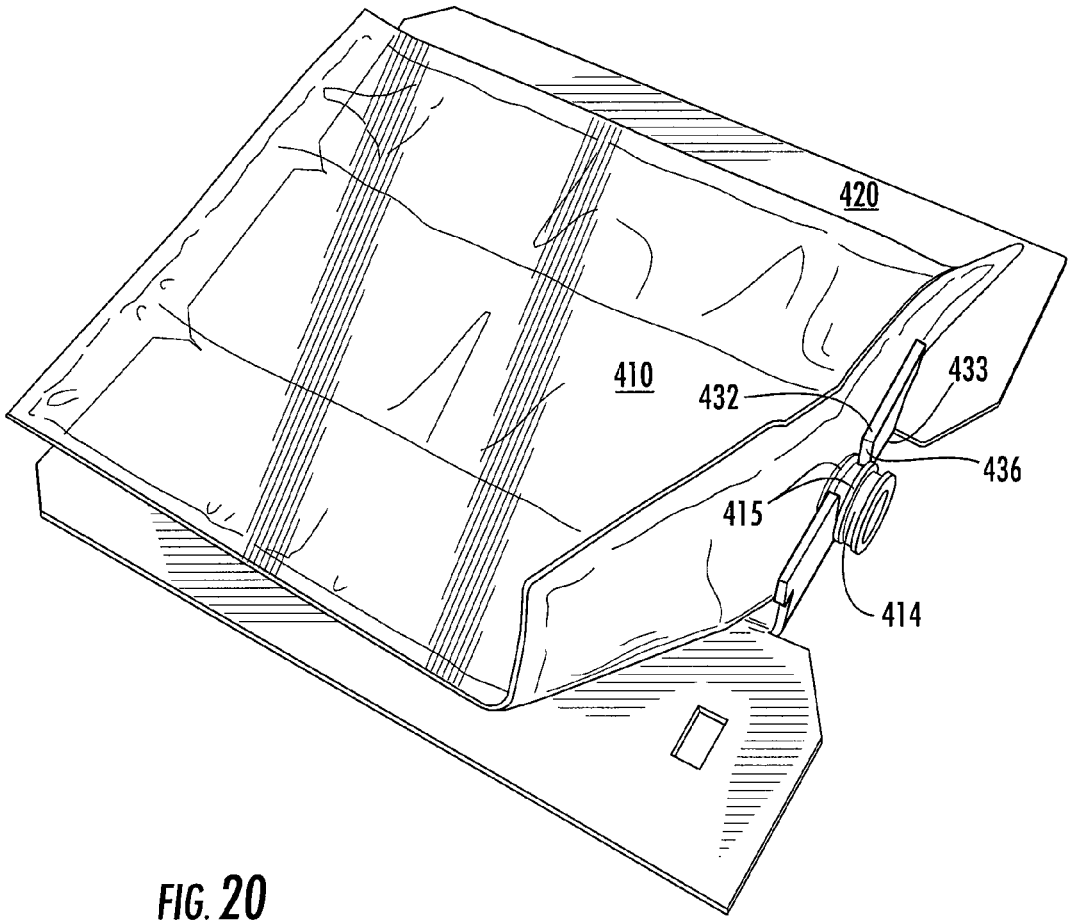
FIG. 20 illustrates the blank of FIG. 19 partially erected into the liner, and an empty bag and associated neck attached to a flap of the liner, in accordance with the third embodiment of the present invention.

An exemplary method of mounting the bag 410 to the liner 470 will now be described with reference to FIGS. 20 and 21. Whereas the bag 410 is illustrated as being empty in FIG. 20 and full in FIG. 21, it is within the scope of the present invention for the bag to be filled at a variety of different times during the erecting and assembling of the package 600, as will be discussed in greater detail below. As best understood with reference to FIG. 20, the liner blank 420 and the bag 410 are placed in a superposed arrangement with respect to one another, so that the neck 414 is proximate the gripping opening 436. The neck 414 is then moved into the gripping opening 436. Alternatively, the liner blank 420 can be moved so that the neck 414 enters the gripping opening 436. As the neck 414 is pressed into the gripping opening 436, the radial tabs 442 deform so that the neck 414 is securely held within the gripping opening 436 by the hingedly connected radial tabs 442. In the configuration illustrated in FIG. 20, the free ends of the deformable radial tabs 442 (FIG. 19) are positioned (e.g., "locked") between two annular flanges 415 of the neck 414. The flanges 415 are spaced apart with respect to one another to accommodate the thickness of the material used to form the holding flap 432.

In accordance with the third embodiment of the present invention, the neck 414 can be installed in the gripping opening 436 in the manner described immediately above prior to any erecting of the liner 470 (e.g., while the entire liner blank 420 (FIG. 19) is in a flat or substantially flat configuration). Thereafter, the holding flap 432 may be folded about the transverse fold line 433 so that it is substantially perpendicular to the remainder of the liner blank 420, as illustrated in FIG. 20. In accordance with an alternative embodiment of the present invention, the neck 414 is installed to the gripping opening 436 after the holding flap 432 is folded or at some other step in the erection of the liner 470.

Figure 21:
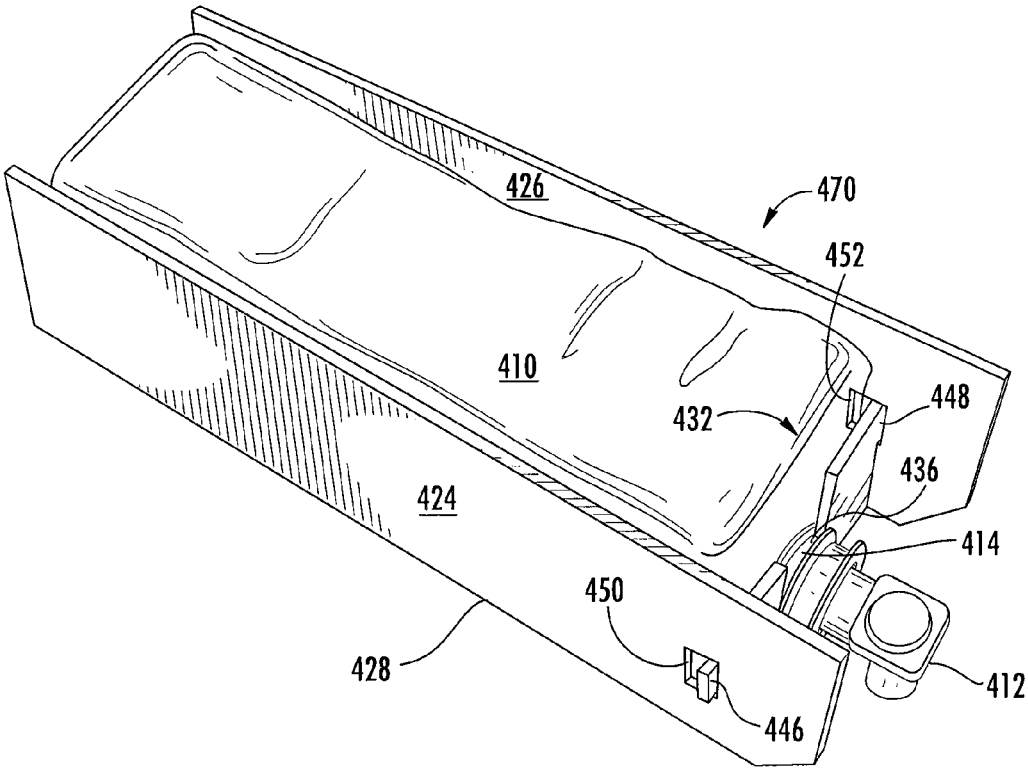
FIG. 21 is like FIG. 20, except that a flowable material is contained in the bag, a spigot has been installed to the neck, and the liner has been fully erected.

Referring to FIG. 21, the first and second side panels 424, 426 are folded about their respective fold lines 428, 429 so that they are substantially perpendicular to the base panel 422. This folding of the side panels 424, 426 respectively brings the first and second retention tabs 446, 448 respectively into the first and second retention apertures 450, 452, thereby completing erection of the liner 470. Insertion of the first and second retention tabs 446, 448 respectively into the first and second retention apertures 450, 452 seeks to prevent the holding flap 432 from unfolding about the fold line 433, and the liner 470/bag 410 assembly is now ready for insertion into the box 550.

Figure 22:
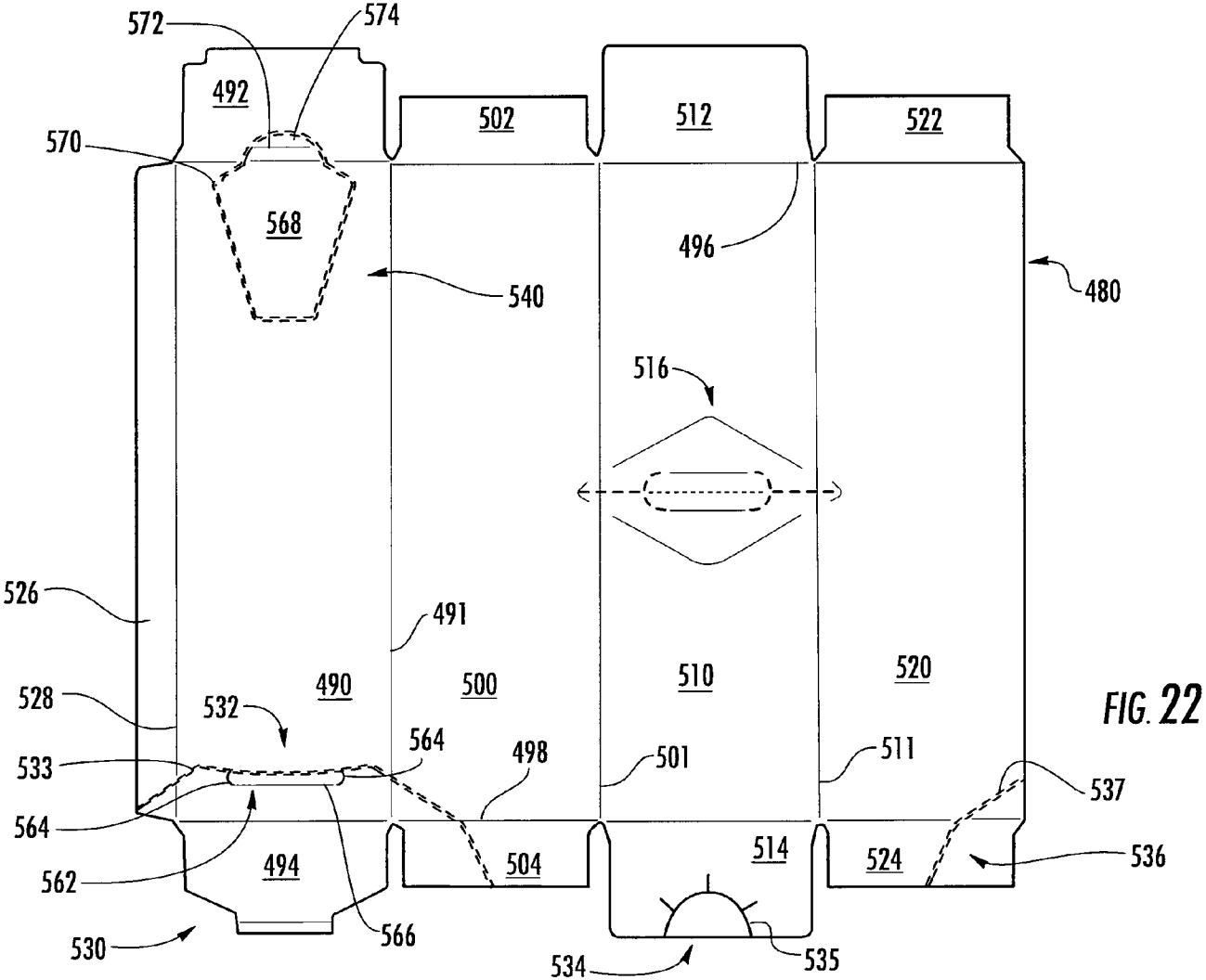
FIG. 22 is a schematic plan view of a blank from which a box can be formed, with the box being for having the combination of FIG. 21 inserted thereinto, in accordance with the third embodiment of the present invention.

In accordance with the third embodiment of the present invention, the box 550 is erected from the blank 480 illustrated in FIG. 22. The blank 480 includes a bottom panel 490 foldably connected to a first side panel 500 at a first transverse fold line 491, a top panel 510 foldably connected to the first side panel 500 at a second transverse fold line 501, and a second side panel 520 foldably connected to the top panel 510 at a third transverse fold line 511. An adhesive flap 526 can be foldably attached to the bottom panel 490 at a fourth transverse fold line 528. The adhesive flap may alternatively be located at the opposite end of the blank 480.

The bottom panel 490 is foldably connected to a first bottom flap 492 and a second bottom flap 494. The first side panel 500 is foldably connected to side end flaps 502, 504. The top panel 510 is foldably connected to a first top end flap 512 and a second top end flap 514. A handle 516 of conventional configuration may also be formed in the top panel 510. The handle 516 is illustrated as being in the form of a generally diamond-shaped, stress-relieving score line extending partially around two flaps that are separable from one another by a tear line and/or slit that extends across the top panel 510 and a short distance into the side panels 500, 520.

The second side panel 520 is foldably connected to side end flaps 522, 524. The end flaps 492, 502, 512, 522 extend generally along a first marginal area of the blank 480 and may be foldably connected along a common longitudinal fold line 496. The end flaps 494, 504, 514, 524 extend generally along a second marginal area of the blank 480 and may be foldably connected along a common longitudinal fold line 498. The fold lines 496, 498 need not be straight lines, and certain sections can be offset. When the package 600 is erected (FIG. 25), the end flaps 492, 502, 512, 522 close a back or non-access end of the box 550, and the end flaps 494, 504, 514, 524 close an access opening at the front end of the box 550.

An forward access opening pattern 530 is formed in the blank 480. The forward access opening pattern 530 defines a forward openable portion 560 (FIG. 25) in the fully erected box 550, and the forward openable portion can be opened (e.g., fully removed) to expose an access opening (FIGS. 26 and 27) and thereby provide access to the spigot 412 of the package 600. In accordance with the third embodiment of the present invention, the forward access opening pattern 530 includes a first section 532 extending through the adhesive flap 526, the bottom panel 490, the first side panel 500 and the side end flap 504; a second section 534 that is formed in the top end flap 514; and a third section 536 that is formed in the second side panel 520 and in the side end flap 524.

The forward access opening pattern 530 can be formed from, for example, score lines, cut/space lines, cut lines, and/or other lines of disruption and combinations thereof, that allow removal or opening of the forward openable portion 560 of the box 550 for providing access to the spigot 412. More specifically and in accordance with the third embodiment of the present invention, the first section 532 of the forward access opening pattern 530 includes a tear line 533 that extends from an edge of the adhesive flap 526 to an edge of the side end flap 504; the second section 534 of the forward access opening pattern includes an arcuate tear line 535 having opposite ends that extend to an edge of the top end flap 514; and the third section 536 of the forward access opening pattern includes a tear line 537 that extends from an edge of the second side panel 520 to an edge of the side end flap 524. In addition, the first section 532 of the forward access opening pattern 530 can include an access flap 562 that is for receiving the finger tips of a user for facilitating the beginning of the removal of the forward openable portion 560. As illustrated in FIG. 22, the access flap is defined by slits 564 that extend from opposite ends of a fold line 566 to the tear line 533.

When the liner 470 includes the support stand 454 (FIGS. 19, 29 and 30), a rearward access opening pattern 540 is typically included in the blank 480 at an end of the blank 480 opposite from the forward access opening pattern 530. The rearward access opening pattern 540 defines a rearward openable portion 568 (FIGS. 22 and 25), and the rearward openable portion can be opened (e.g., fully removed) to expose the support stand 454. The rearward access opening pattern 540 be formed from, for example, score lines, cut/space lines, cut lines, and/or other lines of disruption and combinations thereof, that allow removal or opening of the rearward openable portion 568 of the box 550 for providing access to the support stand 454. More specifically and in accordance with the third embodiment of the present invention, the rearward access opening pattern 540 includes a tear line 570 that extends in both the base panel 490 and the first bottom flap 492 so that the rearward openable portion 568 is positioned in both the base panel 490 and the first bottom flap 492, and is traversed by the longitudinal fold line 496. The first bottom flap 492 further includes a fold line 572 that traverses a portion of the rearward openable portion 568 so that it includes an access flap 574 that is for receiving the finger tips of a user for facilitating the beginning of the removal of the rearward openable portion 568.

A method of forming the package 600 from the bag 410, liner 470 and box blank 480 is discussed in the following, in accordance with the third embodiment of the present invention. The blank 480 can be erected into a tubular configuration, for example, by folding along the transverse fold lines 491, 501, 511, 528 and adhering the adhesive panel 526 to the second side panel 520. The rear end of this tubular construct formed from the blank 480 can be closed by respectively overlapping and adhering the end flaps 492, 502, 512, 522 with respect to one another. The rear end of the tubular construct formed from the blank 480 can be closed before, or at the same time as, or after the front end of this tubular construct is closed.

Figure 23:
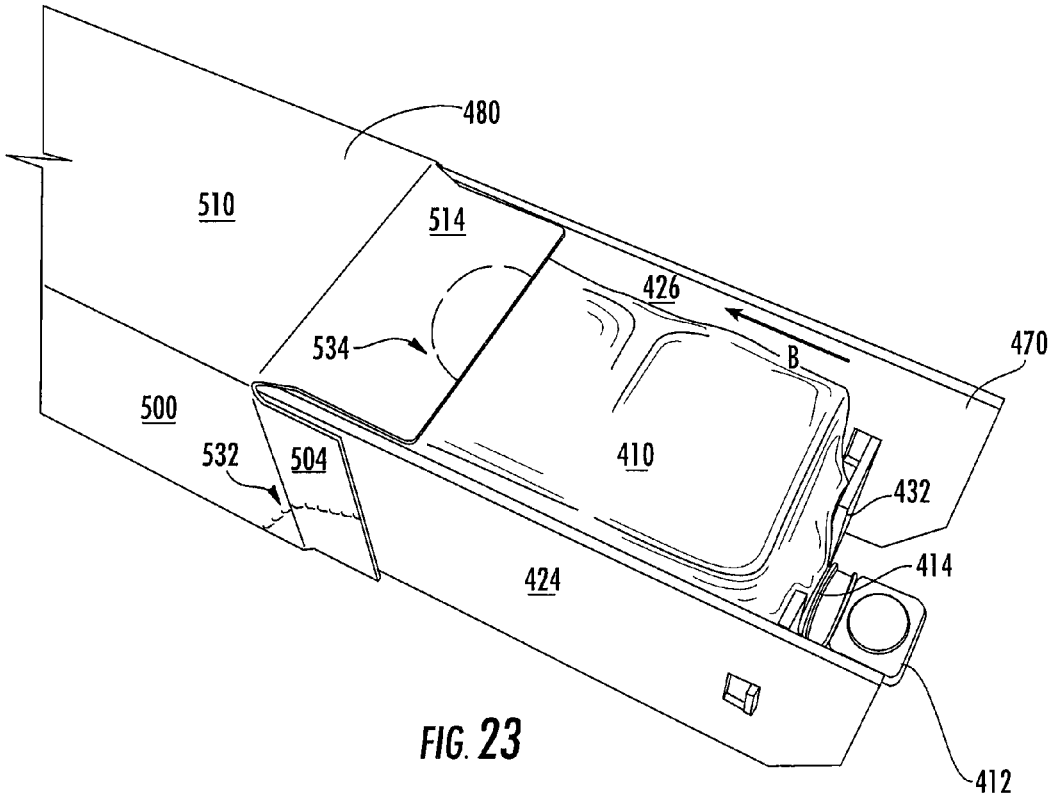
FIG. 23 is a partial view that illustrates the combination of FIG. 21 being inserted into the box erected from the blank of FIG. 22, in accordance with the third embodiment of the present invention.

FIG. 23 illustrates insertion (in the direction of the arrow B) of the liner 470, with the bag 410 mounted thereto, into the generally tubular, partially erected box blank 480. Advantageously, the neck 414 of the flexible bag 410 may be already engaged or mounted in the gripping opening 436 of the liner 470 before insertion of the liner into the box 550. Flowable contents (e.g., a beverage) can put into the bag via the neck 414 at a wide variety of different times during the assembly of the package 600, and the spigot 412 is typically installed to the neck after the bag has been filled, or partially filled, with the flowable material, so that the neck is closed by the spigot. The neck 412 can alternatively be closed by other devices, such as, but not limited to, plugs or caps. Alternatively, the spigot 412 can be installed to the neck 414 prior to the introduction of the flowable material in to the bag 410, and the flowable material can be introduced into the bag by way of the spigot.

Figure 24:
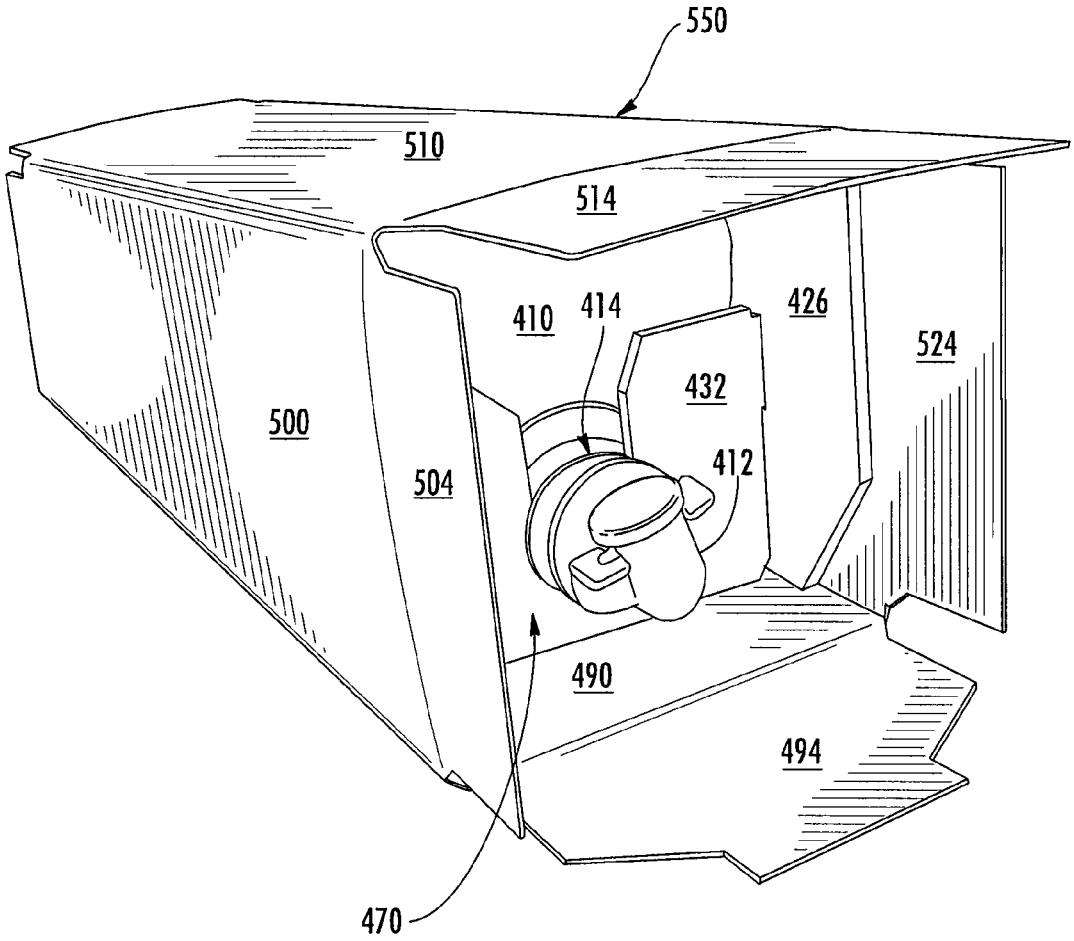
FIG. 24 is generally a front pictorial view that of the combination of FIG. 21 fully inserted into the box of the third embodiment.

FIG. 24 illustrates the liner 470 and bag 410 fully inserted into the front or access end of the box 550 with the end flaps 494, 504, 514, 524 open, so that the front access opening of the box 550 is open. As best understood by also referring to FIG. 21, when the liner 470 is fully inserted into the box 550, the side panels 500, 520 of the box hold the retention tabs 446, 448 of the holding flap 432 respectively within the retention apertures 450, 452 of the side panels 424, 426. The front end of the box 550, or more specifically the front access opening of the box, can be closed by respectively overlapping and adhesively securing the end flaps 494, 504, 514, 524 with respect to one another.

Figure 25:
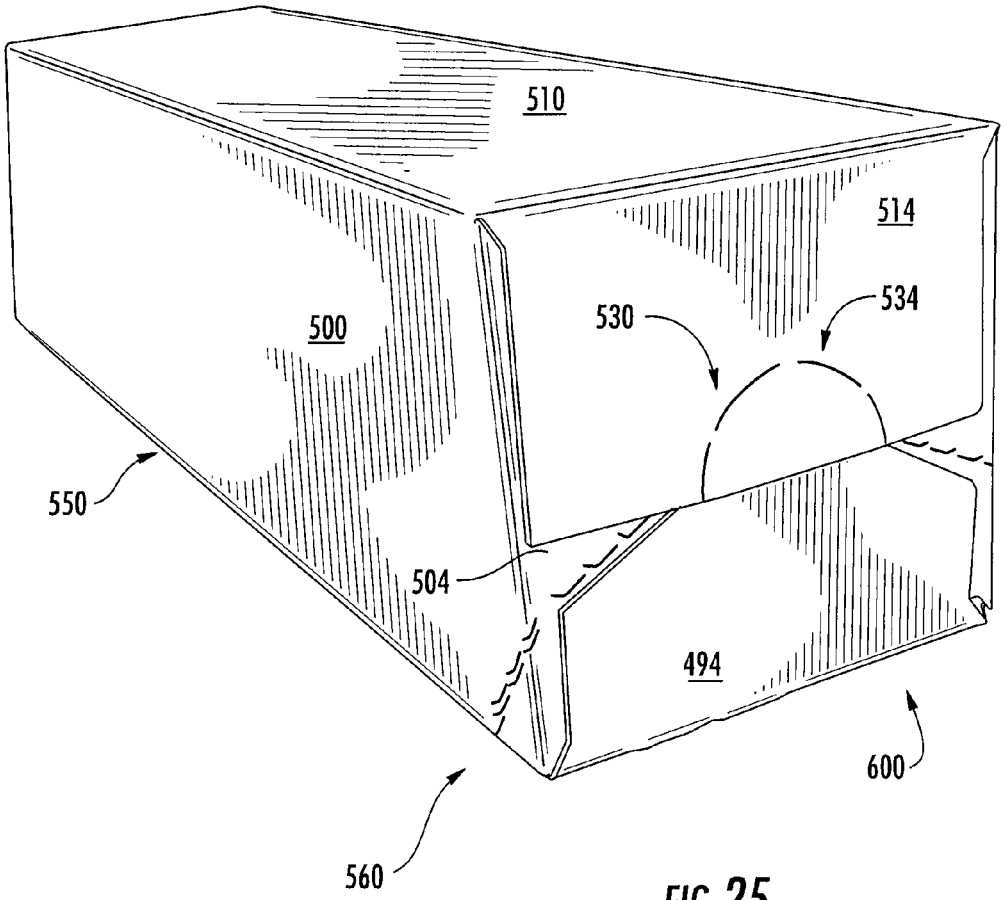
FIG. 25 is generally a front pictorial view of a bag-in-a-box package formed by closing the ends of the box after the combination of FIG. 21 has been fully inserted into the box in the manner illustrated by FIG. 24, in accordance with the third embodiment of the present invention.

FIG. 25 is a pictorial view of the front end of the completed package 600 (i.e., after the front end of the box 550, or more specifically the box's front access opening, has been closed by the end flaps 494, 504, 514, 524 and the end flaps 494, 504, 514, 524 have been respectively secured by adhesive material or any other suitable fastening mechanism. As illustrated in FIG. 25, access to the spigot 412 and associated features such as the neck 414 and bag 410 is obstructed. More specifically and for example, the spigot 412 is completely enclosed within the interior of the box 550 so that access to the spigot is at least temporarily restricted in a manner that at least temporarily restricts any dispensing of flowable material from the bag 410 by way of the spigot.

The front end of the box 550 includes the forward openable portion 560 that is defined by the forward access opening pattern 530. In accordance with the third embodiment of the present invention, a user can easily access the flowable contents within the package by tearing off the forward openable portion 560 to expose an access opening and thereby the spigot 412, and then operating the spigot. More specifically, the forward openable portion 560 is removed by tearing along the forward access opening pattern 530. In accordance with the third embodiment and as best understood by referring also to FIG. 22, this tearing can be initiated at the access flap 562 in the second section 532 of the forward access opening pattern 530 (i.e., in the box's bottom panel 490). Thereafter, the tearing of the forward access opening pattern 530 continues into the side panels 500, 520 and side end flaps 504, 524, and ultimately into the second section 534 of the forward access opening pattern 530 in the top end flap 514. However, differently configured forward access opening patterns 530 and openable portions 560 are also within the scope of the present invention.

Figure 26:
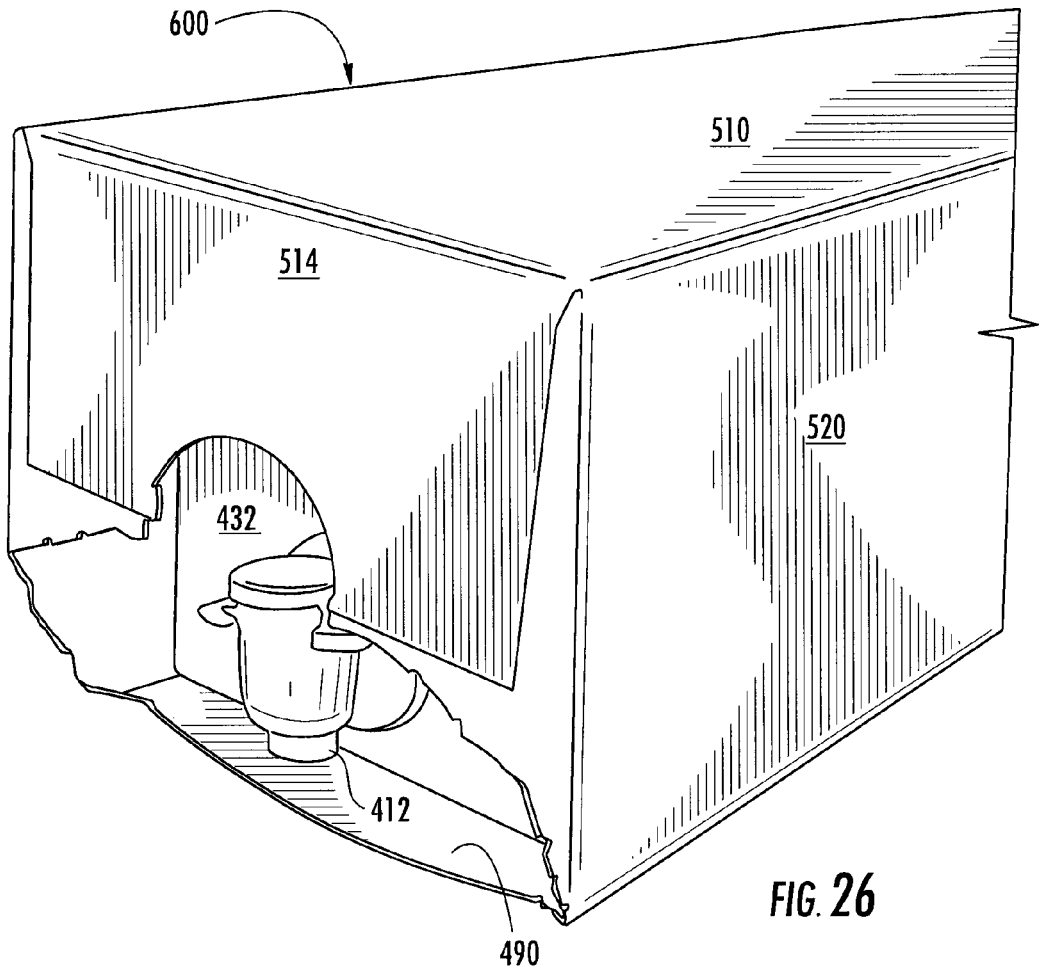
FIG. 26 is generally a front pictorial view of the front portion of the package of FIG. 25, after a forward openable portion of the package has been removed, in accordance with the third embodiment of the present invention.
Figure 27:
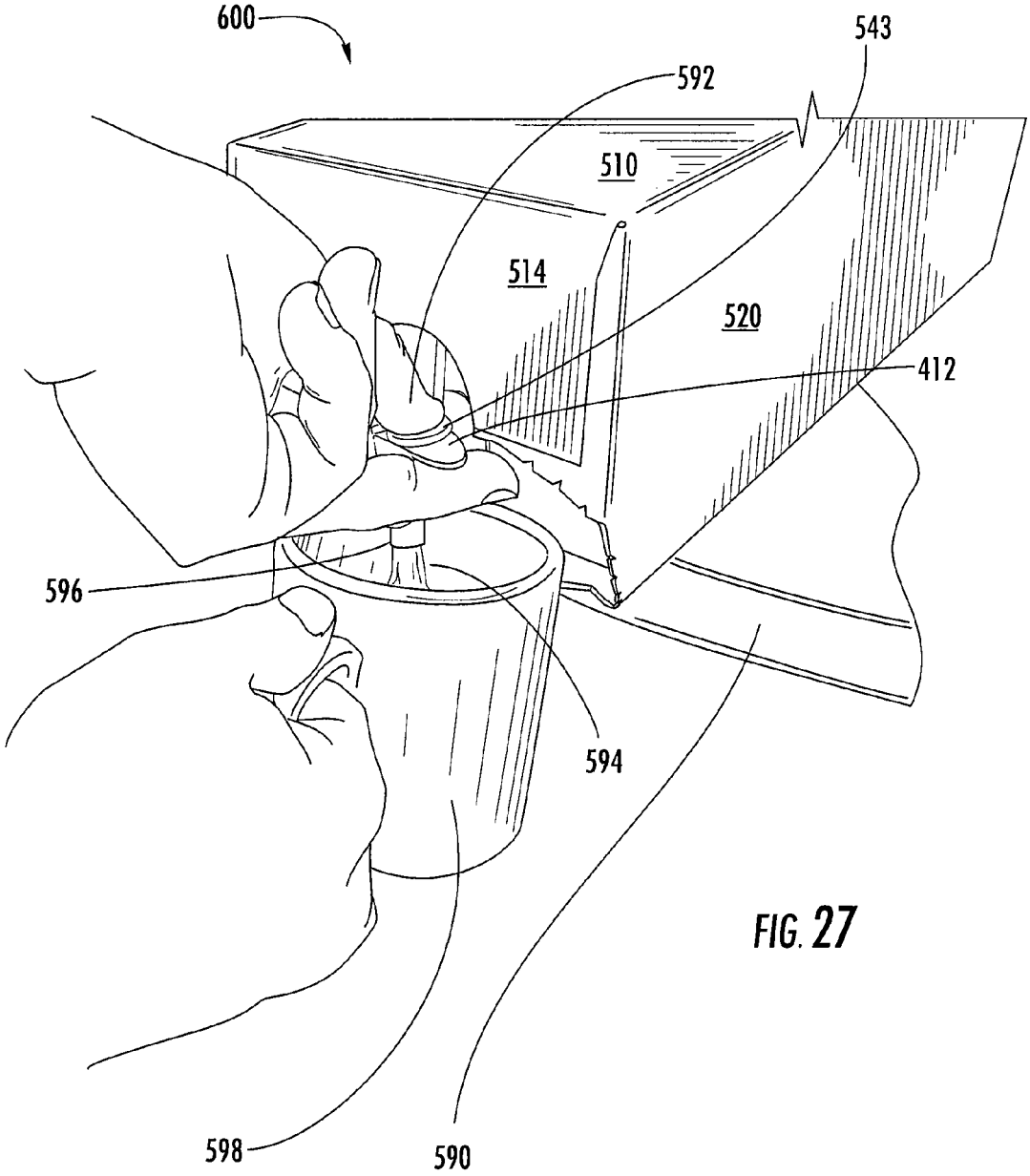
FIG. 27 is like FIG. 26, except that the package us upon a table top and a user is dispensing a flowable material from the package into a cup, in accordance with one example.

FIGS. 26 and 27 illustrate the package 600 with the forward openable portion 560 (FIG. 25) removed, so as to expose the front access opening of the box 550. In accordance with the third embodiment of the present invention, the package 600 can be immediately ready for dispensing upon removing the forward openable portion 560 and orienting the package 600 so that the base panel 490 of the box 550 faces downwardly, or the like. That is, a consumer need not perform any steps to mount or otherwise situate the spigot 412 with respect to the box 550 for dispensing. For example and as illustrated in FIG. 27, while the package 600 is upon a table top 590, or the like, and the spigot remains mounted to the holding flap 432 (FIG. 26), the actuator 543 of the spigot 412 can be manipulated by a user putting their finger or thumb 592 through the upper portion of the access opening formed by removing the forward openable portion 560, so that the flowable material 594 from the interior of the bag is discharged from the spigot's discharge opening 596. The flowable material 594 being discharged can be collected, for example, in a cup 598.

Incorporating the forward access opening pattern 540 into the box 550 is optional because, for example, the box's front access opening can alternatively be accessed by opening the end flaps 494, 504, 514, 524 so that they are configured as illustrated in FIG. 24. Nonetheless, it can be advantageous for the box 550 to include the forward access opening pattern 540, or the like, because removal of the forward openable portion 560 results in removal of the forward end of the box's base panel 490, or at least a portion thereof, in a manner that allows a cup 598, or the like, to be conveniently placed directly beneath, and in close proximity to, the spigot 412.

Similarly, including the liner's support stand 454 (FIG. 19) and box's rearward access opening pattern 540 (FIG. 22) is optional. Nonetheless, it can be advantageous for the package 600 to include the supports stand 454 and rearward access opening pattern 540 because they can enhance the dispensing of the flowable material from the package, by enabling the rear end of the package to be conveniently elevated with respect to the front end of the package.

Figure 28:
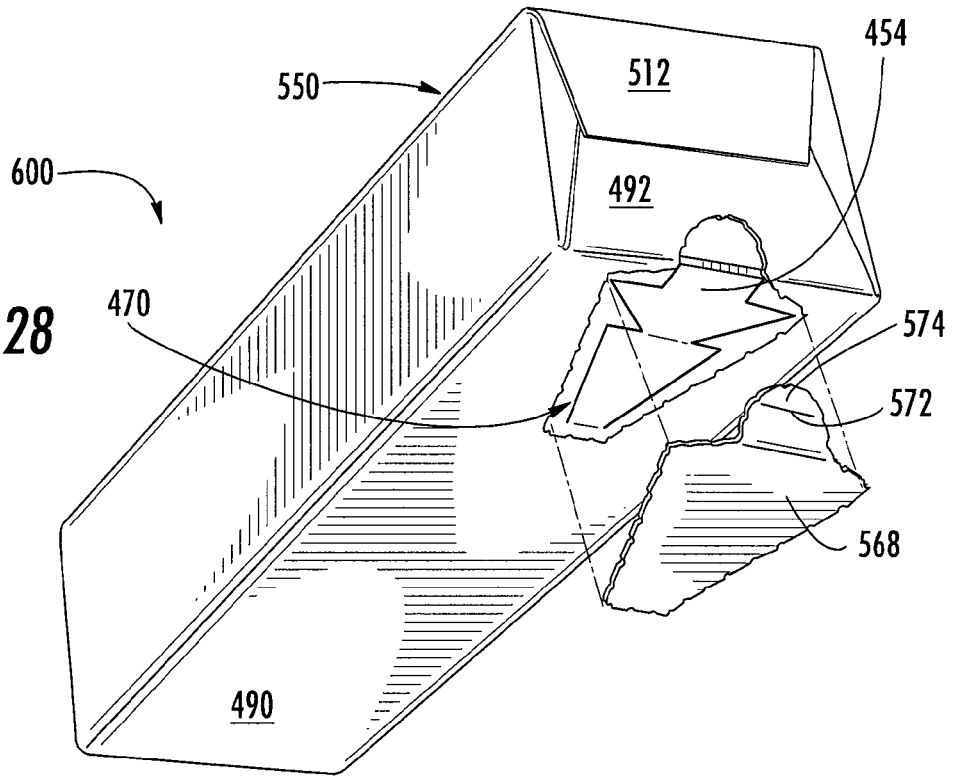
FIG. 28 is generally a rear, bottom pictorial view of the package of FIG. 25, with a rearward openable portion of the box exploded away from the package to expose a support stand of the liner that is within the box, in accordance with the third embodiment of the present invention.
Figure 29:
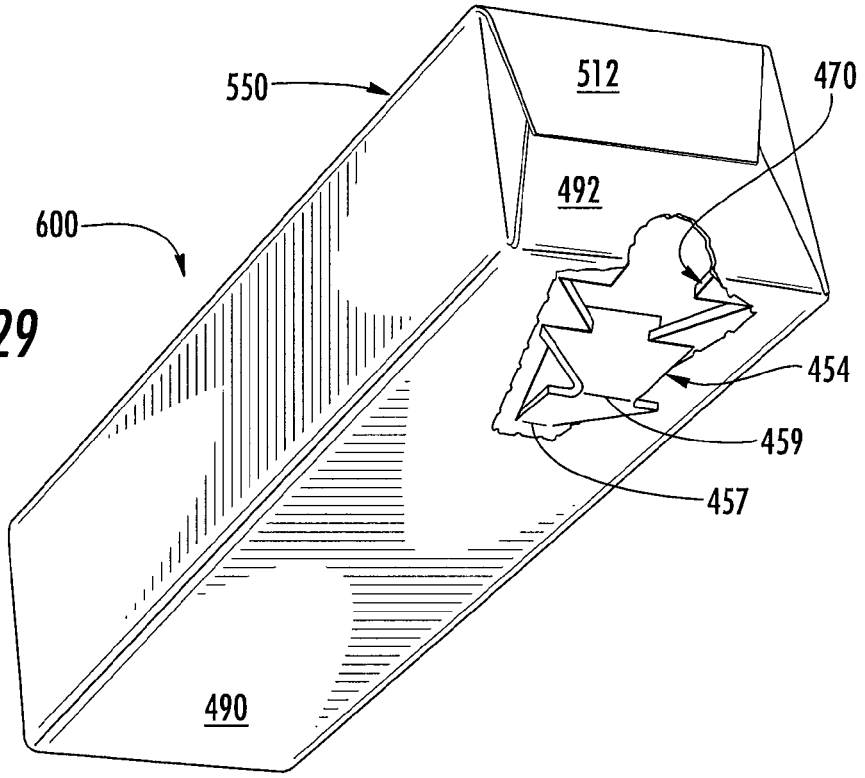
FIG. 29 is similar to FIG. 28, except that the openable portion is not shown and the support stand has been deployed, in accordance with the third embodiment of the present invention.
Figure 30:
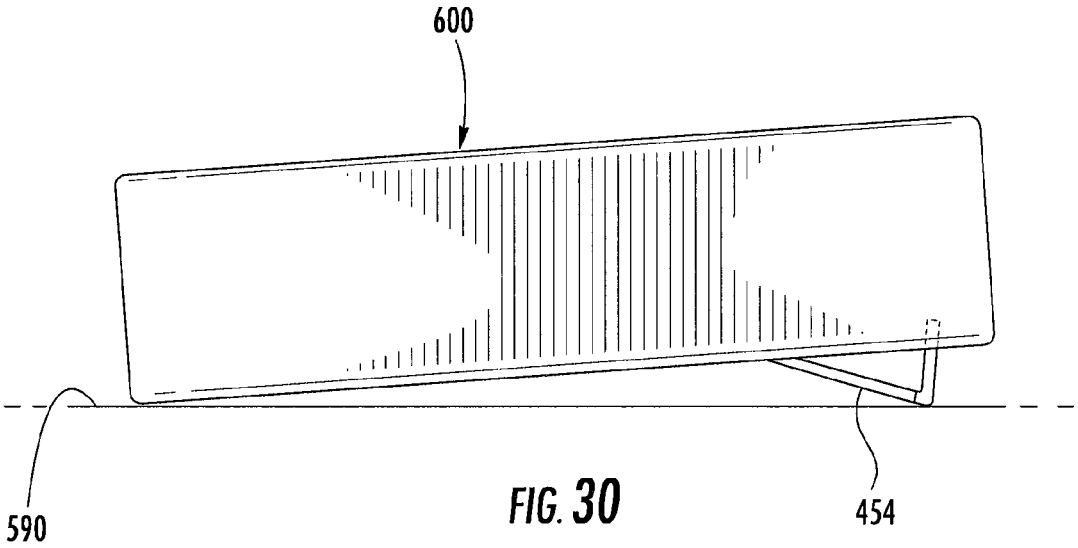
FIG. 30 is a side view of the package with the support stand deployed and sitting upon a horizontal surface, in accordance with the third embodiment of the present invention.

As best understood with reference to FIG. 28, the support stand 454 can be exposed by tearing the rearward openable portion 568 away from the package 600, by tearing along the tear line 570 (FIG. 22). This tearing can be initiated by a user forcing some of her fingers against the access flap 574, and then grabbing and pulling the access flap 574. Thereafter, and as best understood with reference to FIGS. 19 and 29, the support stand 454 can be deployed by respectively tearing along the tear lines 456, 458, and folding along the fold lines 457, 459 to configure the support stand as illustrated in FIG. 29. As illustrated in FIG. 30, the support stand 454 is deployed and the package 600 is upon a table top 590, or the like, so that gravity advantageously forces the contents of the bag 410 toward the end of the package that includes the spigot 412 (FIGS. 23, 26 and 27). FIGS. 28-30 could be characterized as being at least partially schematic because, for example, neither the forward access opening pattern 530 (FIG. 25) nor the forward openable portion 560 (FIG. 25) are clearly shown in them.

FIGS. 31-38 illustrate portions of liners and associated blanks respectively in accordance with fourth through seventh embodiments of the present invention. The fourth through seventh embodiments of the present invention are like the third embodiment of the present invention except for variations noted and variations that will be apparent to those of ordinary skill in the art. In this regard, for features fourth through seventh embodiments that are at least generally like corresponding features of the third embodiment of the present invention, the same respective element numbers are used except that the elements numbers for the subject features have been respectively incremented.

Figure 31:
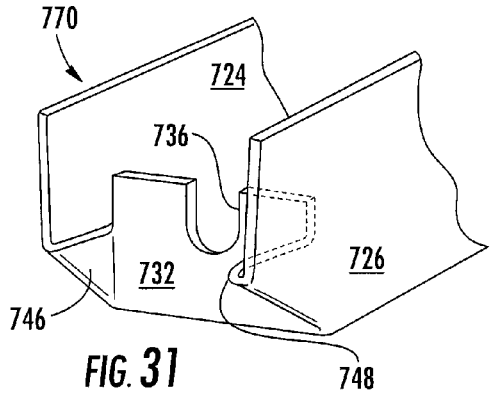
FIG. 31 is generally a front pictorial view of a portion of an erected liner in accordance with a fourth embodiment of the present invention.
Figure 32:
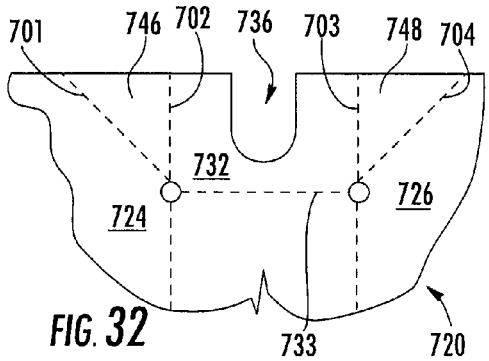
FIG. 32 is a schematic plan view of a portion of a blank from which the liner of FIG. 31 can be erected.

FIG. 31 is a pictorial view of a portion of a liner 770, and FIG. 32 is a plan view of a portion of a blank 720 from which the liner 770 can be erected, in accordance with the fourth embodiment of the present invention. The liner 770 has a holding flap 732 with a gripping opening 736 that is, in accordance with the fourth embodiment, for being in receipt of the neck of a bag. The holding flap 732 is connected to the base panel 722 by the fold line 733. Opposite edges of the holding flap 732 are respectively connected to the first and second side panels 724, 726 by first and second gusset panels 746, 748 that are respectively defined by fold lines 701, 702, 703, 704. The gusset panels 746, 748 are for at least partially supporting the holding flap 732 in an upright configuration while the liner 770 is erected.

Figure 33:
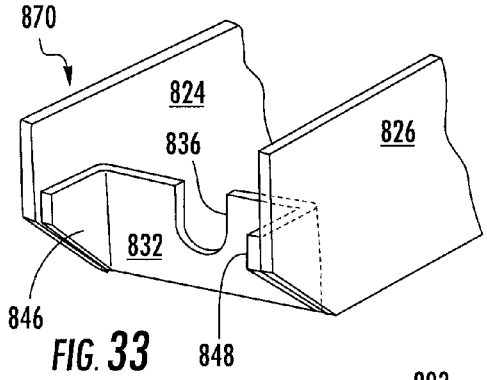
FIG. 33 is generally a front pictorial view of a portion of a liner in accordance with a fifth embodiment of the present invention.
Figure 34:
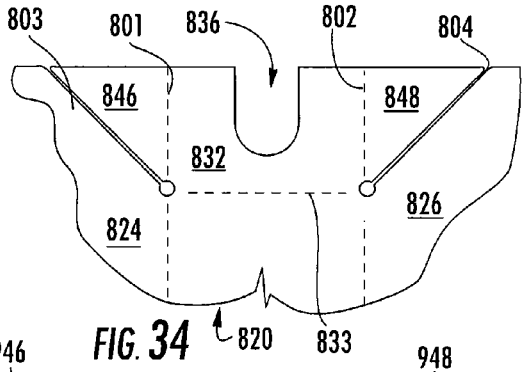
FIG. 34 is a schematic plan view of a portion of a blank from which the liner of FIG. 33 can be erected.

FIG. 33 is a pictorial view of a portion of a liner 870, and FIG. 34 is a plan view of a portion of a blank 820 from which the liner 870 can be erected, in accordance with the fifth embodiment of the present invention. The liner 870 has a holding flap 832 with a gripping opening 836 that is, in accordance with the fifth embodiment, for being in receipt of the neck of a bag. The holding flap 832 is connected to the base panel 822 by the fold line 833. Opposite edges of the holding flap 832 are respectively connected to first and second side flaps 846, 848 by fold lines 801, 802. The first and second side flaps 846, 848 are respectively defined by the fold lines 801, 802 and slits 803, 804, or the like. The first and second side flaps 846, 848 can be respectively attached (e.g., adhered) to the inner faces of the first and second side panels 824, 826 to secure the holding flap 832 in an upright position. In this erected configuration of the liner 870, the opposite edges of the holding flap 832 can respectively be secured in opposing-face-to-face contact with the first and second side panels 724, 726 of the liner 870, even when the liner is not inserted into the box 550 (FIGS. 23-25), or the like. That is, the first and second side flaps 846, 848 can be respectively attached (e.g., adhered) to the first and second side panels 824, 826 to secure the liner 870 in its erected configuration. Stated differently, the first and second side flaps 846, 848 are for respectively connecting the opposite edges of the holding flap 732 to the side panels 824, 826 and thereby securing the liner 470 in its erected configuration.

Figure 35:
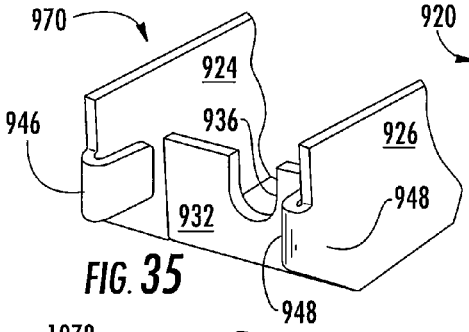
FIG. 35 is generally a front pictorial view of a portion of a liner in accordance with a sixth embodiment of the present invention.
Figure 36:
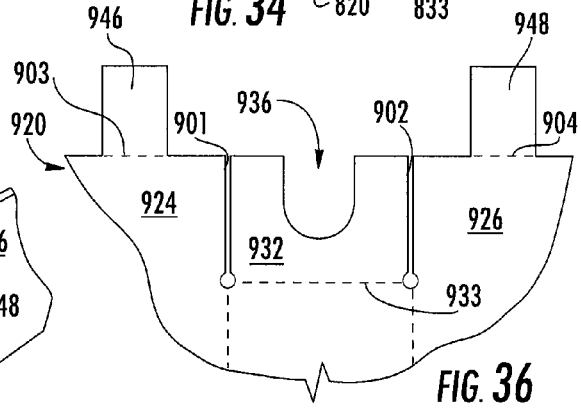
FIG. 36 is a schematic plan view of a portion of a blank from which the liner of FIG. 35 can be erected.

FIG. 35 is a pictorial view of a portion of a liner 970, and FIG. 36 is a plan view of a portion of a blank 920 from which the liner 970 can be erected, in accordance with the sixth embodiment of the present invention. The liner 970 has a holding flap 932 with a gripping opening 936 that is, in accordance with the sixth embodiment, for being in receipt of the neck of a bag. The holding flap 932 is connected to the base panel 922 by the fold line 933. Opposite edges of the holding flap 932 are respectively separated from the first and second side panels 924, 926 by slits 901, 901, or the like. Side flaps 946, 948 are respectively attached to the front edges of the first and second side panels 924, 926 by fold lines 903, 904. The first and second side flaps 946, 948 are folded inwardly and respectively attached to (e.g. adhered to) the inner faces of the first and second side panels 924, 926 so that the rearward-facing ends of the side flaps 946, 948 engage the front face of the holding flap 932 to help hold the holding flap 932 in an upright position when the liner 970 is erected. That is, the side flaps 946 are for at least partially supporting the holding flap 432 in an upright configuration while the liner 470 is erected.

Figure 37:
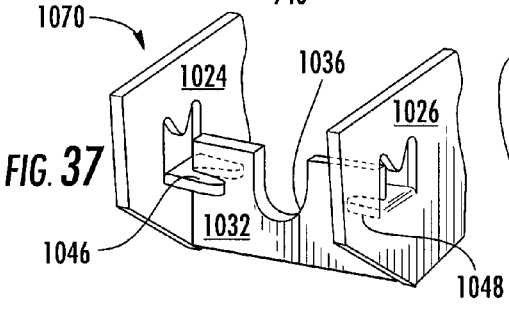
FIG. 37 is generally a front pictorial view of a portion of a liner in accordance with a seventh embodiment of the present invention.
Figure 38:
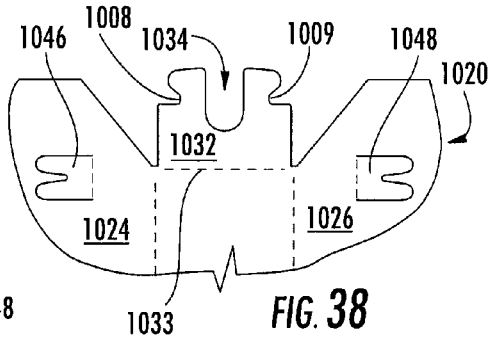
FIG. 38 is a schematic plan view of a portion of a blank from which the liner of FIG. 37 can be erected.

FIG. 37 is a pictorial view of a portion of a liner 1070, and FIG. 38 is a plan view of a portion of a blank 1020 from which the liner 1070 can be erected, in accordance with the seventh embodiment of the present invention. The liner 1070 has a holding flap 1032 with a gripping opening 1036 that is, in accordance with the seventh embodiment, for being in receipt of the neck of a bag. The holding flap 1032 is connected to the base panel 1022 by the fold line 1033. The first and second side panels 1024, 1026 respectively include first and second gripping tabs 1046, 1048. As illustrated, each of the gripping tabs 1046, 1048 is defined by a fold line that extends between the ends of a generally M-shaped slit or tear line. When the liner 1070 is erected, the first and second gripping tabs 1046, 1048 are folded inwardly from (e.g., struck from) the side panels 1024, 1026 so that the notches of the gripping tabs 1046, 1048 respectively mate with notches 1008, 1009 defined in opposite edges of the holding flap 1032 to respectively connect the opposite edges of the holding flap 1032 to the side panels 1024, 1026 and thereby support the holding flap 1032 in an upright position.

Although each of the gripping openings 736, 836, 936, 1036 is illustrated as not including radial tabs (e.g., see radial tabs 442 of FIG. 19), the gripping openings can alternatively include radial tabs.

In accordance with the first through seventh embodiments of the present invention, the holding flap can be characterized as being distinct from the carton it is within because the holding flap is part of a liner that at least partially lines the carton. On the other hand, in accordance with an eighth embodiment of the present invention that is described below, the holding flap can be characterized as not being distinct from the carton because the holding flap can be characterized as being part of the carton. Other types of holders, for holding necks of bags, or the like, are also within the scope of the present invention.

Figure 39:
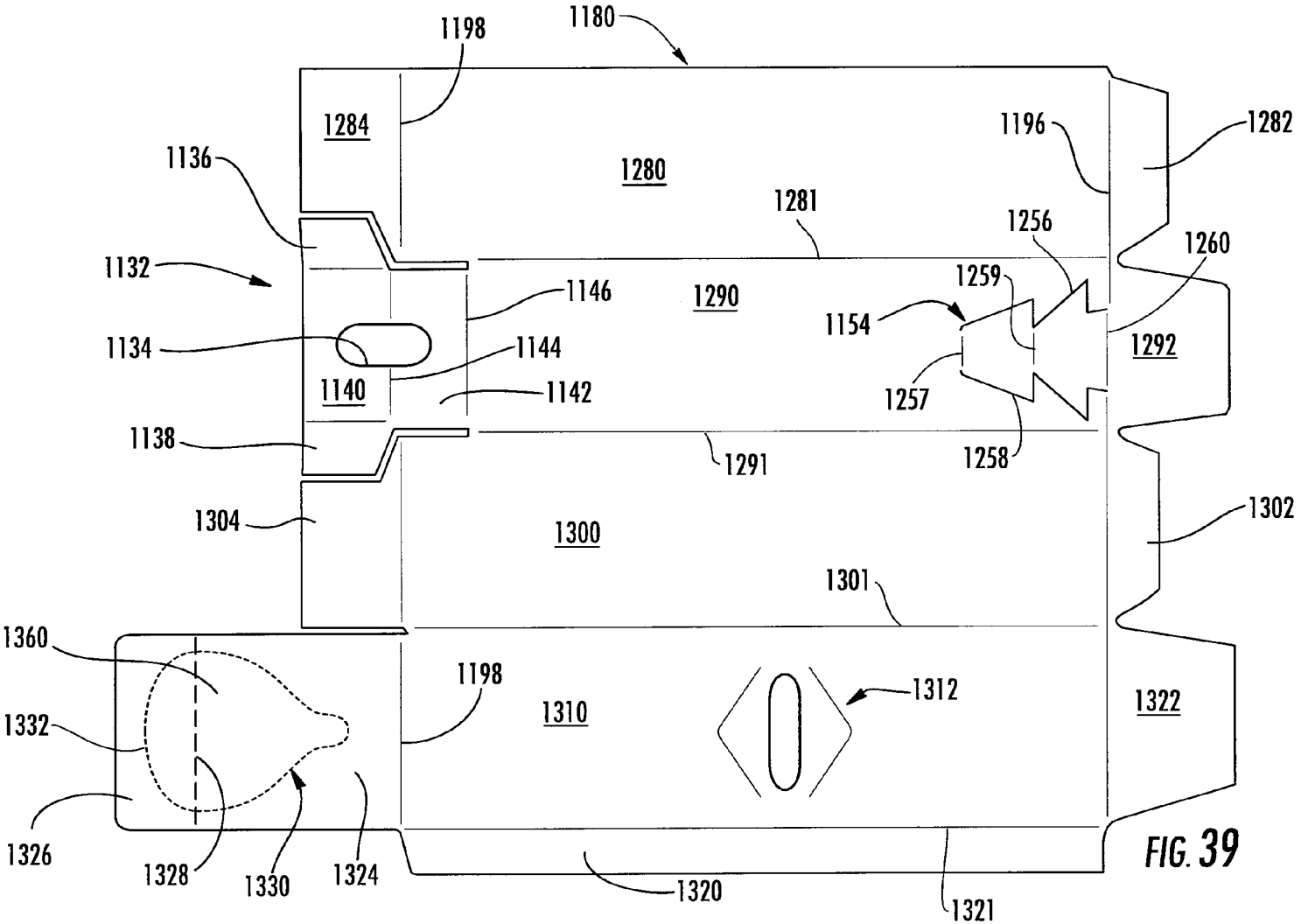
FIG. 39 is a schematic plan view of a blank from which a box can be formed, in accordance with an eighth embodiment of the present invention.

FIGS. 39-43 are illustrative of an eighth embodiment of the present invention. FIG. 39 is a plan view of a blank 1180 that can be used to construct an outer container, or more specifically a carton 1350 (FIGS. 40-43), of a package 1400 (FIGS. 42 and 43) that includes a flexible bag 1110. In this embodiment, the carton 1350 supports the bag 1110 without requiring a liner of the type described above.

In accordance with the eighth embodiment of the present invention and as best understood with reference to FIG. 39, the blank 1180 includes first side panel 1280 foldably connected to a bottom panel 1290 along fold line 1281, a second side panel 1300 foldably connected to the bottom panel 1290 along fold line 1291, and a top panel 1310 foldably connected to the second side panel 1300 along fold line 1301. An adhesive flap 1320 can be foldably attached to the top panel 1310 along fold line 1321. The adhesive flap 1320 may alternatively be located at the opposite end of the blank 1180.

The first side panel 1280 is foldably connected to side end flaps 1282, 1284. The bottom panel 1290 is foldably connected to a first bottom flap 1292. The second side panel 1200 is foldably connected to side end flaps 1302, 1304. The top panel 1310 is foldably connected to a rearward top end flap 1322 and a forward top end flap 1324. A handle 1312 of conventional configuration may also be formed in the top panel 1310. The handle 1312 can be in the form of a pair of two angled stress-relieving score lines that extend around a handle opening, or more specifically that extend around two flaps (not shown) that are for being separated from one another along a tear line and/or slit (not shown) for providing access to the handle opening.

The end flaps 1282, 1292, 1302, 1322 extend generally along a first marginal area of the blank 1180 and may be foldably connected along a common longitudinal fold line 1196. The end flaps 1284, 1304, 1324 extend generally along a second marginal area of the blank 1180 and may be foldably connected along a common longitudinal fold line 1198. The fold lines 1196, 1198 need not be straight, and may be offset at one or more locations.

A fold line 1328 extends across the forward top end flap 1324 so that an attachment flap 1326 is foldably connected to the remainder of the forward top end flap 1324. An access opening pattern 1330 is formed in the forward top end flap 1324. The access opening pattern 1330 defines a openable portion 1360 in the completed package 1400, as will be discussed in greater detail below. The access opening pattern 1330 can be formed from, for example, score lines, cut/space lines, cut lines, other lines of disruption and combinations thereof, that allow removal or opening of a portion of the carton 1350. More specifically, the access opening pattern 1330 can be formed in the forward top end flap 1324 by a tear line 1332.

A holding flap 1132 is foldably connected to the bottom panel 1290 at a fold line 1146. The holding flap 1132 has a fold line 1144 that divides the holding flap 1132 into inner and outer panels 1142, 1140. The holding flap 1132 can be characterized as being a portion of the bottom panel 1290 that is defined by the fold line 1146, or that is more specifically defined by the fold lines 1146 and 1144. A gripping opening 1134 extends through the holding flap 1132. First and second side tabs 1136, 1138 extend from either side of the outer panel 1140 of the holding flap 1132. The fold line 1146, by way of which the holding flap 1132 is foldably attached to the base panel 1290, is positioned rearwardly of the fold line 1198.

A support stand 1154 may optionally be included in the rearward end of the bottom panel 1290. As illustrated in FIG. 39, the support stand 1154 is defined by slits or tear lines 1256, 1258 that extend in a generally zigzag fashion from a fold line 1257, which extends between opposite ends of the tear lines 1256, 1258, respectively to ends of a slit or tear line 1260, which extends between opposite ends of the tear lines 1256, 1258. Another fold line 1259 can extend between the tear lines 1256, 1258 for facilitating deployment of the support stand 1154, as will be discussed in greater detail below. The support stand 1154 can be used to tilt the package 1400 and thereby aid in dispensing of contents of the bag 1110, as will be discussed in greater detail below.

Figure 40:
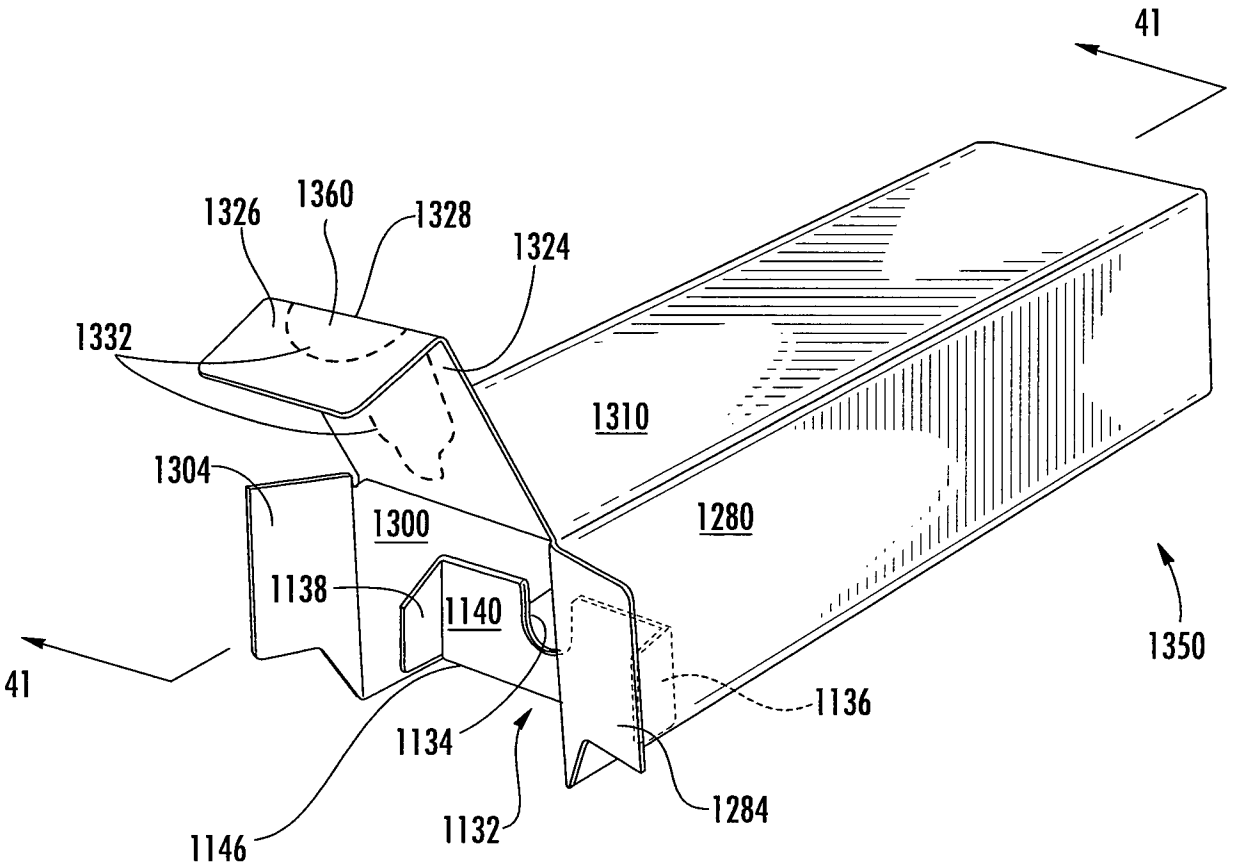
FIG. 40 is generally a front pictorial view that illustrates an open and unfilled box erected from blank of FIG. 39.

FIG. 40 is a pictorial view of the carton 1350 erected from the blank 1180 and in isolation, and a method of erecting the carton 1350 will be described in the following, in accordance with the eighth embodiment of the present invention. The erection of the carton 1350 can begin by forming the blank 1180 into a generally tubular shape by folding along the fold lines 1281, 1291, 1301, 1321 and adhering the adhesive flap 1320 to the first side panel 1280. The holding flap 1132 is folded about the fold line 1144 so that the holding flap 1132 is doubled over and thereby transformed into a two-ply holding flap or panel. More specifically, the holding flap 1132 is folded about the fold line 1144 so that that the inner and outer panels 1142, 1140 are in opposing face-to-face configuration or contact with respect to one another, and are at least generally perpendicular to the bottom panel 1290.

Figure 41:
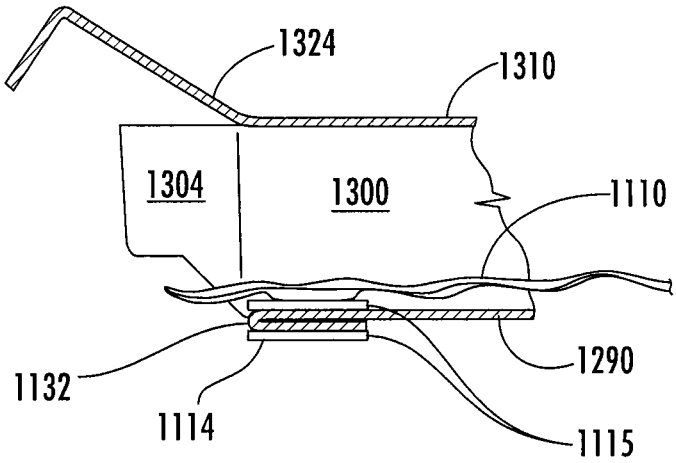
FIG. 41 is a vertical cross-sectional view of a portion of the box taken along line 41-41 of FIG. 40, except that a bag and associated neck are installed to a partially erected holding flap of the box, in accordance with the eighth embodiment of the present invention.

The neck 1114 of the bag 1110 is mounted to the gripping opening 1134 of the two-ply holding flap 1132. The neck 1114 is typically mounted by introducing an annular groove of the neck 1114 to the gripping opening 1134 so that flanges 1115 of the neck engage the oppositely facing surfaces of the two-ply holding flap 1132 as illustrated in FIG. 41. Accordingly, the holding flap 1132 can be more generally referred to as a holder. As an example, the partially erected blank 1180 (FIG. 39) illustrated in FIG. 41 can be referred to as a construct.

Figure 42:
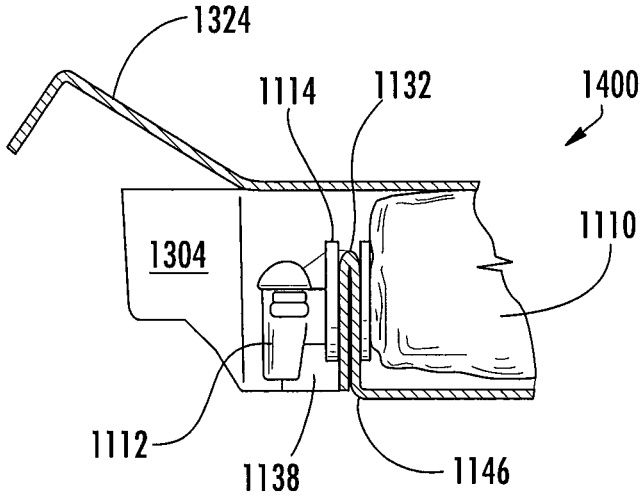
FIG. 42 is like FIG. 41, except that the holding flap is fully erected, the bag is filled with a flowable material, and a spigot has been installed to the neck.
Figure 43:
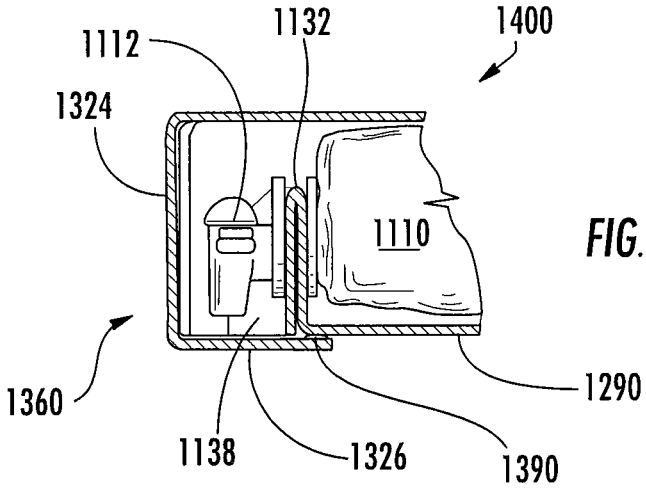
FIG. 43 is like FIG. 42, except that the box has been closed.

Thereafter, the two-ply holding flap 1132 is folded upwardly about the fold line 1146 so that the two-ply holding flap 1132 is generally perpendicular to the bottom panel 1290 as illustrated in FIG. 42. The first and second side tabs 1136, 1138 of the outer panel 1140 are folded so that they abut the first and second side panels 1280, 1300, respectively. The first and second side tabs 1136, 1138 are typically respectively secured to the first and second side panels 1280, 1300 with adhesive material or any other suitable fastening mechanism. Accordingly, the holding flap 1132 can also be referred to as a holding panel. Alternatively, the holding flap 1132 need not necessarily be in a two-ply configuration, and mechanisms other than the side tabs 1136, 1138 can be used to secure the holding flap to the first and second side panels 1280, 1300, or such securing can be omitted if desired.

The bag 1110 is typically filled with flowable material via the neck 1114 after the neck has been installed to the two-ply holding flap 1132, either before or after the two-ply holding flap 1132 is folded upwardly about the fold line 1146 so that the two-ply holding flap 1132 is generally perpendicular to the bottom panel 1290. The bag 1110, neck 1114 and spigot 1112 of this embodiment can be at least generally respectively like those of the previously discussed embodiments. For example and reiterating from above, the spigot 1112 is typically installed to the neck 1114 after the bag 1110 has been filled, or partially filled, with the flowable material, so that the neck is closed by the spigot; the spigot 412 can alternatively be installed to the neck 1114 prior to the introduction of the flowable material into the bag 410, so that the flowable material can be introduced into the bag by way of the spigot; and alternatively the neck 1114 can be closed by devices other than spigots.

In the erected carton 1350, a rear cover panel typically is provided by respectively overlapping and adhered together end flaps 1282, 1292, 1202, 1322 to closing a back or non-access end of the carton 1350. In the fully erected carton 1350 of the eighth embodiment, a forward cover panel that closes the front end of the carton, or more specifically a front access opening of the carton, is typically provided by respectively overlapping and adhering together the end flaps 1284, 1304, 1324. In this regard, the forward access opening of the carton 1350 is shown in an open configuration in FIG. 40, and in a closed configuration in FIG. 43. More specifically regarding the forward top end flap 1324 of the eighth embodiment, as best understood with reference to FIG. 43, it is folded down and the attachment flap 1326 is adhered or otherwise secured to the bottom panel 1290 to close the carton 1350 and complete erection of the package 1400. With the carton 1350 closed in this manner, access to the spigot 1112, bag 1110 and neck 114 are obstructed. More specifically and for example, the spigot 1112 is disposed within the interior of the carton 1350 so that access to the spigot is at least temporarily restricted in a manner that at least temporarily restricts any dispensing of flowable material from the bag 1110 by way of the spigot. More specifically, and for example, the spigot 1112 is completely enclosed in the carton 1350.

As one example, the forward access opening of the package 1400 can be opened by a user by tearing the access opening pattern 1330 (i.e., the tear line 1332) and thereby removing the openable portion 1360 that is defined by the access opening pattern 1330. In accordance with the illustrated embodiments, an end user of the package 1400 of the eighth embodiment can remove the openable portion 1360 of the package 1400, dispense flowable material from the package 1400 via the spigot 1112, and deploy and use the support stand 1154 of the package respectively in at least generally the same as manner as a user would carry out corresponding actions with respect to the package 600 (FIG. 25) of the third embodiment, except that a rearward openable portion 568 (FIGS. 22 and 28) typically need not be removed to gain access to the support stand 1154.

For each of the above-described bag-in-a-box packages, flowable contents (e.g., a beverage) can put into the bag via the bag's neck at a wide variety of different times during the assembly of the package, and the spigot can be installed to the neck after the bag has been filled, or partially filled, with the flowable material, so that the neck is closed by the spigot. Alternatively, the spigot can be installed to the neck prior to filling the bag, and the bag can be filled through the spigot. Similarly, for each of the above-described bag-in-a-box packages, the neck or the like can be mounted to the gripping opening at a wide variety of different times during the assembly of the package. For example, the neck or another portion of the spigot assembly can be mounted to the gripping opening prior to the bag being filled with the flowable material, while the bag is being filled with the flowable material, or after the bag is filled with the flowable material.

Figure 44:
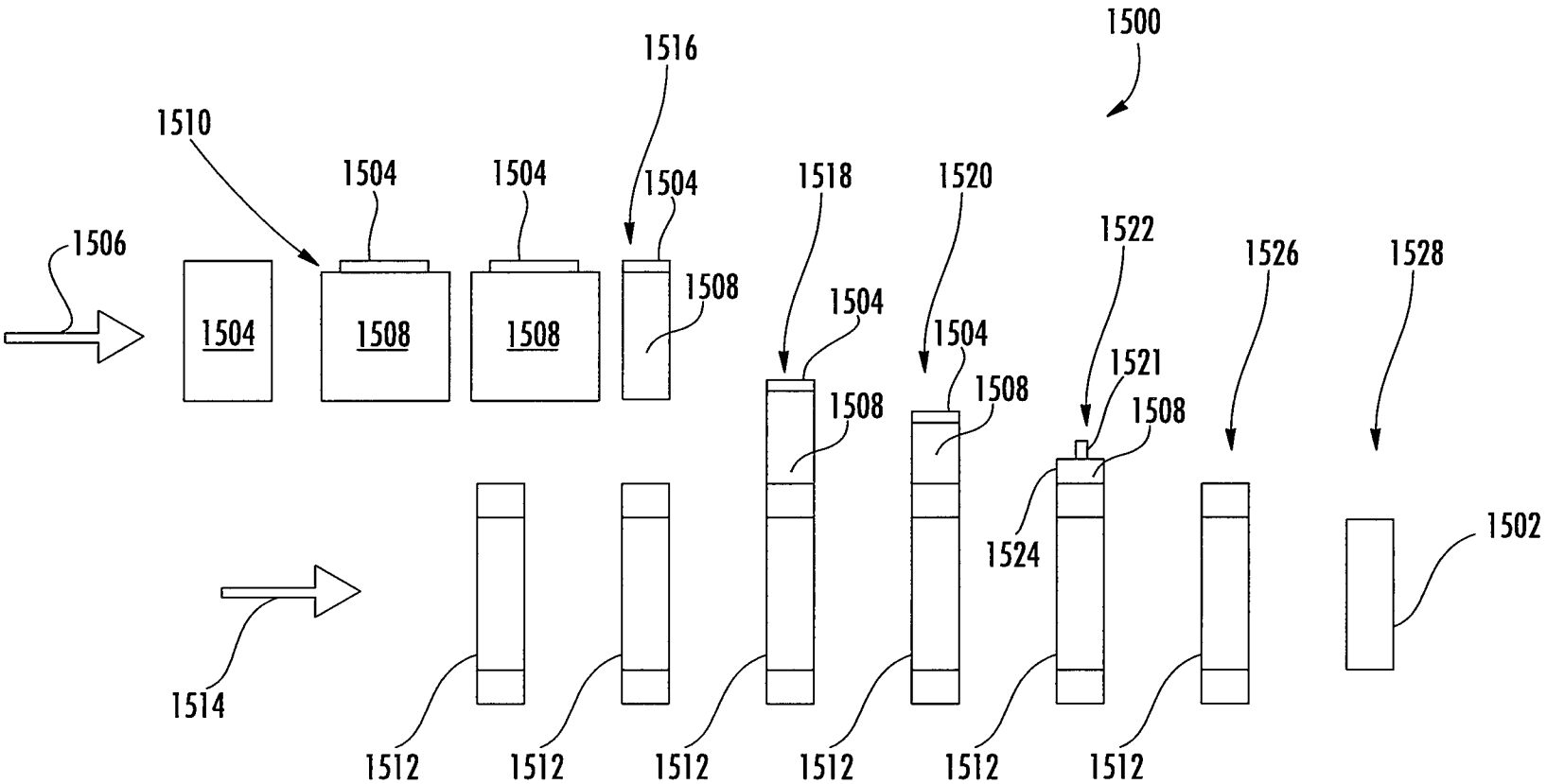
FIG. 44 illustrates a system and method for assembling packages in accordance with one example of the present invention.

FIG. 44 schematically illustrates an example of a system 1500 and method that will be generally described in the following and may be used for assembling packages 1502 (e.g., packages 21, 200 or 600) of the first, second third, forth, fifth, sixth and seventh embodiments of the present invention. As illustrated in FIG. 44, liner blanks 1504 (e.g., blanks 22, 222, 420, 720, 820, 920 or 1020) are serially carried from left to right along a first path of travel that is partially schematically illustrated by arrow 1506. Bags 1508 (e.g., bags 26, 226 or 410) are respectively superposed with, and mounted to, the liner blanks 1504 at a superposing station 1510. The mounting includes attaching the necks (e.g., necks 28, 228 or 414) of the bags 1508 to the gripping openings (e.g., gripping openings 42, 242, 436, 736, 836, 936 or 1036) of the liner blanks 1504. Alternatively, the bags 1508 can be serially carried along the first path of travel 1506, with the liner blanks 1504 being mounted to the bags.

As illustrated in FIG. 44, at least partially open cartons 1512 (e.g., cartons 24, 224 or 550) are serially carried from left to right along a second path of travel, which is partially schematically illustrated by arrow 1514, so that the cartons are respectively aligned with the liner blanks 1504 that have the bags 1508 respectively attached thereto. At a folding station 1516, the side panels (e.g., side panels 70, 256, 264, 424, 426, 724, 726, 824, 826, 924, 926, 1024 or 1026) of the blanks 1504 are folded so that the blanks 1504 to which the bags 1508 are mounted are partially erected. These partially erected blanks 1504 can be referred to as constructs, or the like. At an inserting station 1518, the partially erected blanks 1504 with the bags 1508 attached thereto are respectively partially inserted into the cartons 1512. At a filling station 1520, the bags 1508 that are attached to the partially erected blanks 1504 that are partially inserted into the cartons 1512 are at least partially filled with flowable material. After a bag 1508 is at least partially filled, the closed spigot 1521 (e.g., spigot 44, 244 or 412) mounted to the bag keeps the flowable material from escaping from the bag. At a folding station 1522, the holding flaps (e.g., holding flaps 40, 240, 432, 732, 832, 932 or 1032) of the blanks 1504 are folded and optionally connected to the respective side panels (e.g., side panels 70, 256, 264, 424, 426, 724, 726, 824, 826, 924, 926, 1024 or 1026) to complete the erection of the liners 1524 (e.g., liners 20, 220, 470, 770, 870, 970 or 1070). At an inserting station 1526, the liners 1523 are fully inserted into the respective cartons 1512. At a closing station 1528, the ends of the cartons 1512 are closed (e.g., by respectively overlapping and adhering the flaps 30, 492, 494, 502, 504, 512, 514, 522, 524 or the like) to complete the assembly of the packages 1502.

The operations described above with reference to FIG. 44 can be carried out manually, by automated machinery, or by a combination of automated machinery and manual operations. Examples of some automated machinery that could be used in automating the operations described above with reference to FIG. 44 include, but are not limited to, conveyors, pick-in-place mechanisms (e.g., such as available from Minnesota Automation (Crosby, Minn.)), and other automated machinery.

In accordance with other embodiments of the present invention, the arrangement of the above-described stations and/or operations described with reference to FIG. 44 can be changed. For example and in accordance with another exemplary embodiment of the present invention, the bags 1508 can be filled with the flowable material, and closed by their spigots, or the like, prior to the bags being superposed with, and mounted to, the liner blanks 1504 at the superposing station 1510. That is and for example, the necks (e.g., necks 28, 228 or 414) of the previously filled bags 1508 can be attached to the gripping openings (e.g., gripping openings 42, 242, 436, 736, 836, 936 or 1036) of the liner blanks 1504 at the superposing station 1510, so that the filling station 1520 would not be between the inserting and folding stations 1518, 1522.

In accordance with the exemplary embodiments of the present invention, the blanks can be formed from paperboard, corrugated cardboard or other materials having properties suitable for at least generally enabling the respective functionalities described above. Paperboard is typically of a caliper such that it is heavier and more rigid than ordinary paper, and corrugated cardboard is typically of a caliper such that it is heavier and more rigid than paperboard. Typically, at least the side of the paperboard or cardboard that will be an exterior surface in the carton erected therefrom will be coated with a clay coating, or the like. The clay coating can be printed over with product, advertising, price-coding, and other information or images. The blanks may then be coated with a varnish to protect any information printed on the blanks. The blanks may also be coated with, for example, a moisture barrier layer, on one or both sides. The blanks can also be laminated to or coated with one or more sheet-like materials.

In accordance with one specific example of the exemplary embodiments that include both a carton and a liner for lining the carton, the carton blank will typically be constructed of a material that is more aesthetically appealing and weaker than the material from which the liner blank will be constructed. In accordance with one more specific example, the carton blank will typically be constructed of clay-coated paperboard, or the like, and the liner blank will typically be constructed of corrugated cardboard, or the like. This contrast between the materials of the liner and carton blanks can provide an advantageous balance between costs and aesthetics. In accordance with one specific example of the exemplary embodiment that includes a carton without a liner for lining the carton, the carton blank is constructed of a clay-coated corrugated cardboard, or a sufficiently sturdy clay-coated paperboard. Other construction materials are also within the scope of the present invention.

In accordance with the exemplary embodiments of the present invention, a fold line can be any at least somewhat line-like arranged, although not necessarily straight, form of weakening that facilitates folding therealong; and a tear line can be any at least somewhat line-like arranged, although not necessarily straight, form of weakening that facilitates tearing therealong. More specifically, but not for the purpose of narrowing the scope of the present invention, conventional fold lines include: a crease, such as formed by folding; a score line, such as formed with a blunt scoring knife, or the like, which creates a crushed portion in the material along the desired line of weakness; a slit that extends partially into the material along the desired line of weakness, and/or a series of spaced apart slits that extend partially into and/or completely through the material along the desired line of weakness; or various combinations of these features. More specifically, but not for the purpose of narrowing the scope of the present invention, conventional tear lines include: a slit that extends partially into the material along the desired line of weakness, and/or a series of spaced apart slits that extend partially into and/or completely through the material along the desired line of weakness, or various combinations of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present invention for each of the tear lines to be replaced with a continuous slit, or the like.

It will be understood by those skilled in the art that while the present invention has been discussed above with reference to exemplary embodiments, various additions, modifications and changes can be made thereto without departing from the spirit and scope of the invention as set forth in the following claims.

What is claimed is:

1. A package for dispensing a flowable material, the package comprising:

a carton including a plurality of panels that extends at least partially around an interior of the carton, wherein the plurality of panels includes a base panel having opposite edges, a top panel having opposite edges, and opposite side panels that respectively extend between the side edges of the top and base panels, at least one holding panel foldably connected to and extending upwardly from a front edge of the base panel, a top end flap foldably connected to and extending downwardly from a front edge of the top panel for at least partially closing a front end of the carton, and an attachment flap connected to and extending rearwardly from a lower edge of the top end flap to proximate the base panel;

a flexible bag for containing the flowable material, wherein the bag is positioned in the interior of the carton; and a spigot operatively connected to the bag for selectively dispensing the flowable material from the bag, wherein the at least one holding panel is holding the spigot so that the spigot is simultaneously disposed at least partially within the interior of the carton, and proximate the front end of the carton, and wherein the at least one holding panel comprises a first panel that is foldably connected to a second panel, the second panel is foldably connected to the base panel, the second panel is folded relative to the first panel to reinforce the holding panel, and the first panel and the second panel have features for holding the spigot.

2. The package according to claim 1, wherein a rear portion of the attachment flap is connected to the base panel.

3. The package according to claim 1, wherein the least one holding panel is a doubled over holding flap that projects into the interior of the carton.

4. The package according to claim 1, wherein:

the first and second panels of the at least one holding panel are in opposing face-to-face configuration with respect to one another.

5. The package according to claim 4, wherein the first and second panels are in opposing face-to-face contact with respect to one another.

6. A package for dispensing a flowable material, the package comprising:

a carton including a plurality of panels that extends at least partially around an interior of the carton, an access opening that is for providing access to the interior of the carton, and a holder connected by at least one fold line to at least one panel of the plurality of panels;

a flexible bag for containing the flowable material, wherein the bag is positioned in the interior of the carton; and a spigot operatively connected to the bag for selectively dispensing the flowable material from the bag, wherein the holder is holding the spigot so that the spigot is simultaneously disposed at least partially within the interior of the carton, and proximate the access opening of the carton, and wherein the holder comprises a first panel that is foldably connected to a second panel, the second panel is foldably connected to one panel of the plurality of panels, the second panel is folded relative to the first panel to reinforce the holder, and the first panel and the second panel have features for holding the spigot.

7. The package according to claim 6, wherein the holder is a holding flap that projects into the interior of the carton and is connected by the fold line to a base panel of the plurality of panels.

8. The package according to claim 6, wherein the holder comprises a doubled over portion of the at least one panel of the plurality of panels.

9. The package according to claim 6, comprising an end flap that at least partially closes a front end of the carton, wherein the end flap at least partially defines the access opening, and a portion of the end flap obstructs the access opening.

10. The package according to claim 6, wherein:

the at least one panel of the plurality of panels comprises a base panel of the plurality of panels, the plurality of panels further includes opposite side panels that are respectively foldably connected to, and extend upwardly from, opposite edges of the base panel, and opposite edges of the holder are respectively adjacent the opposite side panels.

11. The package according to claim 10, wherein the opposite edges of the holder are respectively abutting the opposite side panels.

12. The package according to claim 10, wherein the opposite edges of the holder are respectively connected to the opposite side panels.

13. A package for dispensing a flowable material, the package comprising:

a carton at least partially formed by erecting a blank that includes a plurality of panels that are respectively foldably connected to one another, wherein the carton comprises the plurality of panels extending at least partially around an interior of the carton, and an access opening for providing access to the interior of the carton, and wherein the plurality of panels includes a base panel having opposite edges, a top panel having opposite edges, opposite side panels that respectively extend between the edges of the top and base panels, at least one holding panel foldably connected to at least one panel selected from the group consisting of the base panel, the top panel and the side panels;

a flexible bag for containing the flowable material, wherein the bag is positioned in the interior of the carton; and a spigot operatively connected to the bag for selectively dispensing the flowable material from the bag, wherein the at least one holding panel extends into the interior of the carton and is holding the spigot so that the spigot is simultaneously disposed at least partially within the interior of the carton, and proximate the access opening of the carton, and wherein the at least one holding panel comprises a first panel that is foldably connected to a second panel, the second panel is foldably connected to the base panel, and the second panel is folded relative to the first panel to reinforce the holding panel, and the first panel and the second panel have features for holding the spigot.

14. The package according to claim 13, wherein the at least one holding panel is a holding flap that is foldably connected to, and extends upwardly from, the base panel.

15. The package according to claim 13, wherein:

the first and second panels of the at least one holding panel are in opposing face-to-face configuration with respect to one another.

16. The package according to claim 15, wherein the first and second panels are in opposing face-to-face contact with respect to one another, and a neck of the spigot extends through both of the first and second panels.

17. The package according to claim 16, wherein:

the at least one holding panel is proximate a front end of the carton, is positioned between the side panels, extends substantially perpendicularly from proximate each of the side panels, and extends substantially perpendicularly, upwardly from the base panel; and the flexible bag is positioned between the top and base panels, between the side panels, and between the at least one holding panel flap and a rear end of the carton.

18. The package according to claim 17, wherein the front end of the carton is obstructed by a front panel of the plurality of panels of the carton, and the front panel comprises an openable portion that is for being opened to at least further expose the access opening of the carton, for providing access to the spigot in the interior of the carton.

19. The package according to claim 13, wherein opposite edges of the at least one holding panel are respectively connected to the side panels by way of side flaps.

20. The package according to claim 13, wherein the base panel consists essentially of a single panel.

21. The package according to claim 13, wherein:

the base panel includes a front edge, the at least one holding panel includes a lower edge, and a fold line connects the lower edge of the at least one holding panel to the front edge of the base panel.

22. The package according to claim 13, comprising:

a first fold line connecting a first side panel of the opposite side panels to a first edge of the opposite edges of the base panel;

a second fold line connecting a second side panel of the opposite side panels to a second edge of the opposite edges of the base panel; and a third fold line connecting the at least one holding panel to a front edge of the base panel, wherein the third fold line extends substantially all the way to both of the first and second fold lines.

23. A blank capable of being used with a bag having a neck, the blank comprising:

a plurality of panels that are respectively foldably connected to one another by a plurality of fold lines that extend in a longitudinal direction, wherein the plurality of panels is adapted for extending at least partially around an interior of the carton when the carton is erected from the blank, and the plurality of panels includes a first panel having a forward first edge extending in a lateral direction that is crosswise to the longitudinal direction, wherein the first panel extends in the longitudinal direction rearwardly from the forward first edge, and a second panel having a forward second edge extending in the lateral direction, wherein the second panel extends in the longitudinal direction rearwardly from the forward second edge, and the forward first edge is positioned rearwardly of the forward second edge; and a holding flap foldably connected to and extending forwardly from the forward first edge of the first panel, the holding flap including a gripping opening for holding the neck of the bag, the holding flap comprises an inner panel foldably connected to an outer panel, the inner panel is foldably connected to the first panel, the inner panel is for being folded relative to the outer panel to reinforce the holding flap, and the inner panel and the outer panel comprise the gripping opening of the holding flap.

24. The blank according to claim 23, wherein the plurality of panels comprises a third panel positioned between and foldably connected to the first and second panels by way of respective fold lines of the plurality of fold lines.

25. The blank according to claim 23, wherein the holding flap includes a fold line that foldably connects the inner panel and the outer panel, and at least a portion of the gripping opening extends at least partially into each of the inner and outer panels of the holding flap.

26. The blank according to claim 23, comprising side tabs respectively extending from longitudinally extending opposite edges of the holding flap.

27. The blank according to claim 23, wherein a portion of the holding flap is laterally wider than the first panel.

28. The blank according to claim 23, further comprising an end flap foldably connected to and extending forwardly from the forward second edge of the second panel, wherein the end flap extends farther forwardly than does the holding flap.

29. The blank according to claim 28, further comprising an access opening pattern formed in at least the end flap, wherein the access opening pattern is for defining an openable portion of the carton when the carton is erected from the blank.

30. The blank according to claim 28, further comprising an attachment flap foldably connected to and extending forwardly from a laterally extending, forward edge of the end flap.

31. A method of erecting the blank of claim 23, comprising:

forming the blank into a generally tubular shape;

configuring the holding flap in a doubled over configuration, comprising causing relative folding between the inner panel and the outer panel, so that the inner panel and the outer panel are in opposing face-to-face configuration with respect to one another; and mounting the neck of the bag into the gripping opening of the doubled over holding flap.

* * * * *